US009091963B2

(12) United States Patent
Matsushita et al.

(10) Patent No.: US 9,091,963 B2
(45) Date of Patent: Jul. 28, 2015

(54) DEVELOPING DEVICE, CARTRIDGE AND ELECTROPHOTOGRAPHIC IMAGE FORMING APPARATUS

(71) Applicant: CANON KABUSHIKI KAISHA, Tokyo (JP)

(72) Inventors: Masaaki Matsushita, Yokohama (JP); Tomonori Matsunaga, Suntou-gun (JP); Shunsuke Mizukoshi, Yokohama (JP); Kohei Matsuda, Fujisawa (JP); Jun Miura, Kawasaki (JP); Takayuki Kanazawa, Yokohama (JP); Takashi Mukai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 53 days.

(21) Appl. No.: 13/687,658

(22) Filed: Nov. 28, 2012

(65) Prior Publication Data

US 2013/0164040 A1 Jun. 27, 2013

(30) Foreign Application Priority Data

Nov. 29, 2011 (JP) ..... 2011-260032
Nov. 14, 2012 (JP) ..... 2012-249882

(51) Int. Cl.
*G03G 15/08* (2006.01)

(52) U.S. Cl.
CPC ..... *G03G 15/0889* (2013.01); *G03G 15/0874* (2013.01); *G03G 15/0881* (2013.01); *G03G 2215/0682* (2013.01)

(58) Field of Classification Search
CPC ..... G03G 15/0874; G03G 15/0881; G03G 15/0886; G03G 15/0887; G03G 2215/0682; G03G 2215/0802; G03G 2215/0822; G03G 2215/0833
See application file for complete search history.

(56) References Cited

U.S. PATENT DOCUMENTS 5,079,591 A * 1/1992 Tomita et al. ..... 399/262
5,528,341 A 6/1996 Shishido et al.

(Continued)

FOREIGN PATENT DOCUMENTS

EP 1 367 459 A1 3/2003
JP 59-20252 2/1984

(Continued)

OTHER PUBLICATIONS

International Search Report and Written Opinion of the International Searching Authority in International Patent Application No. PCT/JP2012/081443, dated Oct. 2, 2013.

*Primary Examiner* — Clayton E Laballe
*Assistant Examiner* — Victor Verbitsky
(74) *Attorney, Agent, or Firm* — Fitzpatrick, Cella, Harper & Scinto

(57) ABSTRACT

A developing device includes: a flexible container, provide with an opening, for accommodating the developer; a frame for accommodating the container; an urging member, rotatably provided inside the frame, for urging the container by rotation thereof to deform the container; and a developer carrying member for carrying the developer on its surface to feed the developer. A distance X from a rotation center of the urging member to the surface of the developer carrying member and a length T from the rotation center of the urging member to a free end thereof for urging the container satisfy a relationship of X<T. A shielding member for preventing contact of the urging member with the developer carrying member is provided between the rotation center of the urging member and the surface of the developer carrying member or in a neighborhood thereof.

34 Claims, 56 Drawing Sheets

(56) References Cited

U.S. PATENT DOCUMENTS

| | | | |
|---|---|---|---|
| 5,642,187 | A | 6/1997 | Nomura et al. |
| 5,650,841 | A | 7/1997 | Matsuda et al. |
| 5,678,139 | A | 10/1997 | Nomura et al. |
| 5,697,022 | A | 12/1997 | Matsuda et al. |
| 5,825,472 | A | 10/1998 | Araka et al. |
| 5,867,751 | A | 2/1999 | Nomura et al. |
| 6,016,408 | A | 1/2000 | Hashimoto et al. |
| 6,101,352 | A | 8/2000 | Hashimoto et al. |
| 6,151,459 | A | 11/2000 | Hashimoto et al. |
| 6,272,300 | B1 | 8/2001 | Fujiwara et al. |
| 6,324,370 | B1 | 11/2001 | Isobe et al. |
| 6,501,913 | B2 | 12/2002 | Hattori et al. |
| 6,564,029 | B2 | 5/2003 | Kojima et al. |
| 6,836,639 | B2 | 12/2004 | Karakama et al. |
| 6,873,815 | B2 | 3/2005 | Matsuda et al. |
| 6,968,147 | B2 | 11/2005 | Matsuda et al. |
| 6,980,755 | B2 | 12/2005 | Numagami et al. |
| 7,200,350 | B2 | 4/2007 | Agata et al. |
| 7,277,659 | B2 | 10/2007 | Kobayashi et al. |
| 7,593,670 | B2 | 9/2009 | Matsuda et al. |
| 7,813,670 | B2 | 10/2010 | Matsuda |
| 8,000,630 | B2 | 8/2011 | Matsuda |
| 8,260,171 | B2 | 9/2012 | Matsuda |
| 2008/0199222 | A1* | 8/2008 | Nakajima ..... 399/254 |
| 2011/0170906 | A1 | 7/2011 | Matsushita et al. |
| 2011/0200340 | A1 | 8/2011 | Kojima et al. |
| 2012/0288303 | A1 | 11/2012 | Matsuda |

FOREIGN PATENT DOCUMENTS

| | | |
|---|---|---|
| JP | 1128351 | 9/1989 |
| JP | 04-066980 | 3/1992 |
| JP | 04-166963 | 6/1992 |
| JP | 11119536 | 4/1999 |
| JP | 2002068300 | 3/2002 |
| JP | 2008134483 | 6/2008 |
| WO | 2011/136129 A1 | 3/2011 |

* cited by examiner (a)

(b)

(a)

(b)

(a)

(b)

(a)

(b)

(a)

(b)

(c)

(a)

(b)

(a)

(b)

(a)

(b)

(c)

(a)

(b)

(a)

(b)

(a)

(b)

DEVELOPING DEVICE, CARTRIDGE AND ELECTROPHOTOGRAPHIC IMAGE FORMING APPARATUS

FIELD OF THE INVENTION AND RELATED ART

The present invention relates to a developing device for carrying a developer, accommodated in a developer accommodating container to feed the developer, a detachably mountable cartridge including the developing device, and an electrophotographic image forming apparatus including the cartridge.

The electrophotographic image forming apparatus forms an image on a recording material (medium) by using, e.g., an electrophotographic image forming process and may include, e.g., an electrophotographic copying machine, an electrophotographic printer (such as an LED printer or a laser beam printer), an electrophotographic facsimile machine, and the like.

Further, the cartridge refers to a cartridge, including at least the developing device, detachably mountable to a main assembly of the image forming apparatus and refers to a cartridge, prepared by integrally assembling the developing device and at least an electrophotographic photosensitive member, detachably mountable to the main assembly of the image forming apparatus.

Further, the developing device is accommodated in the image forming apparatus or the cartridge.

In a conventional electrophotographic image forming apparatus using the electrophotographic image forming process, a process cartridge type in which an electrophotographic photosensitive member and process means acting on the photosensitive member are integrally assembled into a cartridge and this cartridge is detachably mountable to a main assembly of the electrophotographic image forming apparatus is employed.

In such a process cartridge, as shown in (b) of FIG. 34, an opening provided to a developer accommodating frame 34 for accommodating a developer (toner, carrier, etc.) is sealed with a sealing member. Further, as an example of a sealing means, there is a type in which a sheet-like sealing member 32 as shown in (a) of FIG. 34 is welded by heat seal or the like at a periphery of the opening of the developer accommodating frame 31. In order to reduce a load of a user when a welded portion 33 formed by the welding, a constitution in which a free end of the sealing member 32 is folded back and is capable of being pulled off in a side (in an arrow direction in (a) of FIG. 34) opposite from a side where the folded portion is located has been widely used (Japanese Laid-Open Patent Application (JP-A) Hei 04-66980, FIG. 13).

In an actual form of the process cartridge, as shown in (b) of FIG. 34, the opening is sealed with a toner seal 32. After the opening is unsealed or in the case where there is no toner seal, a rotation shaft 40 is rotated to feed the developer to the neighborhood of a developer carrying member 13 by a developer feeding member 41.

Further, a constitution in which a developer accommodating unit separable from and mountable to a main assembly of the process cartridge is provided and in which the sheet member or the like is pulled off to feed the developer has been proposed as follows.

According to JP-A Hei 04-166963, the user pulls an end of bag-like sheet film accommodating the developer to unseal the bag, so that the developer can be supplied. According to Japanese Utility-Model Application (JP-U) Hei 01-128351, a sheet blocking an opening for permitting discharge of a developer is wound up by a rotatable member, so that supply of the developer is automatically started. JP-A 2008-134483 principally aims at preventing agglomeration of the developer, and a stirring sheet blocks an opening of a hopper portion accommodating the developer and functions as a stirring means after the opening is unsealed.

Further, in order to solve a problem such that the developer is scattered in the process cartridge in a developer filling step during manufacturing of the process cartridge, a constitution in which a deformable inner container is used has been proposed (JP-A Hei 04-66980, FIG. 1).

However, in the conventional constitutions described above was accompanied with the following problems.

In the constitution in which the container for applying the developer and the stirring member are provided in the developer accommodating unit, an upsizing is unavoidable. Therefore, in the case where the above-described conventional constitution is used for the developer accommodating portion of the detachably mountable process cartridge, the process cartridge is upsized, so that the image forming apparatus in which the process cartridge is mounted is also upsized.

Therefore, in order to downsize such a process cartridge, it would be considered that, e.g., as shown in (a) and (b) of FIG. 35, a distance between a developing roller 13 and a rotation shaft 40 of a developer feeding member 41 is shortened. However, in this case, irrespective of presence and absence of a toner seal 32, the developer feeding member 41 and the developing roller 13 contact each other, so that there was a possibility of generation of an image defect on an output image.

SUMMARY OF THE INVENTION

A principal object of the present invention is to provide a developing device capable of downsizing a process cartridge while preventing contact between a developer feeding member and a developing roller.

According to an aspect of the present invention, there is provided a developing device comprising: a flexible container, including an opening for permitting discharge of a developer, for accommodating the developer; a frame for accommodating the flexible container and for accommodating the developer discharged from the flexible container; an urging member, rotatably provided inside the frame, for urging the flexible container by rotation thereof to deform the flexible container; and a developer carrying member for carrying the developer on its surface to feed the developer, wherein a distance X from a rotation center of the urging member to the surface of the developer carrying member and a length T from the rotation center of the urging member to a free end thereof for urging the flexible container satisfy a relationship of $X<T$, and wherein a shielding member for preventing contact of the urging member with the developer carrying member is provided between the rotation center of the urging member and the surface of the developer carrying member or in a neighborhood thereof.

These and other objects, features and advantages of the present invention will become more apparent upon a consideration of the following description of the preferred embodiments of the present invention taken in conjunction with the accompanying drawings.

Figure 7:
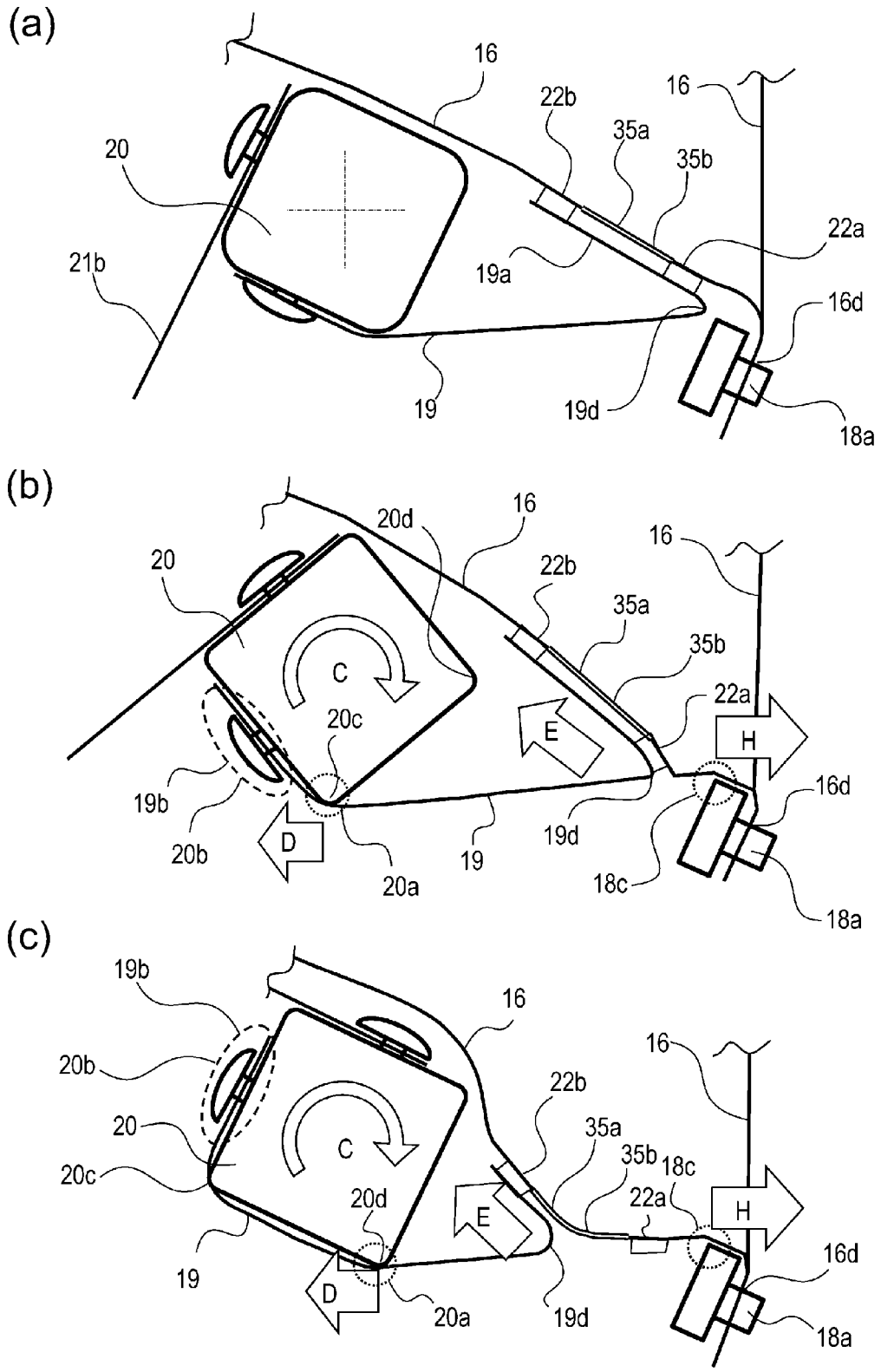
Figure 8:
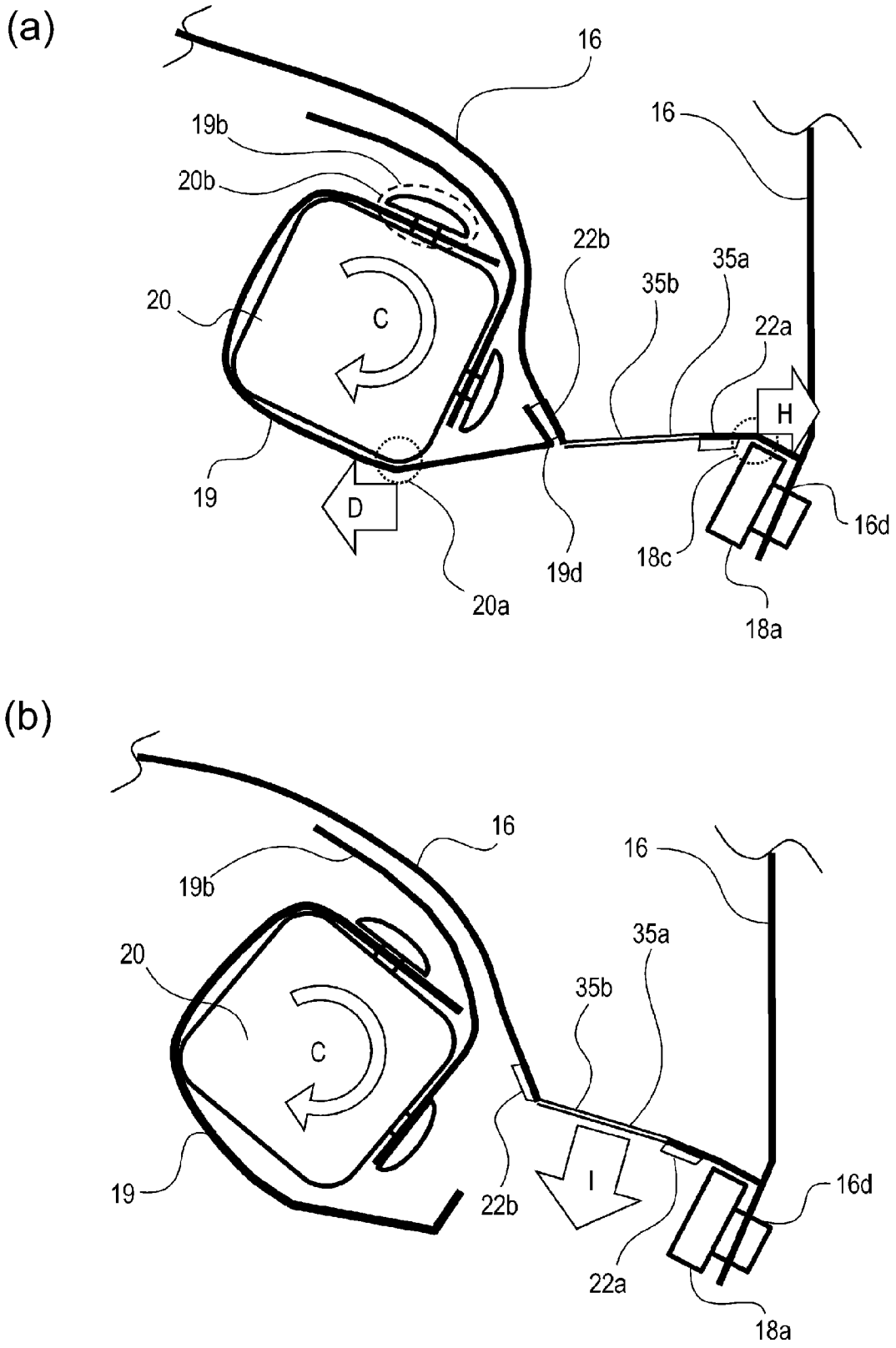

Parts (a), (b) and (c) of FIG. 7, and (a) and (b) of FIG. 8 are sectional views for illustrating a process of unsealing the discharging portion in the embodiment of the present invention.

Figure 9:
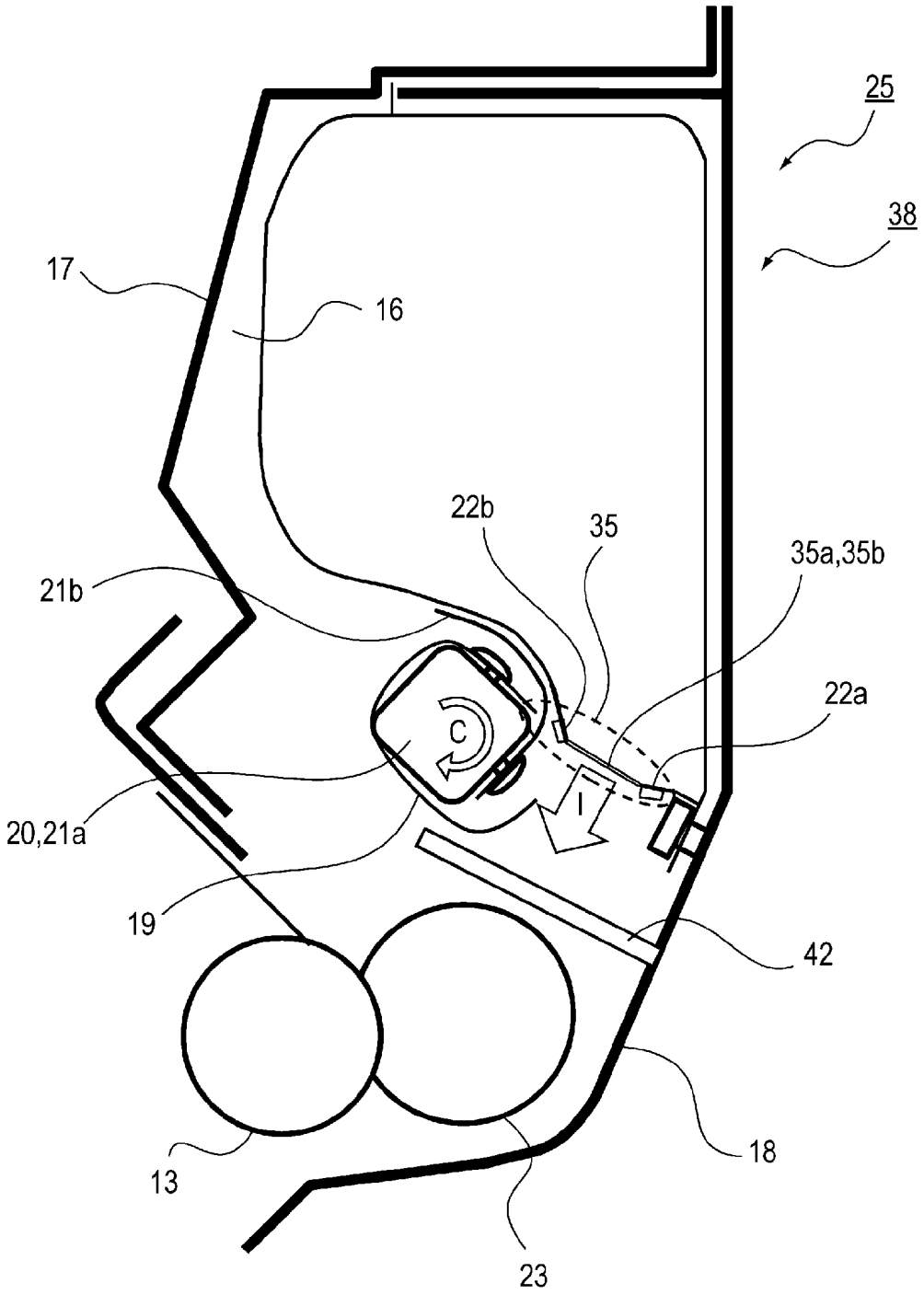

FIG. 9 is a sectional view of the developer accommodating unit after the unsealing in the embodiment of the present invention.

Figure 10:
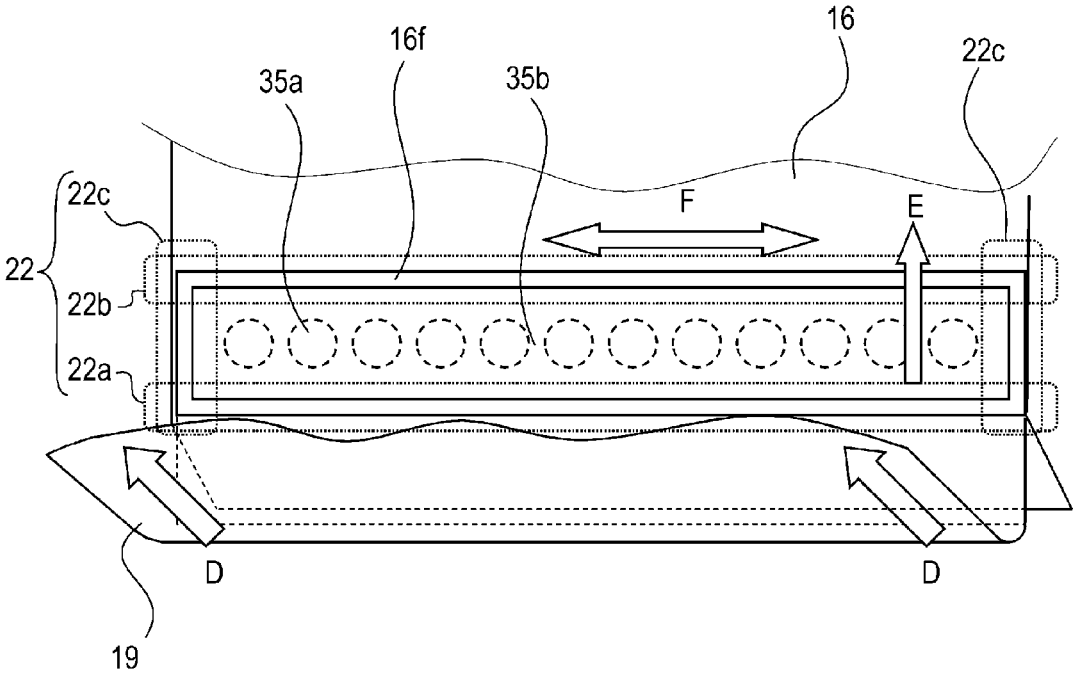

FIG. 10 is an illustration of the developer accommodating container before unsealing in the embodiment of the present invention.

Figure 11:
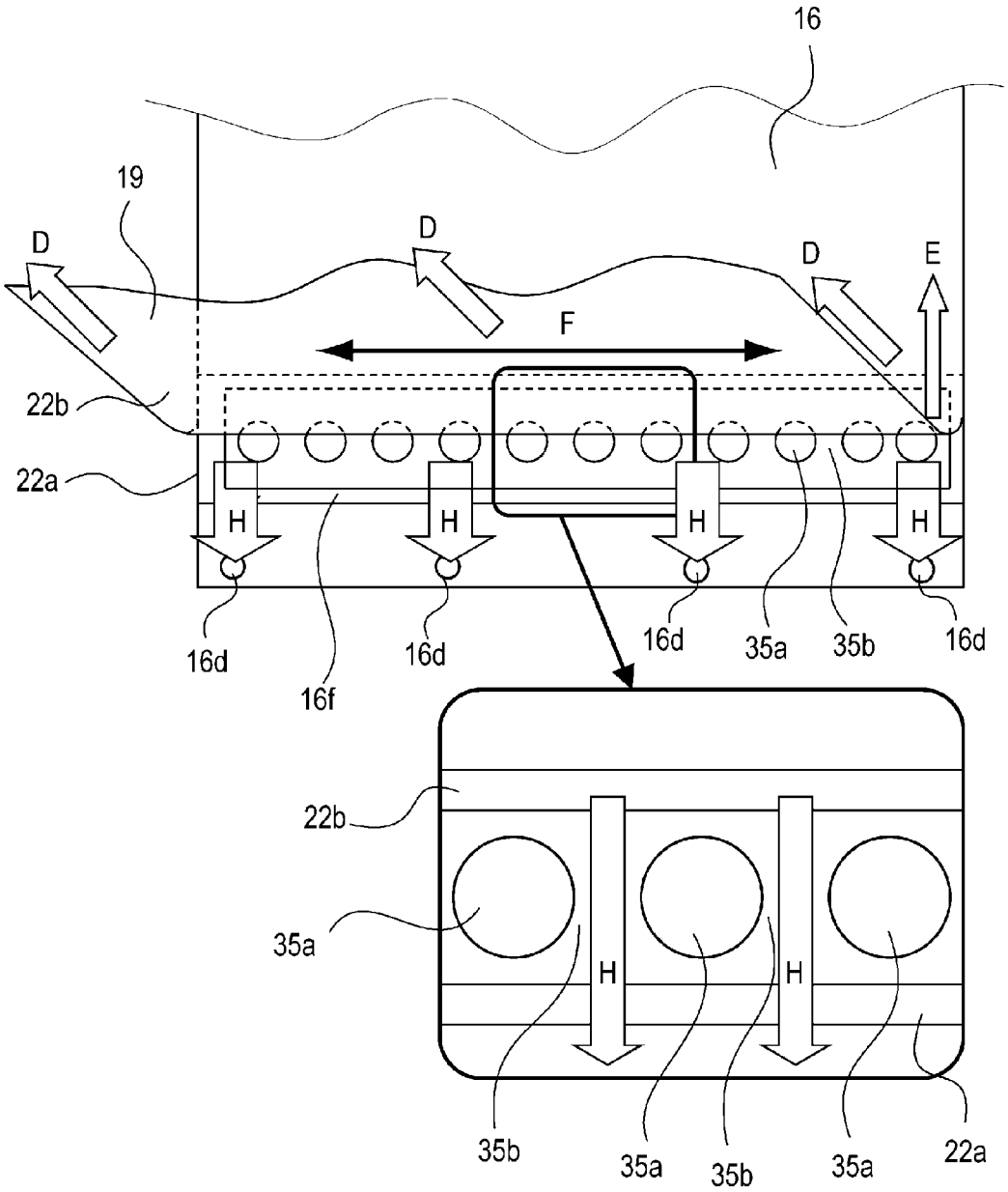

FIG. 11 is an illustration of the developer accommodating container in which the discharging portion is unsealed in midstream in the embodiment of the present invention.

Figure 12:
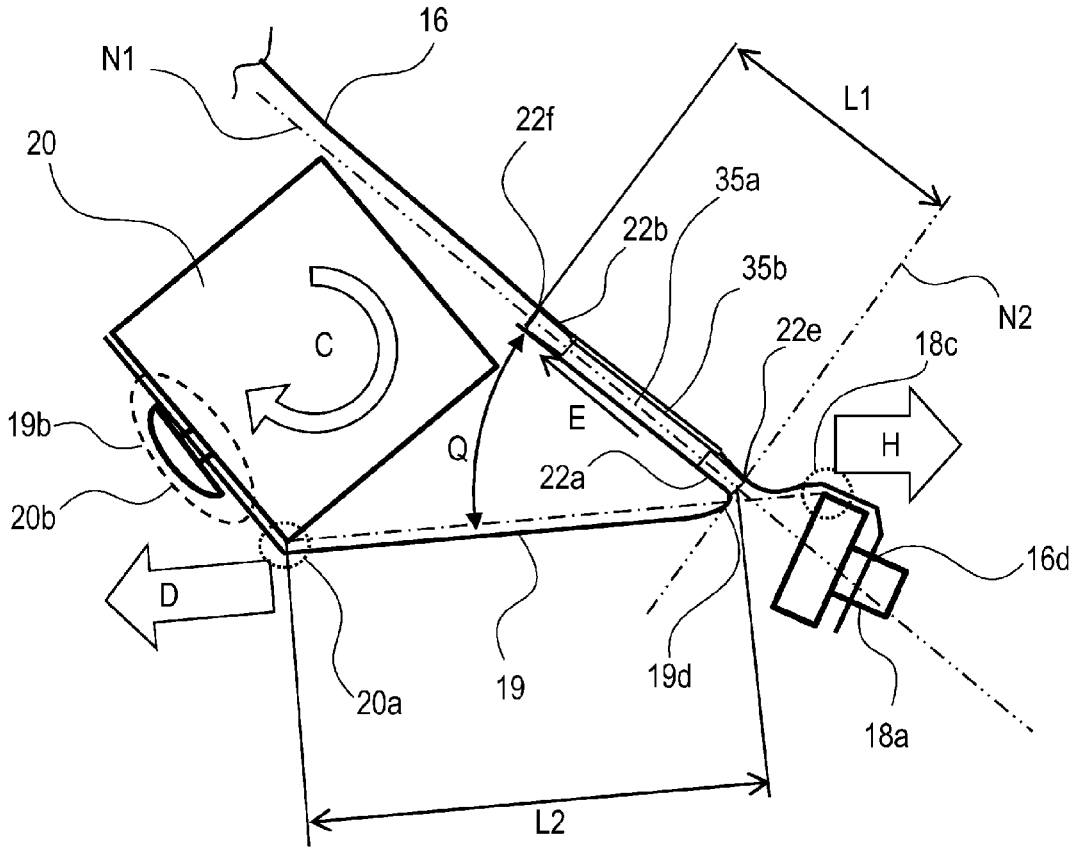

FIG. 12 is a sectional view for illustrating the discharging portion in the embodiment of the present invention.

Figure 13:
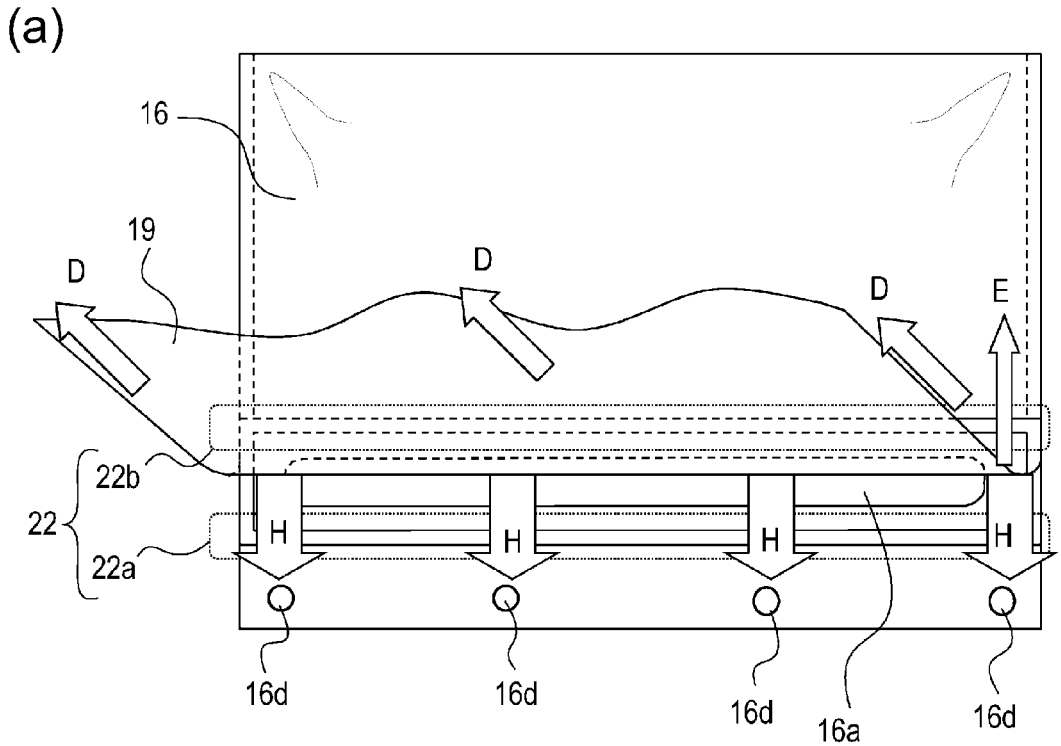
Figure 13:
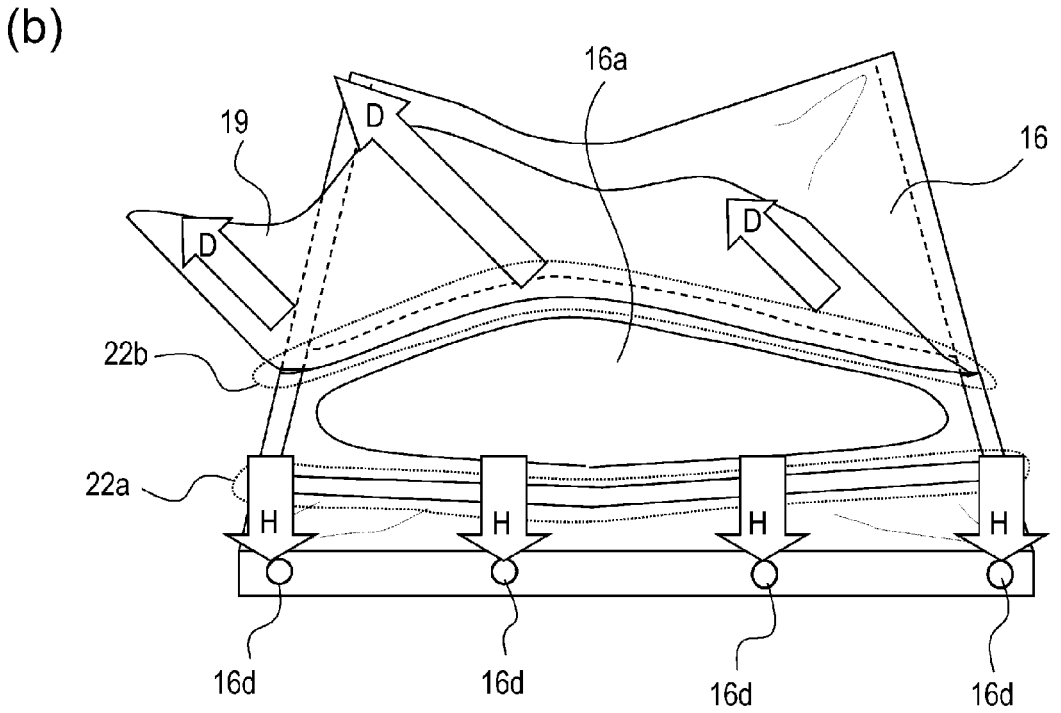
Figure 14:
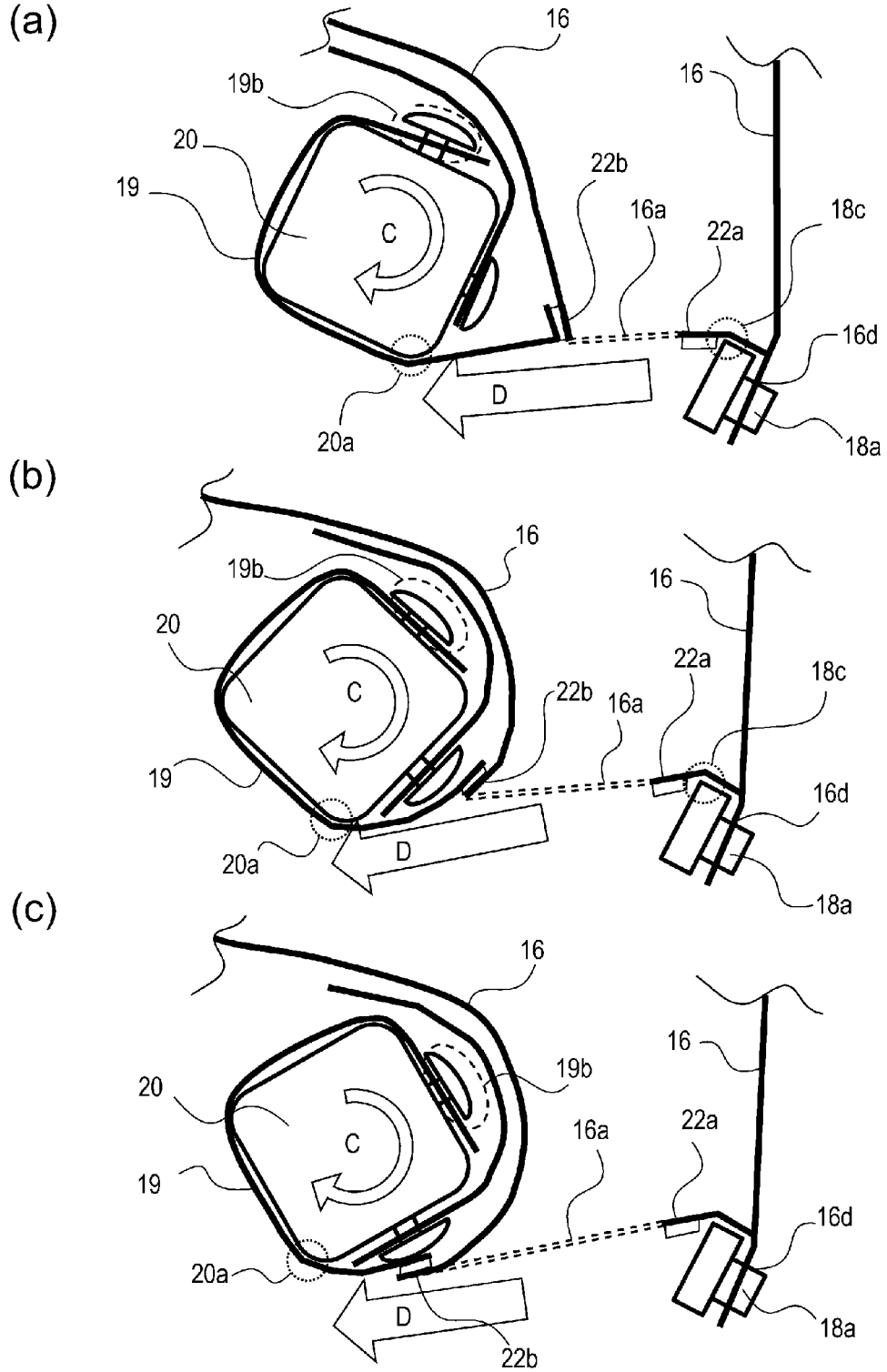
Figure 15:
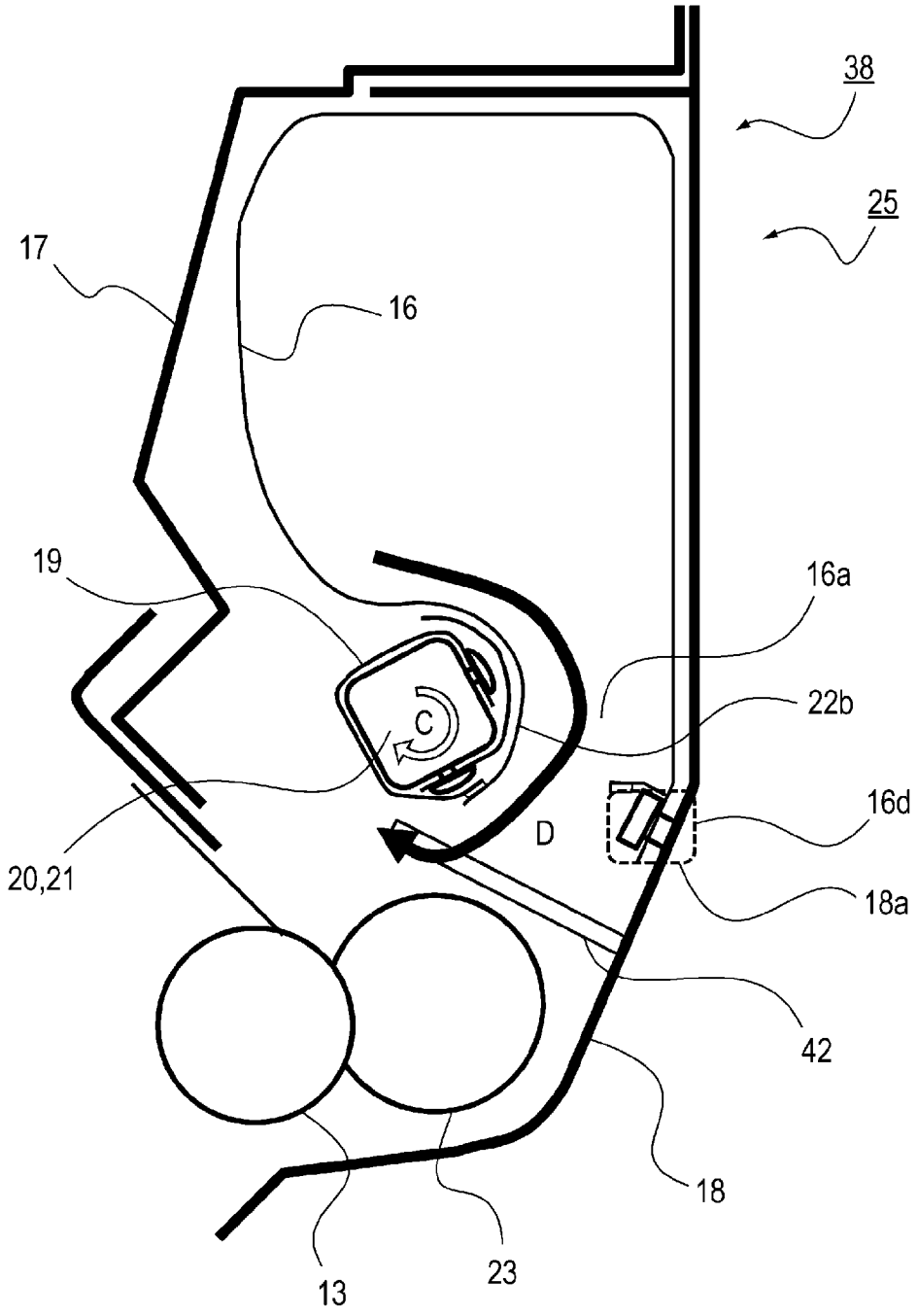

Parts (a) and (b) of FIG. 13, (a) to (c) of FIG. 14, and FIG. 15 are illustrates of a developer accommodating unit in which it is difficult to unseal a discharging portion in an embodiment which is not in accordance with the present invention.

Figure 16:
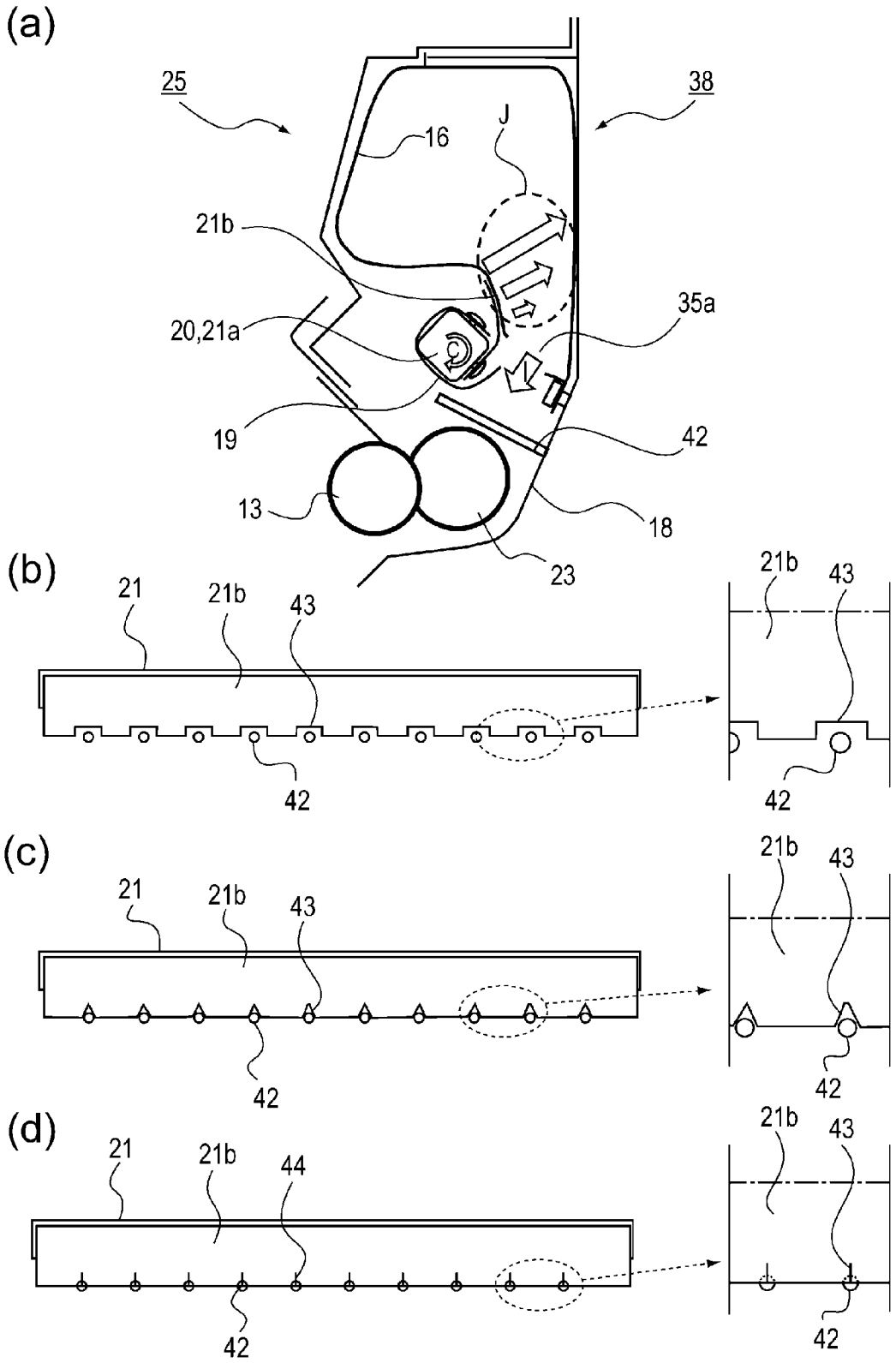
Figure 17:
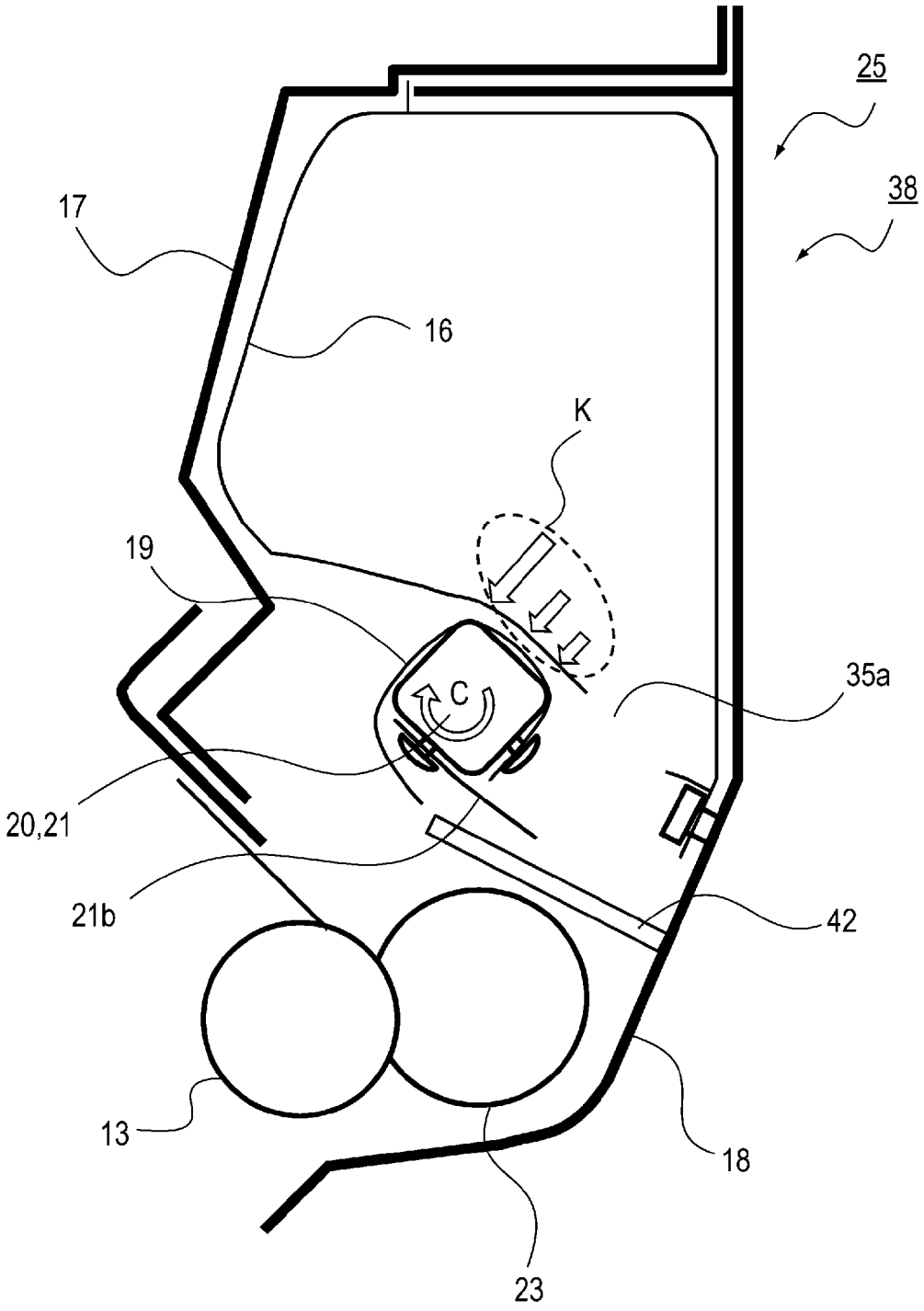

Parts (a) to (d) of FIG. 16 and FIG. 17 are sectional views of the developer accommodating unit in the embodiment of the present invention.

Figure 18:
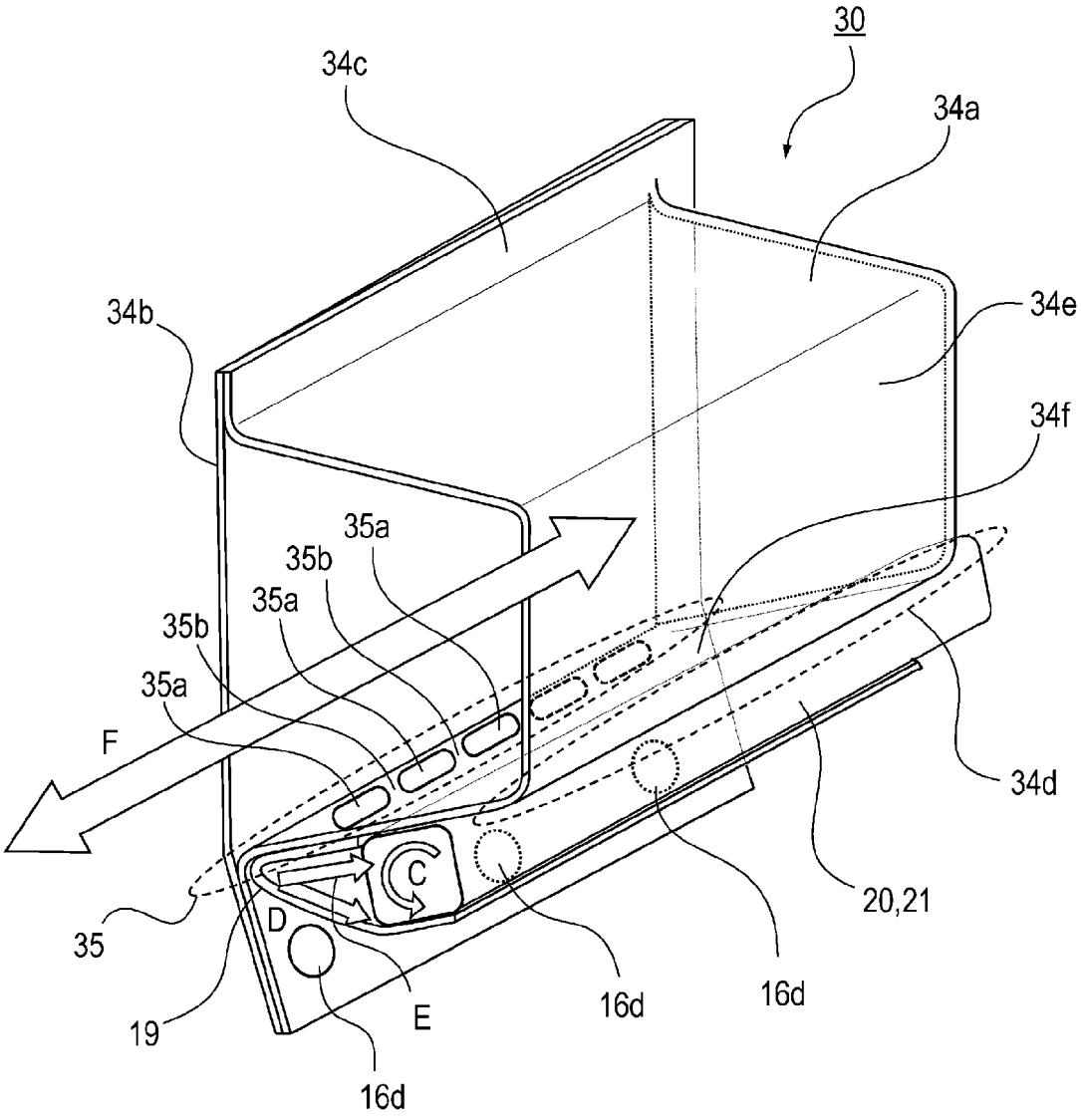

FIG. 18 is a perspective view of a developer accommodating container in Fourth Embodiment of the present invention.

Figure 19:
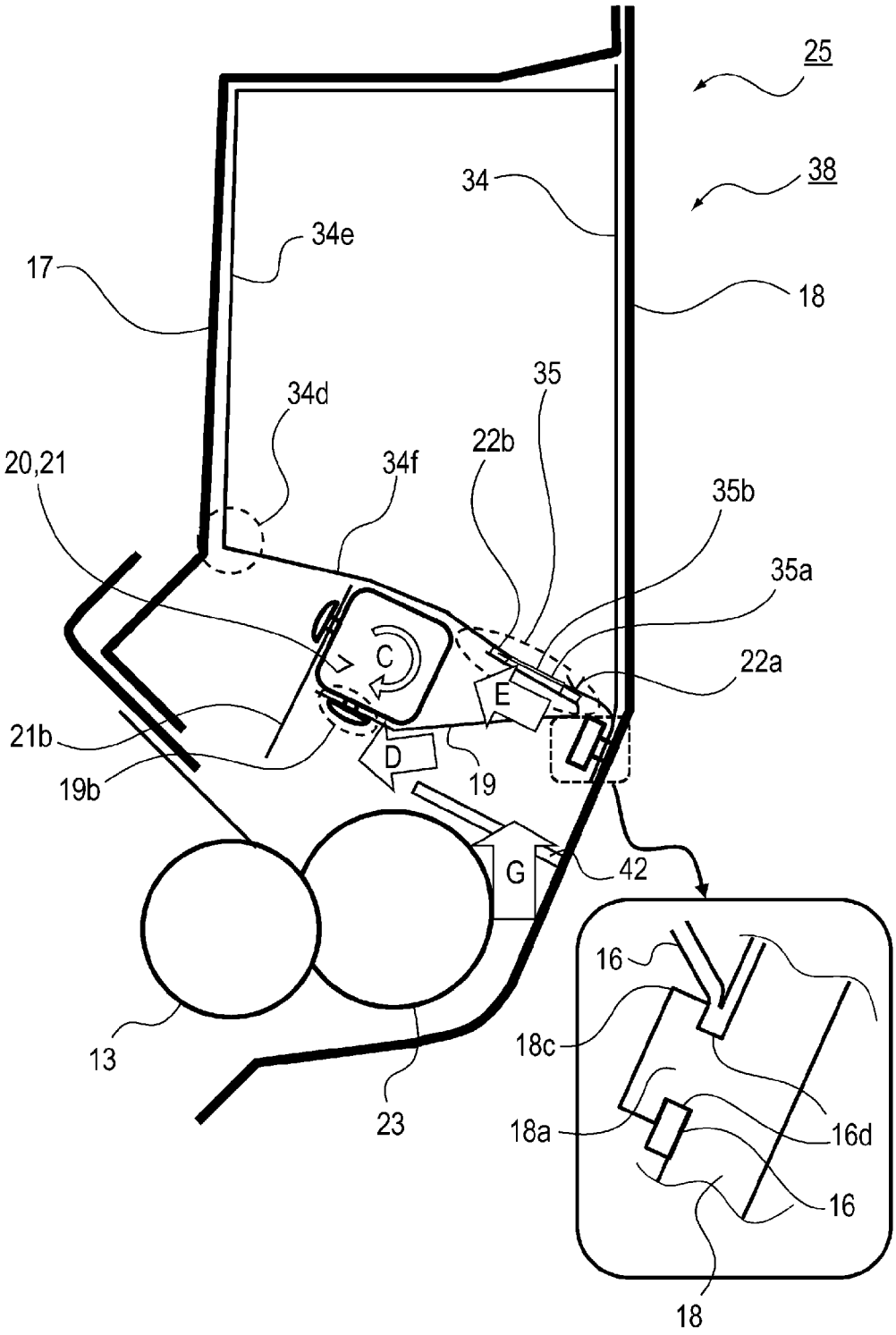

FIG. 19 is a sectional view of a developer accommodating unit in Fourth Embodiment of the present invention.

Figure 20:
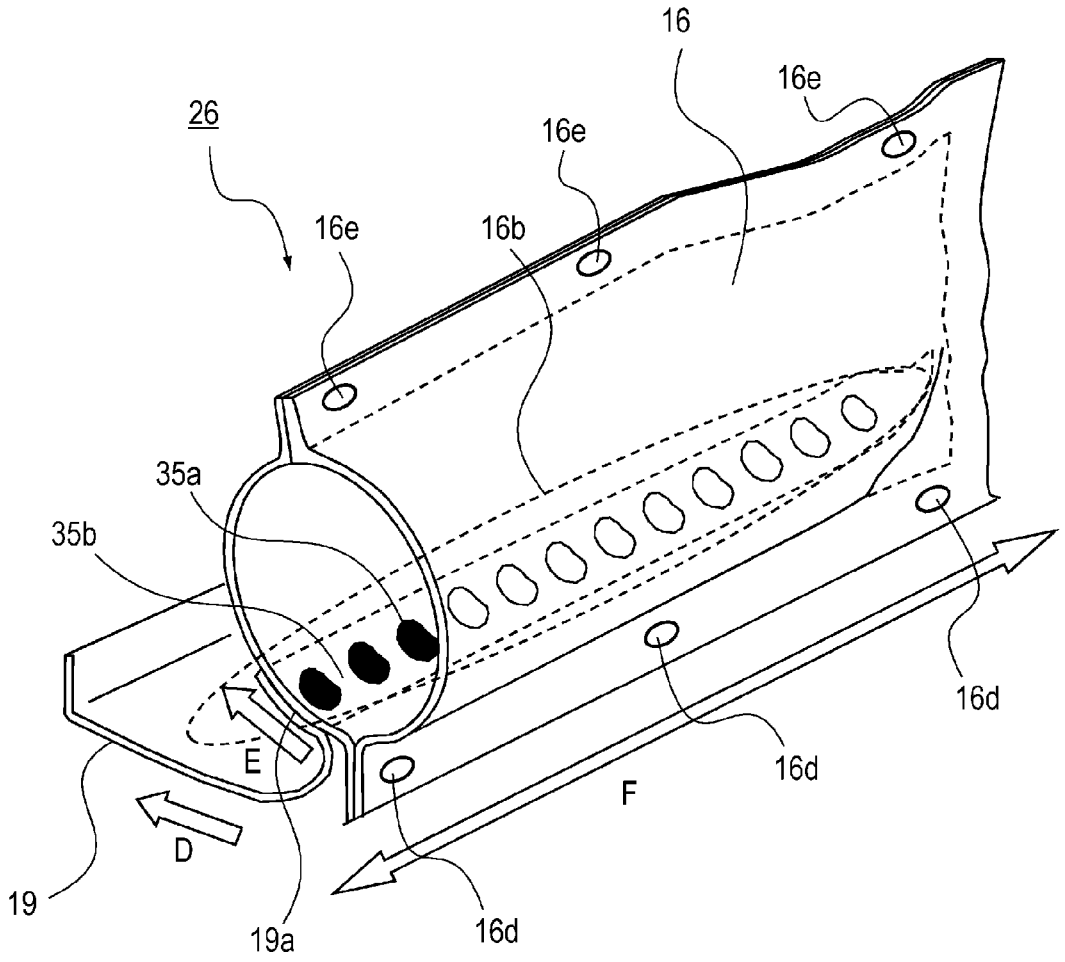
Figure 21:
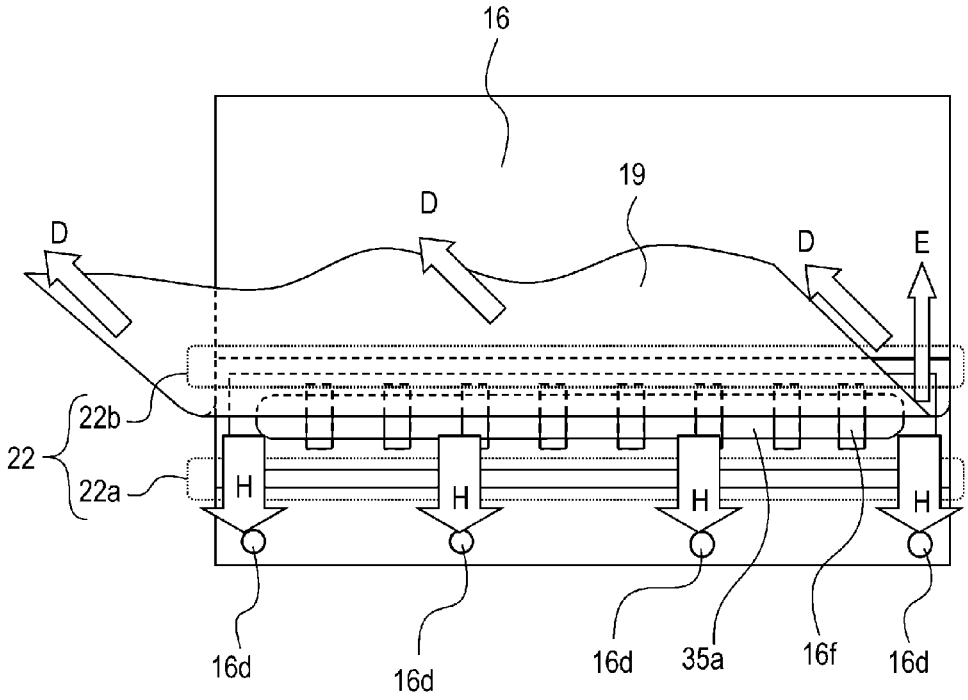
Figure 21:
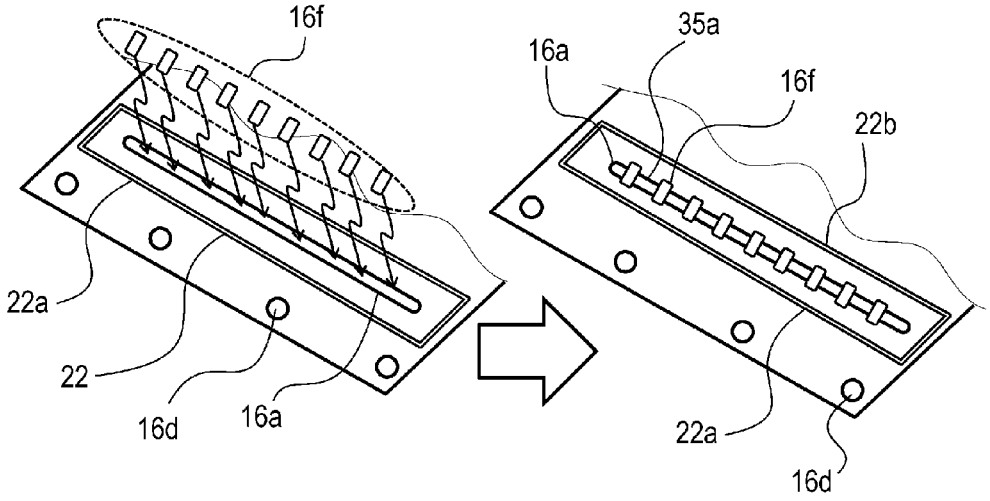

FIG. 20, and (a) and (b) of FIG. 21 are illustrations of the developer accommodating container in the embodiment of the present invention.

Figure 22:
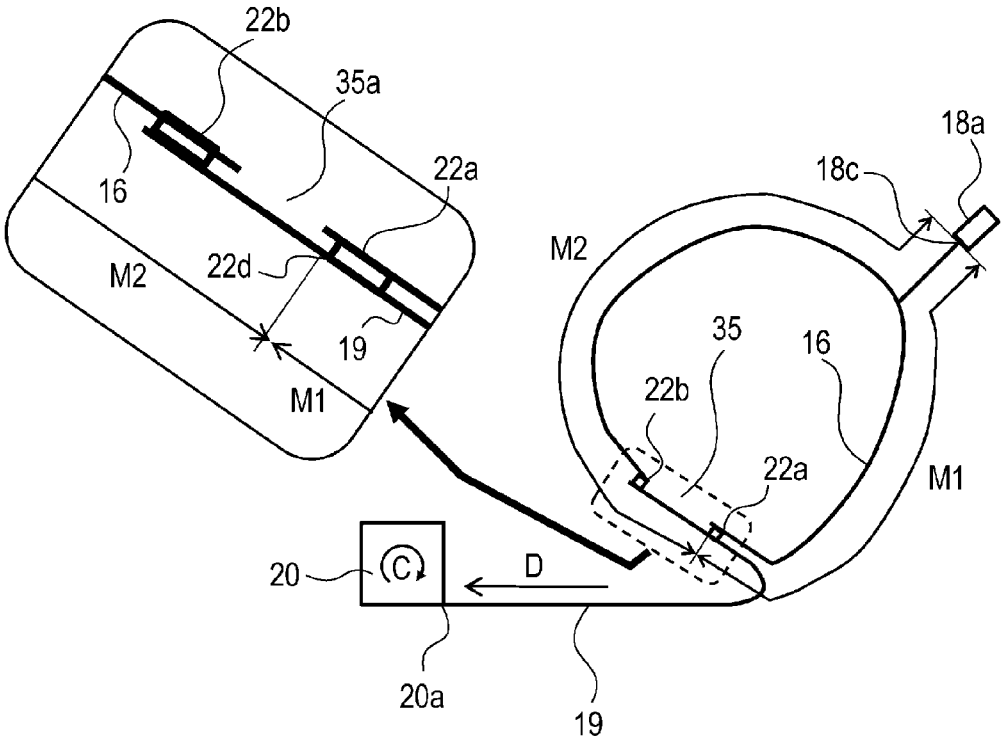
Figure 22:
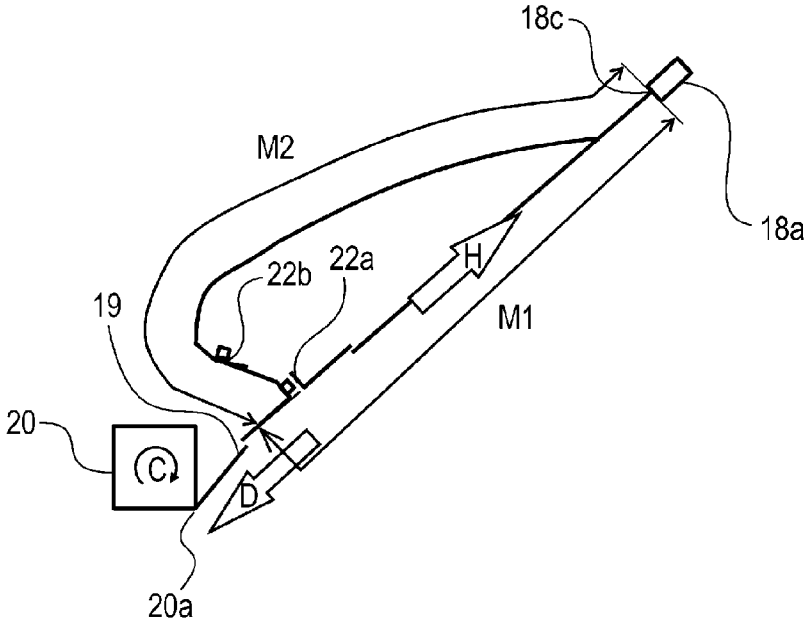

Parts (a) and (b) of FIG. 22 are illustrations of a developer accommodating container in an embodiment which is not in accordance with the present invention.

Figure 23:
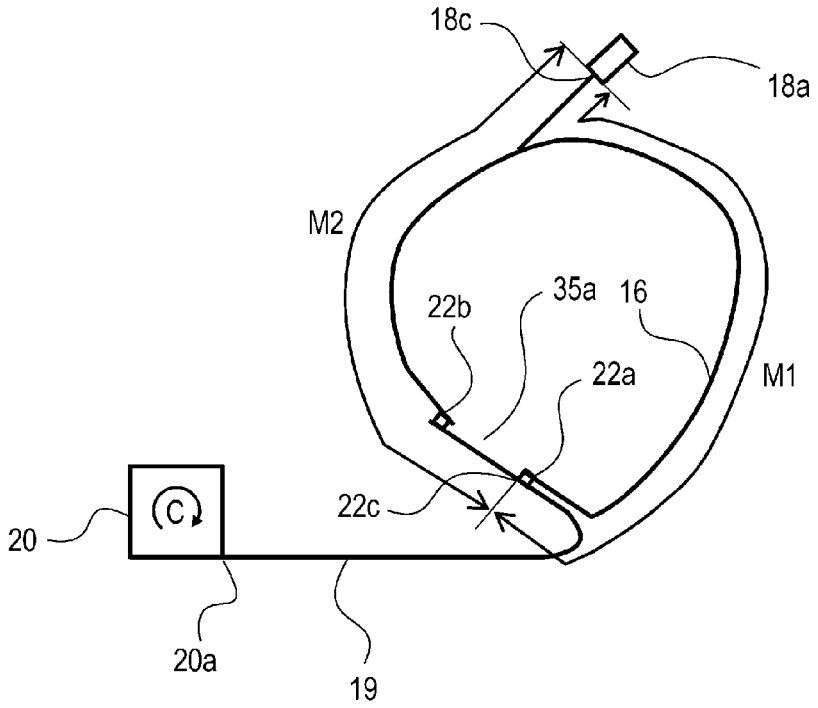
Figure 23:
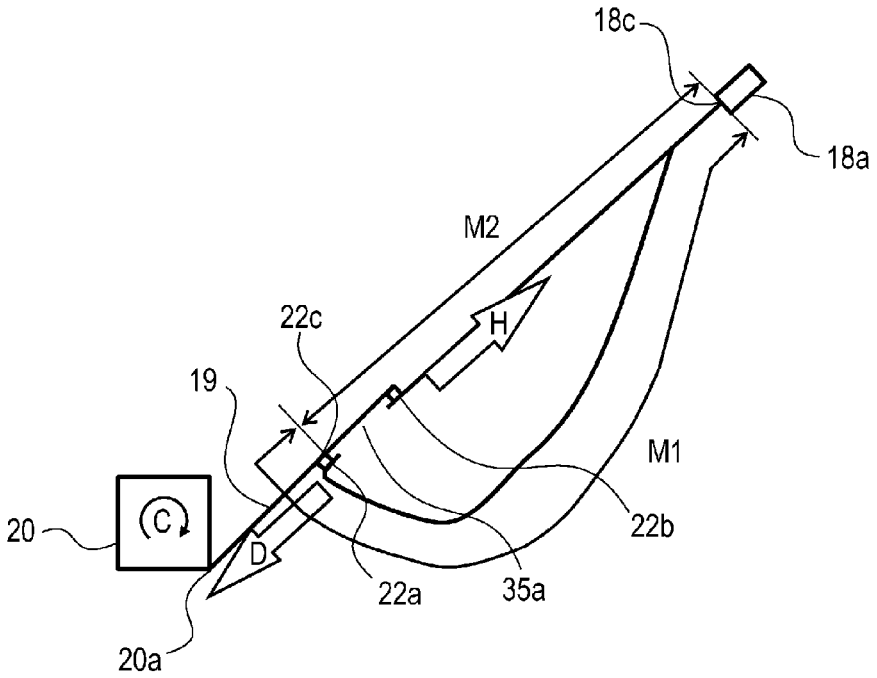
Figure 24:
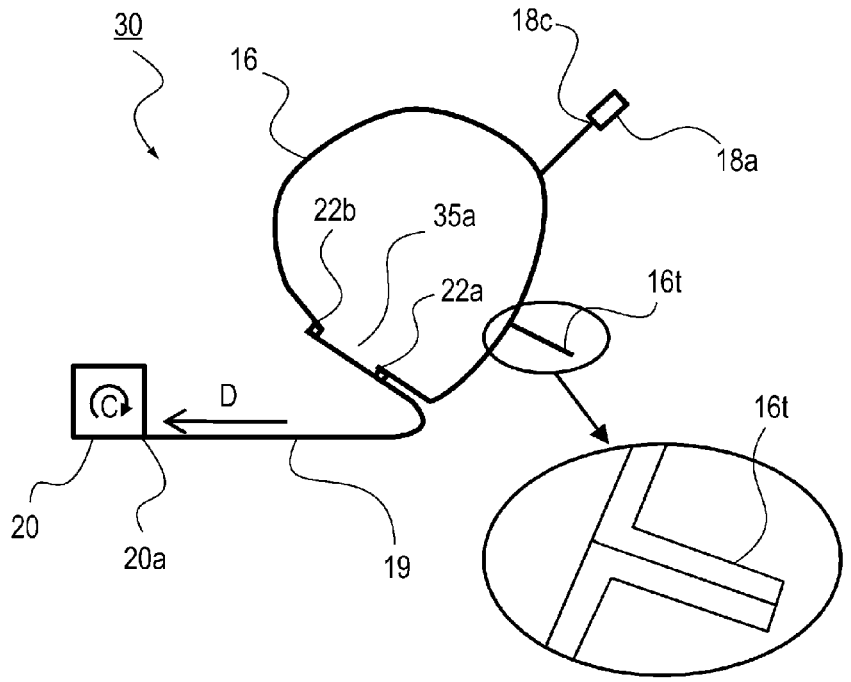
Figure 24:
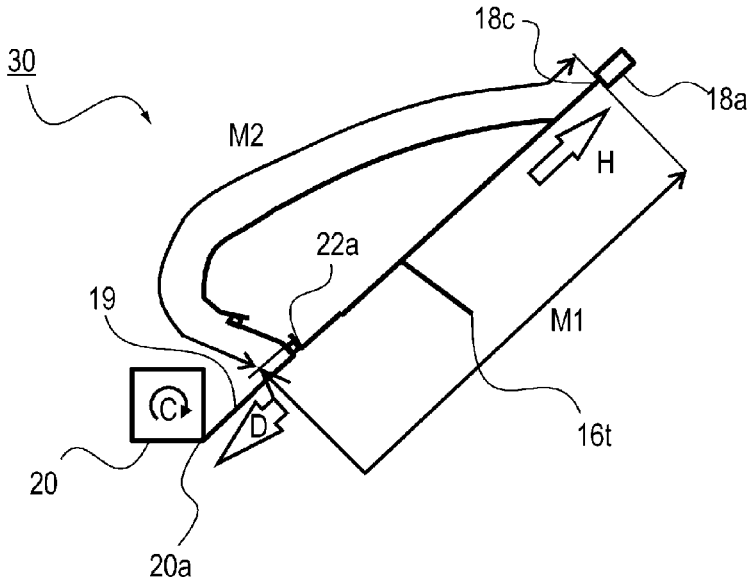

Parts (a) and (b) of FIG. 23, and (a) and (b) of FIG. 24 are illustrations of the developer accommodating unit in the embodiment of the present invention.

Figure 25:
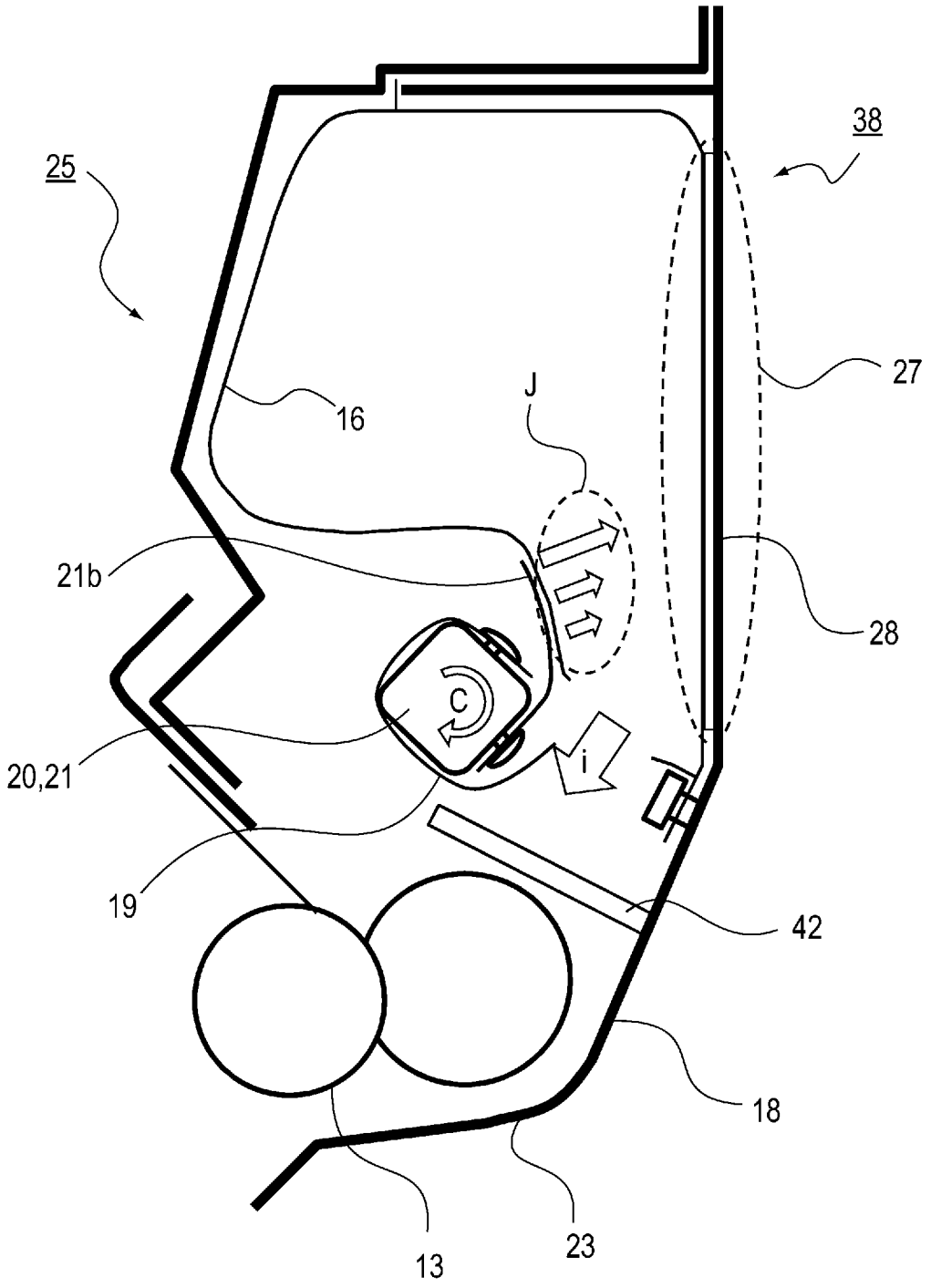
Figure 26:
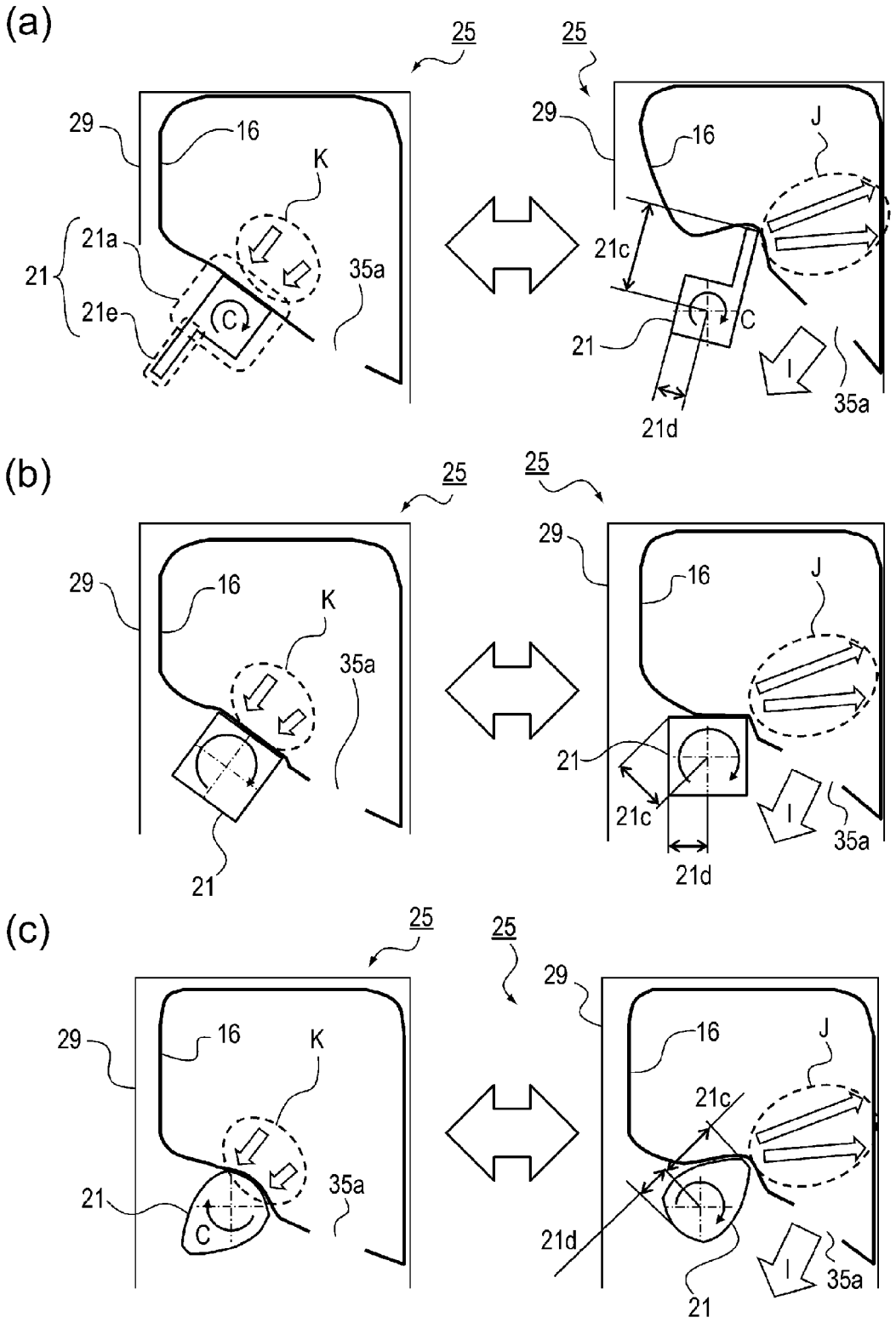

FIG. 25 and (a) to (c) of FIG. 26 are illustrations of the developer accommodating unit in the embodiment of the present invention.

Figure 27:
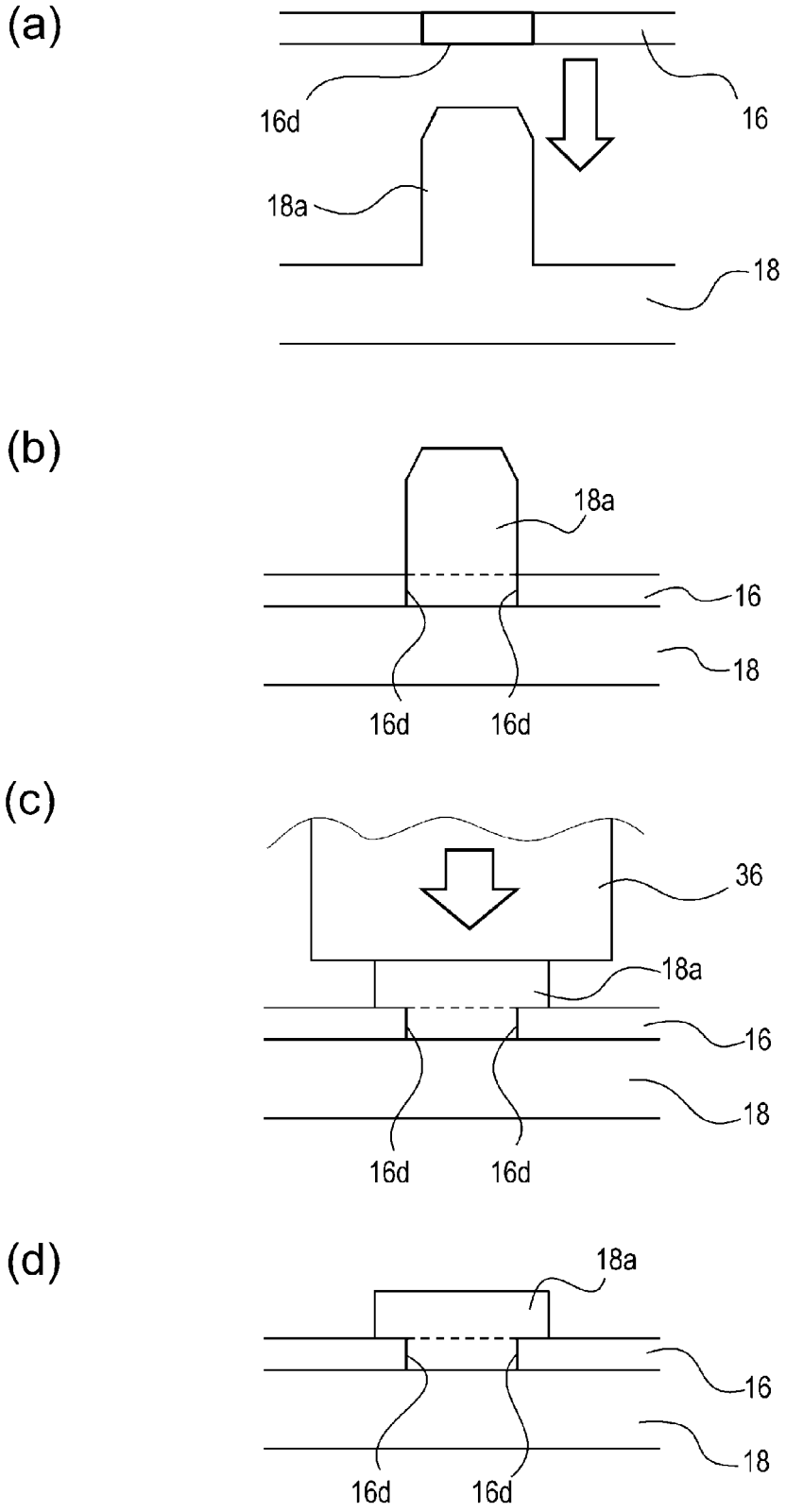

Parts (a) to (d) of FIG. 27 are illustrations of a fixing portion of the developer accommodating container in the embodiment of the present invention.

Figure 28:
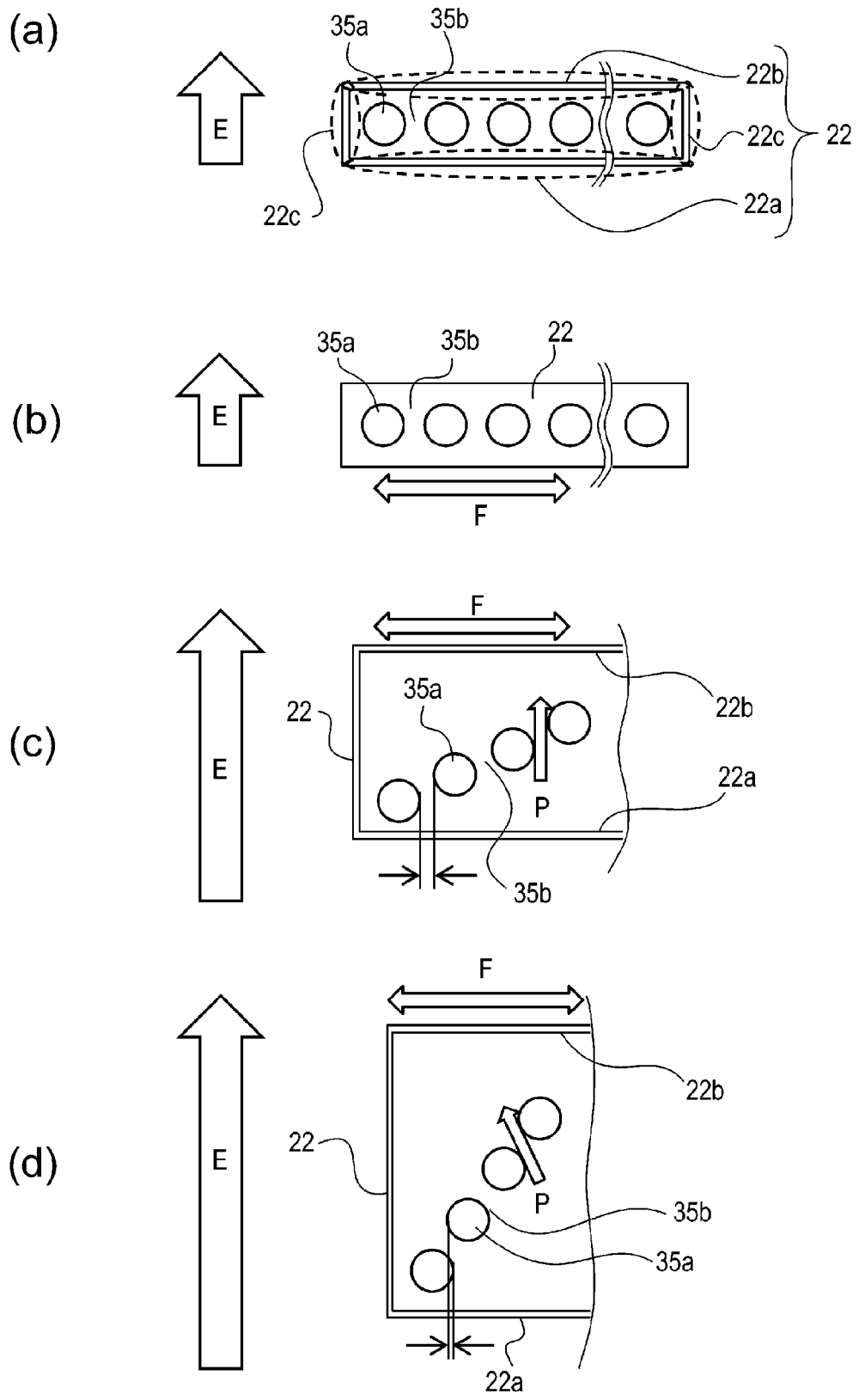

Parts (a) to (d) of FIG. 28 are illustrations of an opening of the developer accommodating container in the embodiment of the present invention.

Figure 29:
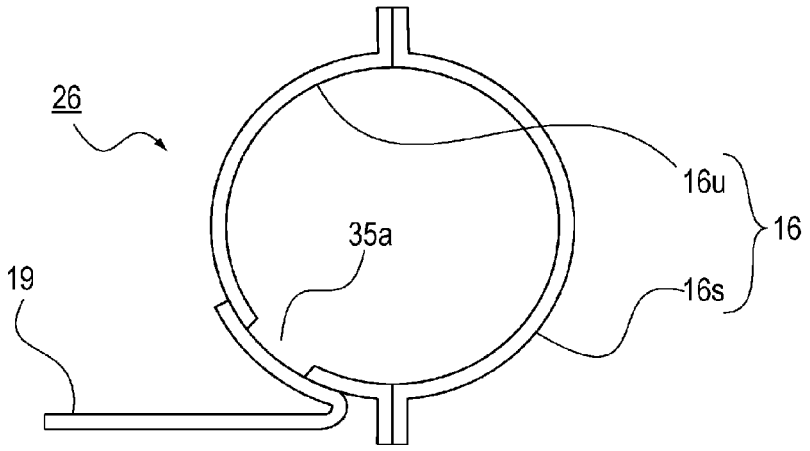
Figure 29:
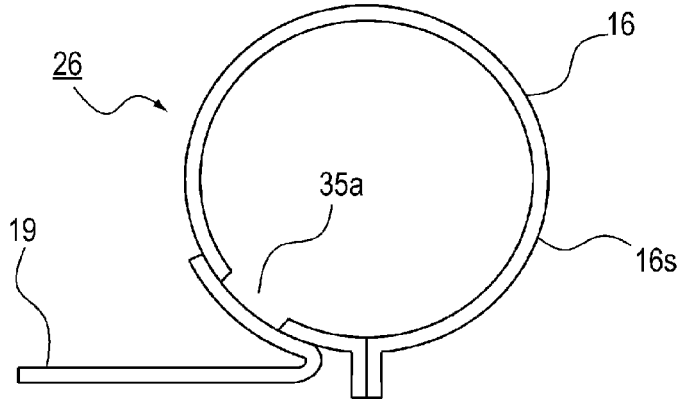
Figure 29:
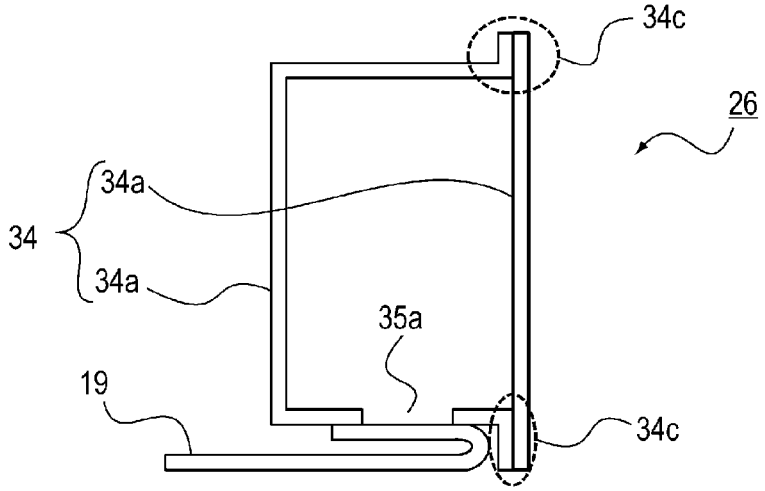
Figure 30:
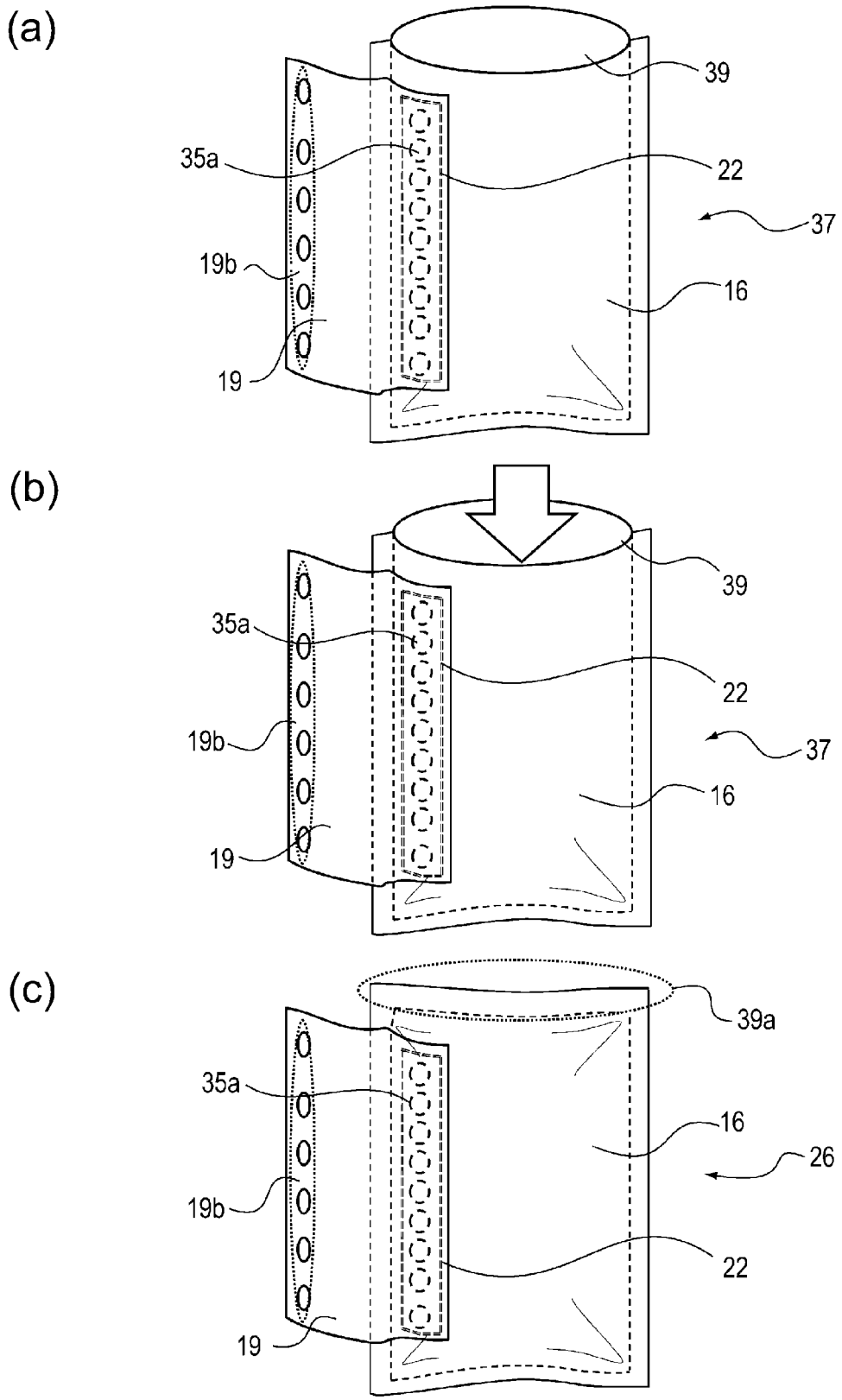

Parts (a) to (c) of FIG. 29 and (a) to (c) of FIG. 30 are illustrations of developer accommodating containers in embodiments of the present invention.

Figure 31:
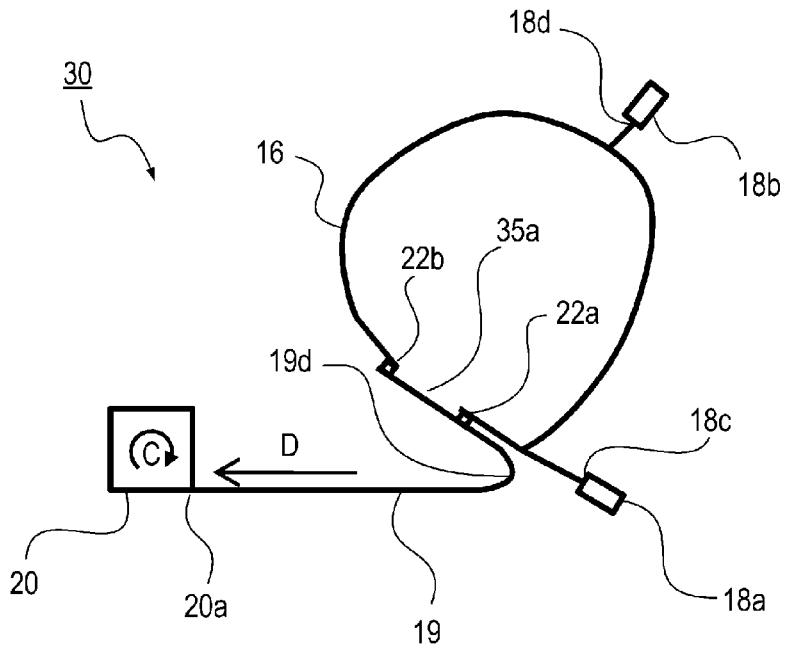
Figure 31:
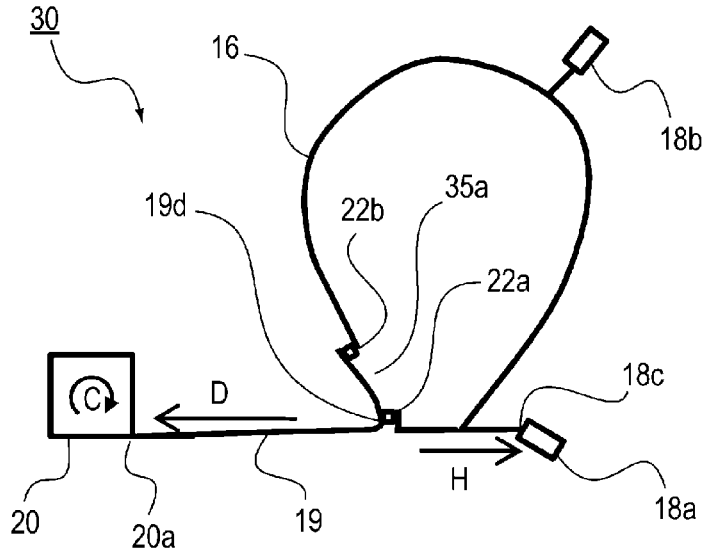

Parts (a) and (b) of FIG. 31 are illustrations of the developer accommodating container provided with an unsealing member.

Figure 32:
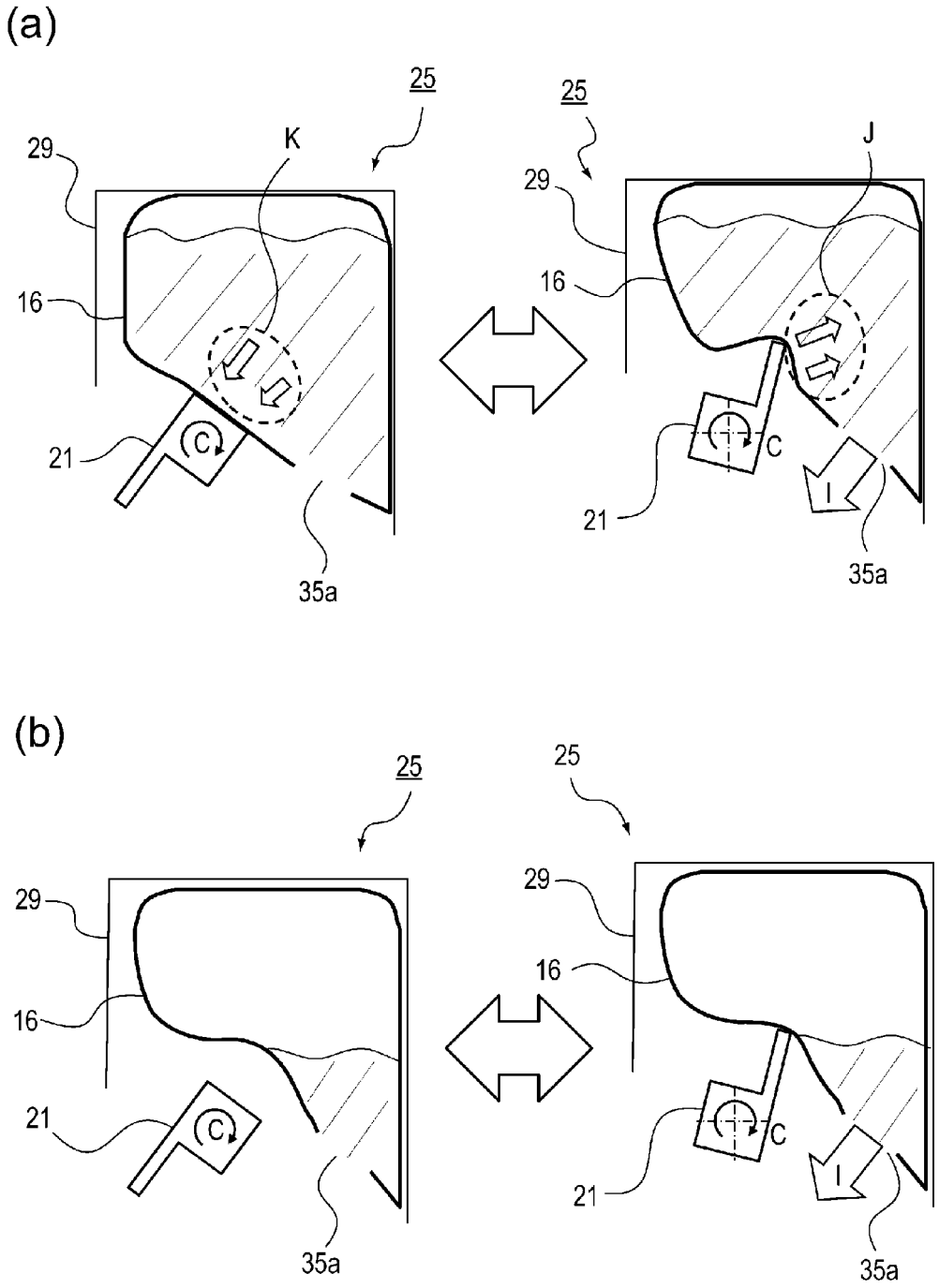
Figure 33:
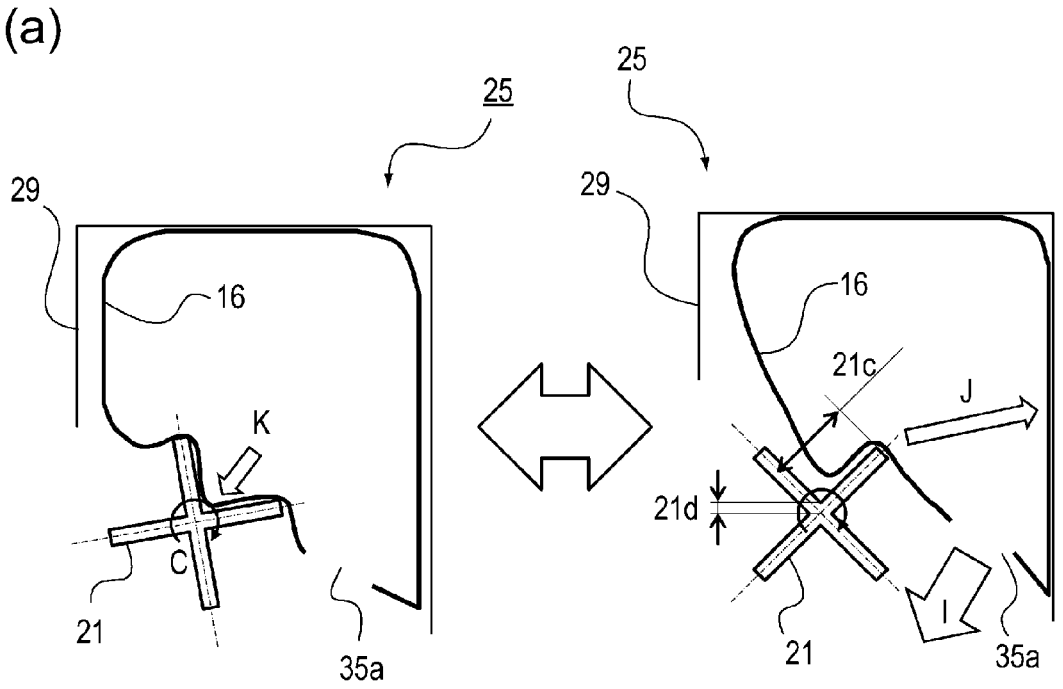
Figure 33:
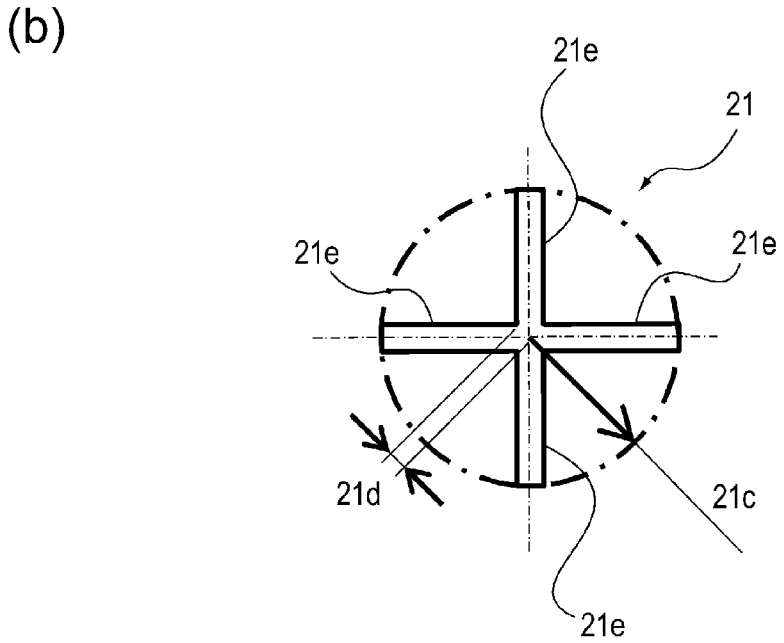

Parts (a) and (b) of FIG. 32, and (a) and (b) of FIG. 33 are illustrations of the developer accommodating unit in the embodiment of the present invention.

Figure 34:
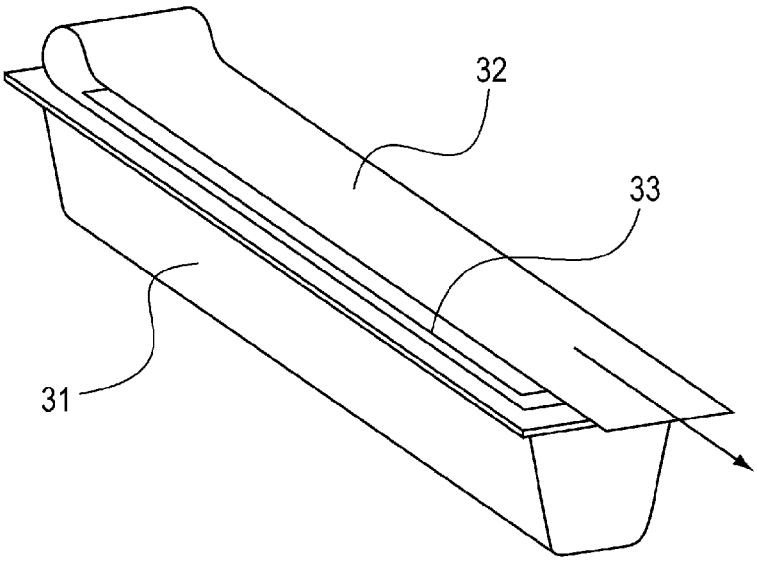
Figure 34:
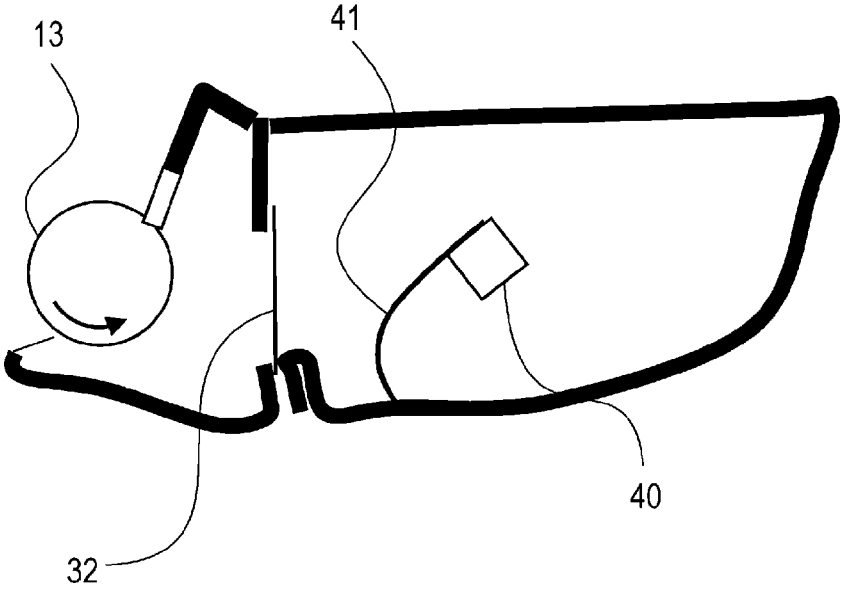

Parts (a) and (b) of FIG. 34 are illustrations of a conventional process cartridge.

Figure 35:
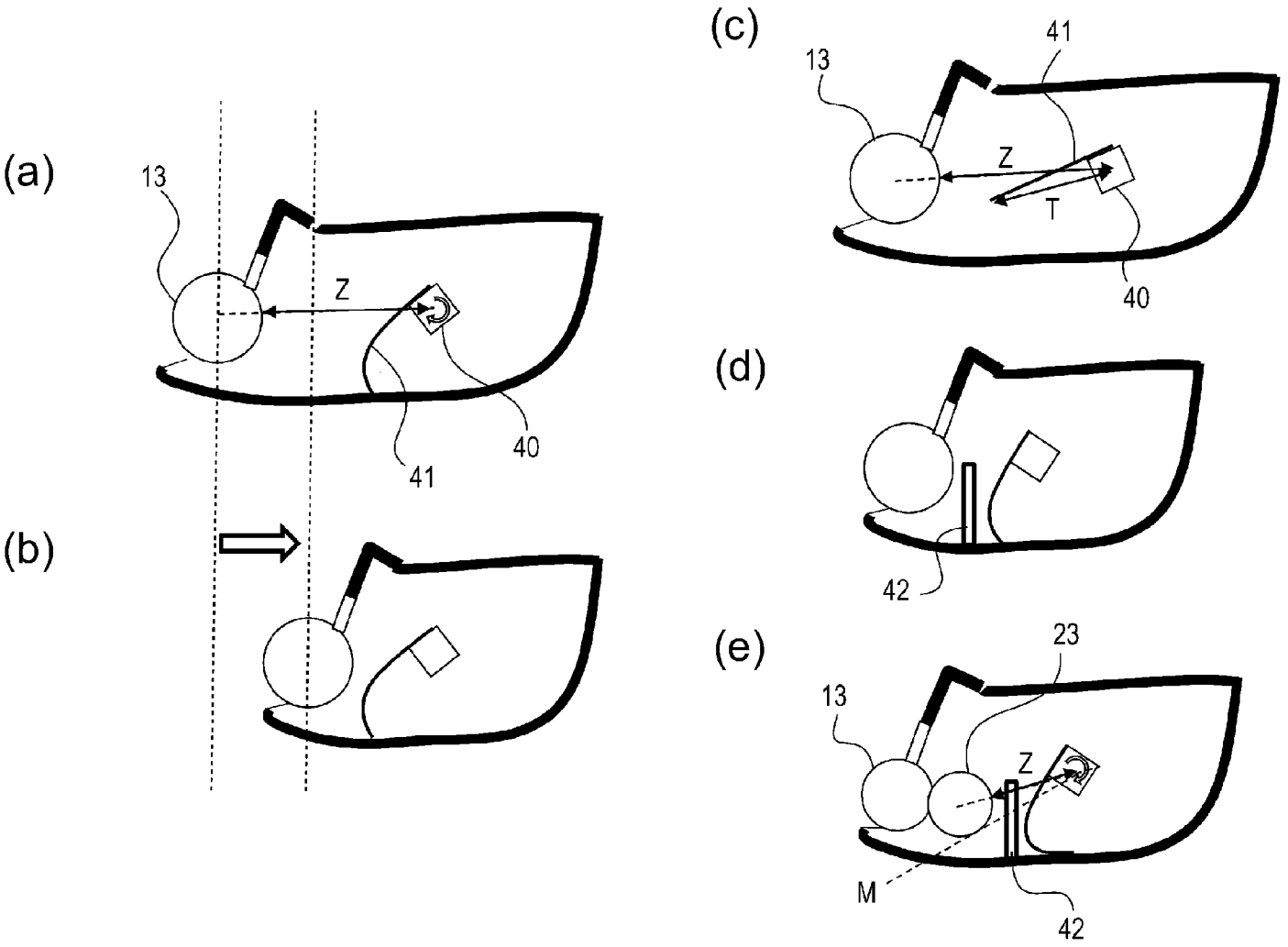

Parts (a) to (e) of FIG. 35 are sectional views of a developer accommodating unit in Fifth Embodiment of the present invention.

Figure 36:
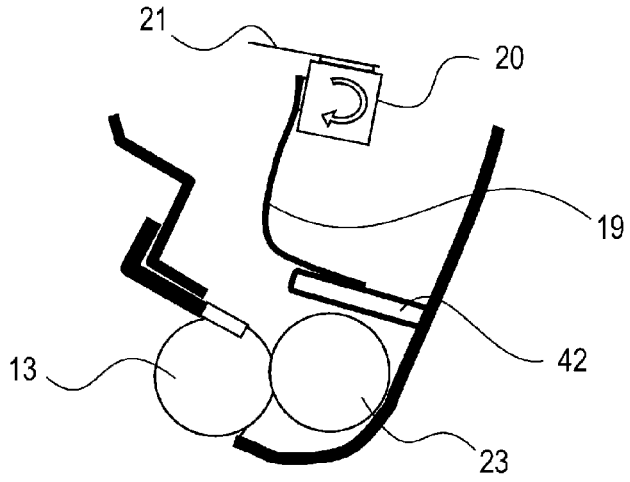
Figure 36:
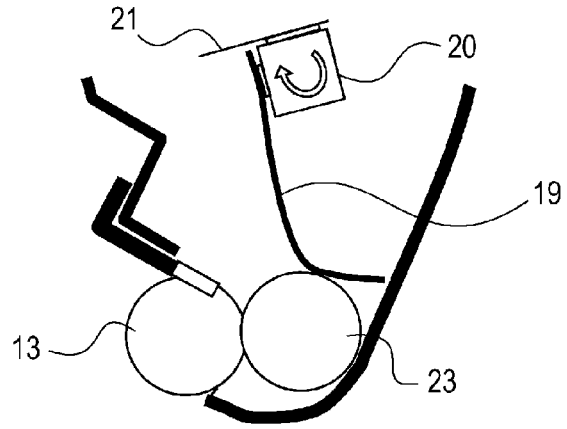
Figure 36:
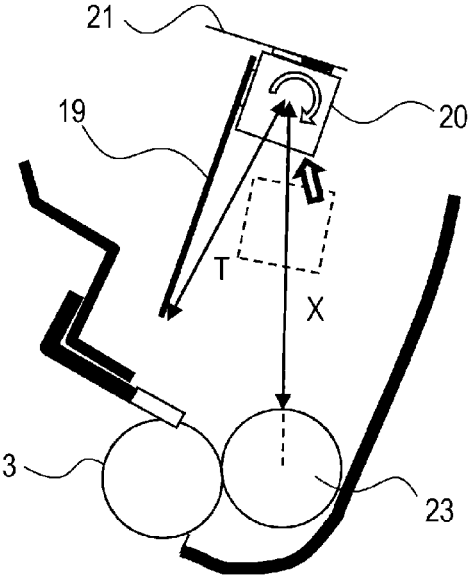

Parts (a) to (c) of FIG. 36 are illustrations of an effect of a shielding member in the embodiment of the present invention.

Figure 37:
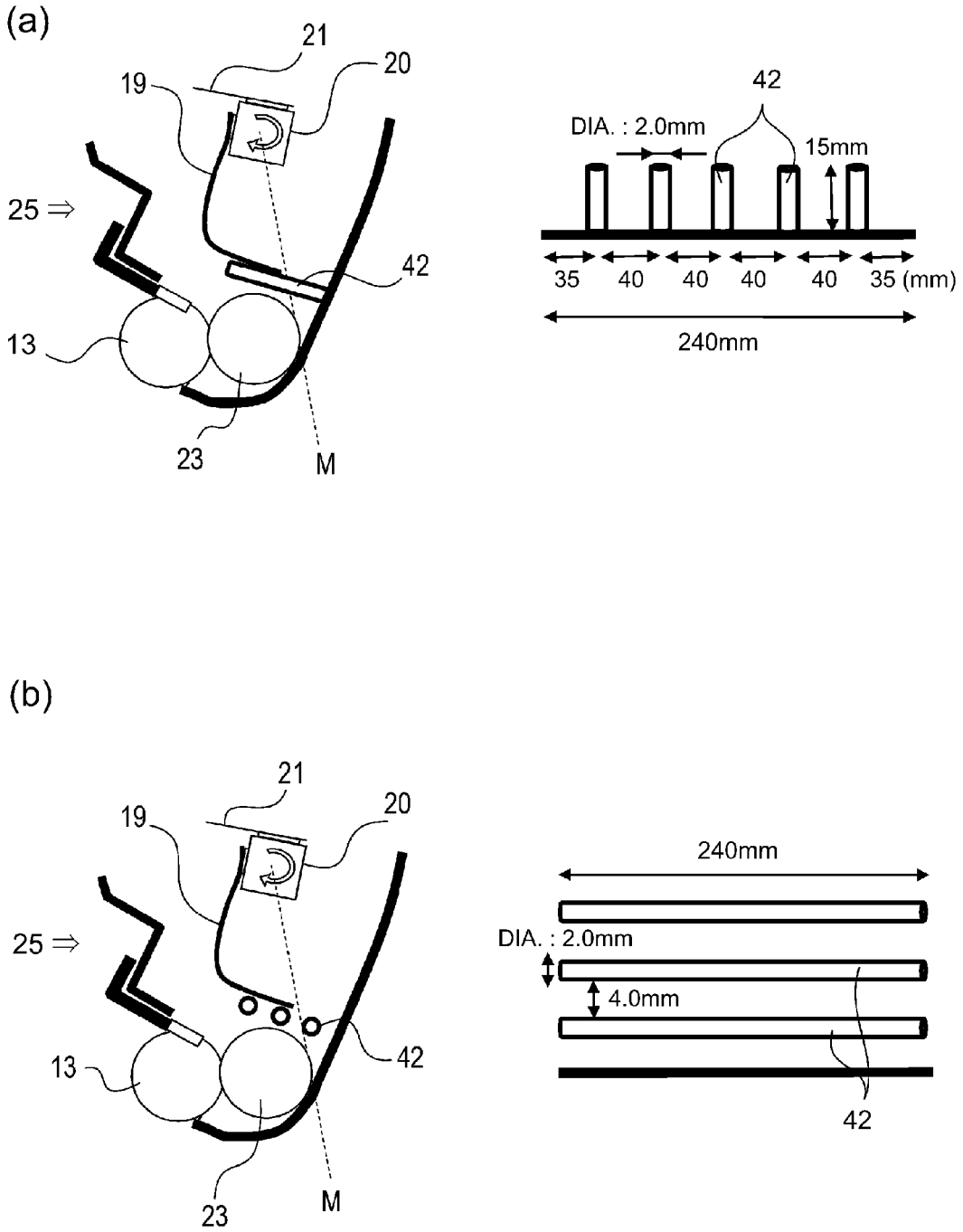
Figure 38:
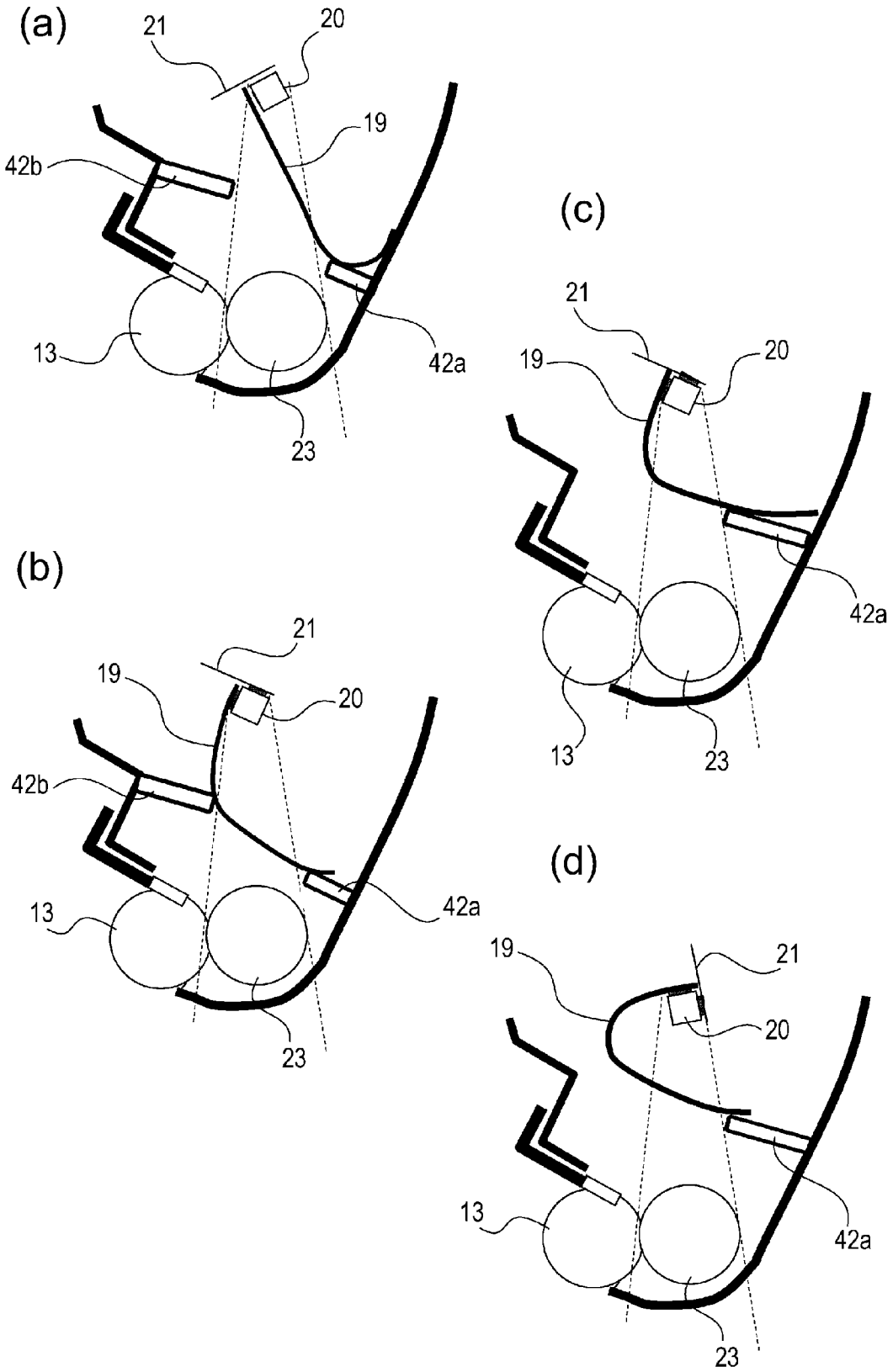

Parts (a) and (b) of FIG. 37, and (a) to (d) of FIG. 38 are illustrations of a constitution of the shielding member in the embodiment of the present invention.

Figure 39:
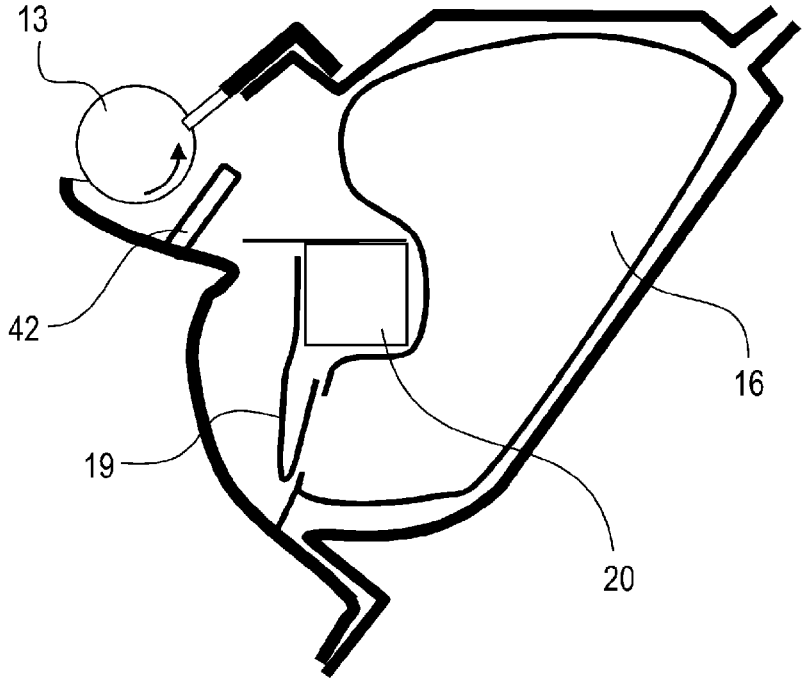
Figure 39:
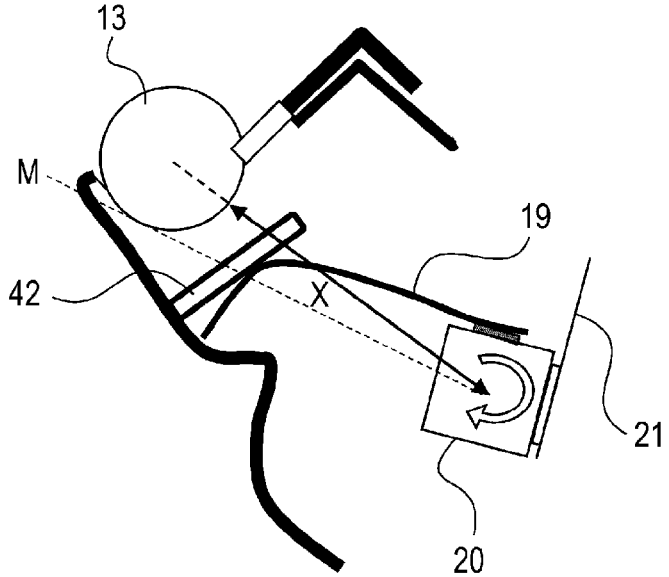

Parts (a) and (b) of FIG. 39 are illustration of a developer accommodating unit in Third Embodiment of the present invention.

Figure 40:
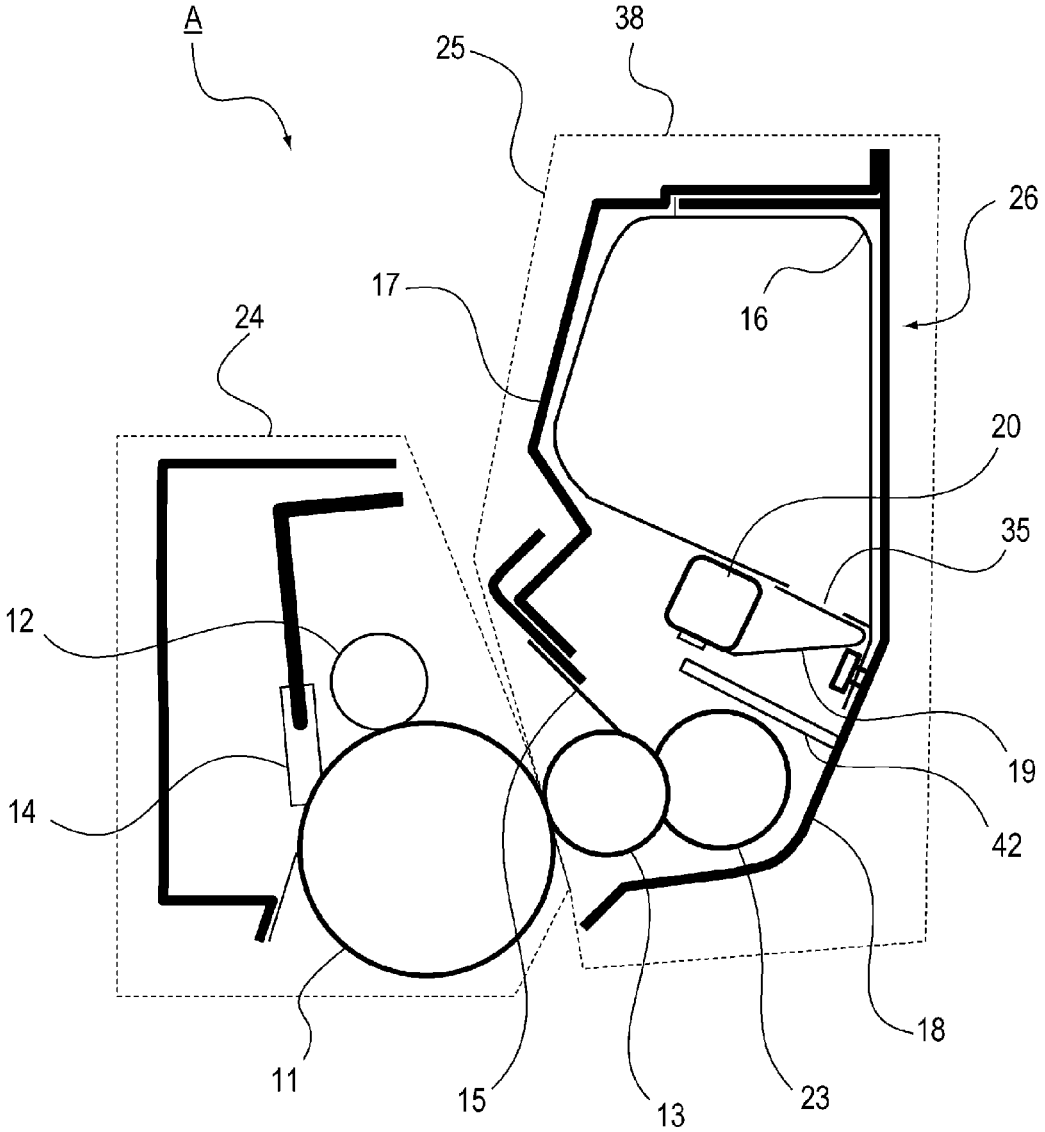

FIG. 40 is a principal sectional view of a process cartridge in the case where a seal also functions as an urging member.

Figure 41:
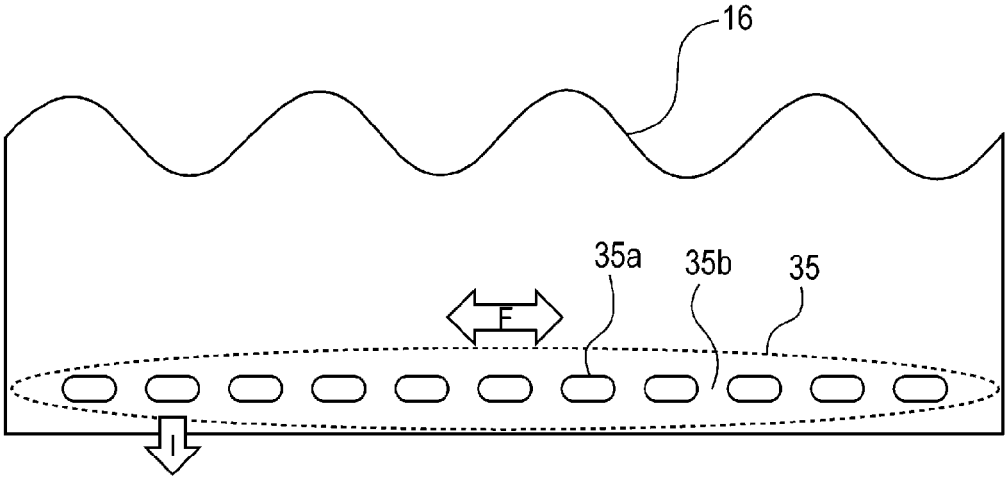

FIG. 41 is an illustration of openings of a developer accommodating container in Sixth Embodiment of the present invention.

Figure 42:
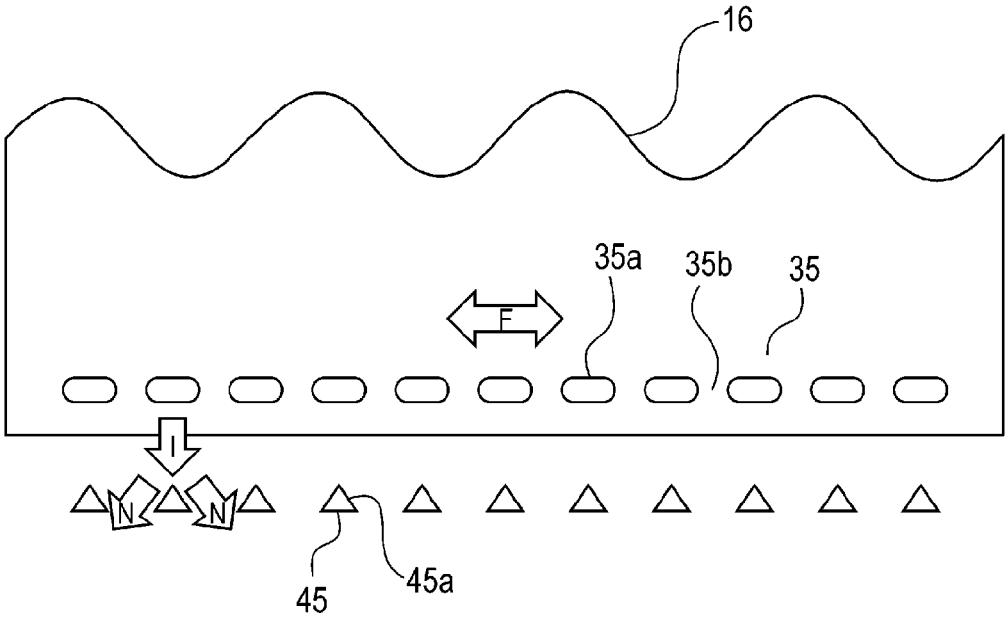
Figure 43:
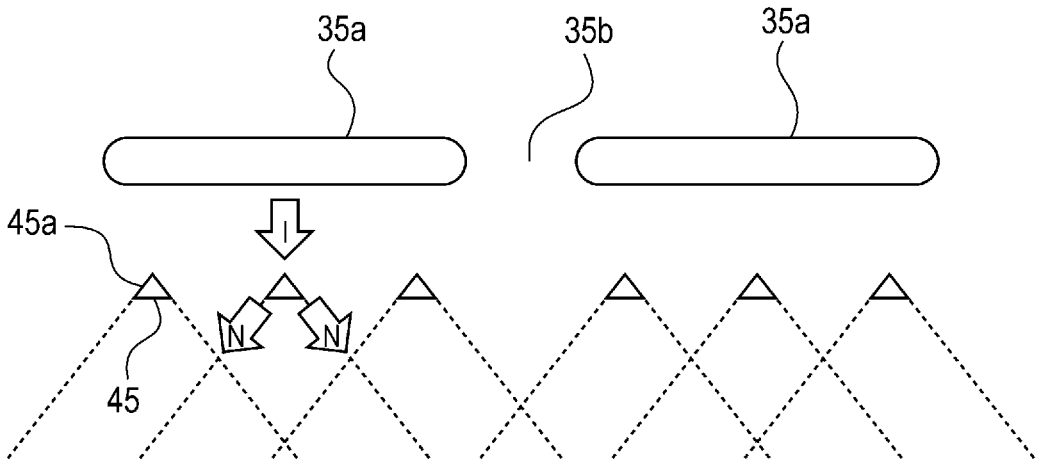

FIGS. 42 and 43 are illustrations of diffusing members in Sixth Embodiment of the present invention.

Figure 44:
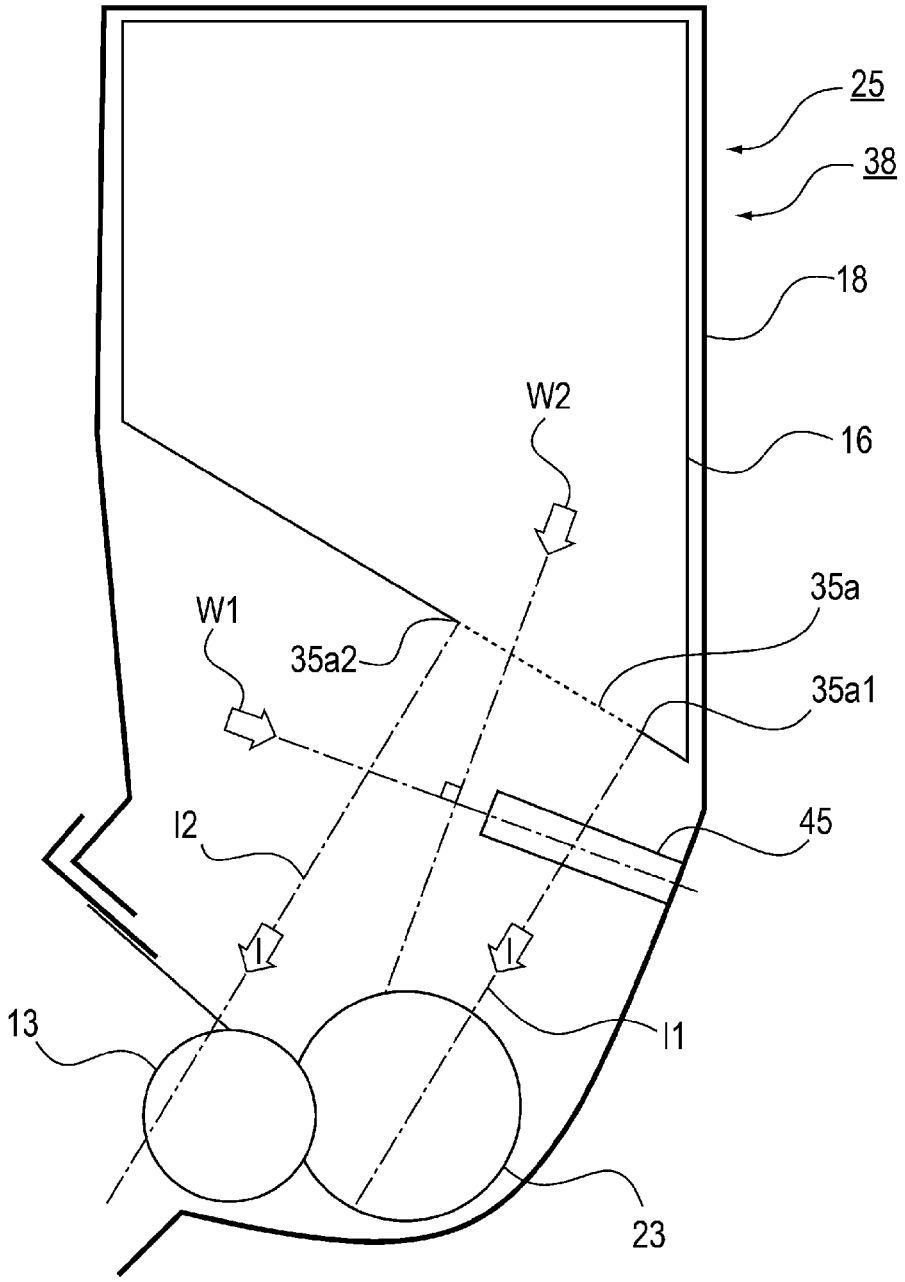
Figure 45:
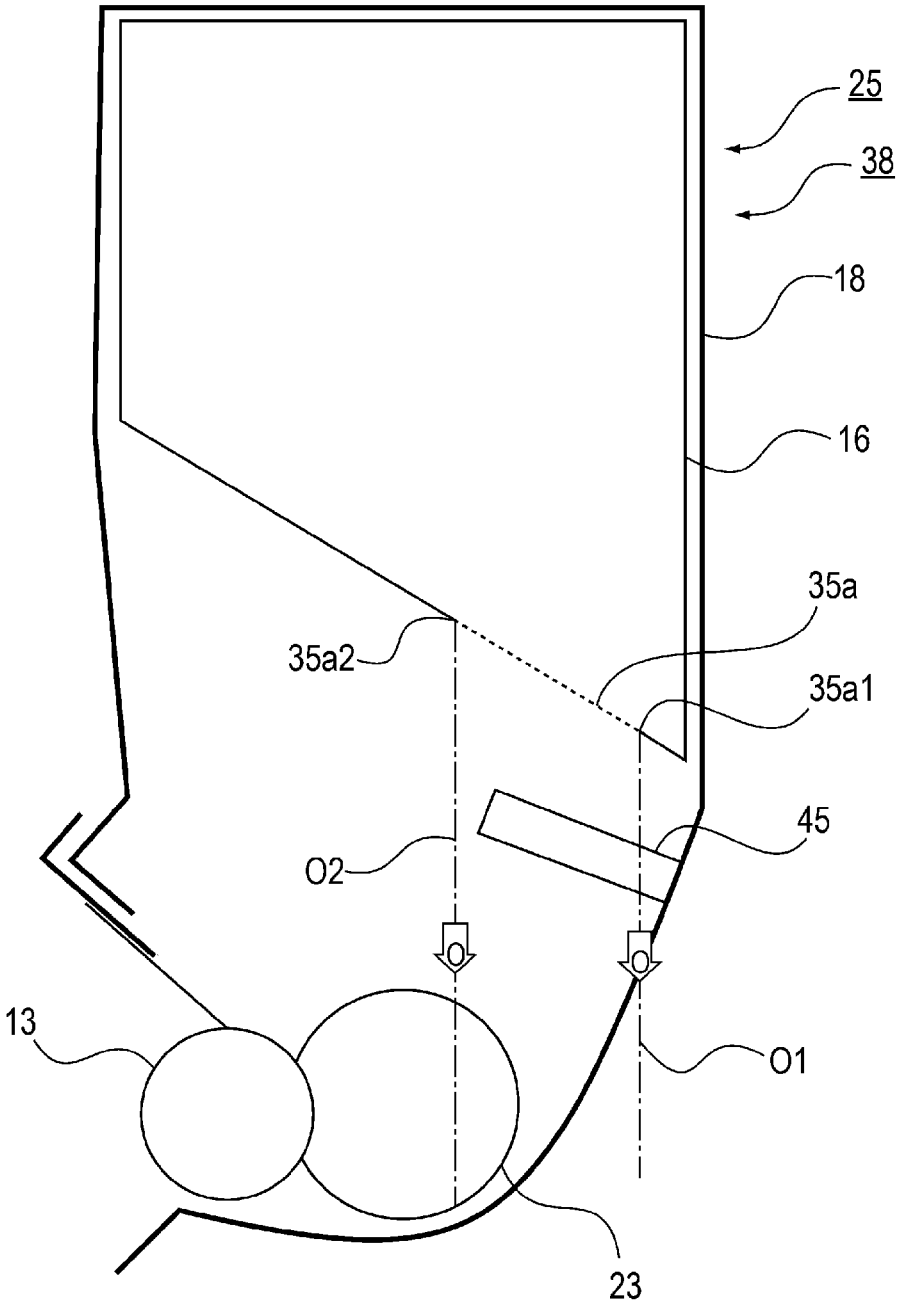

FIGS. 44 and 45 are illustrations of a developer accommodating unit in Sixth Embodiment of the present invention.

Figure 46:
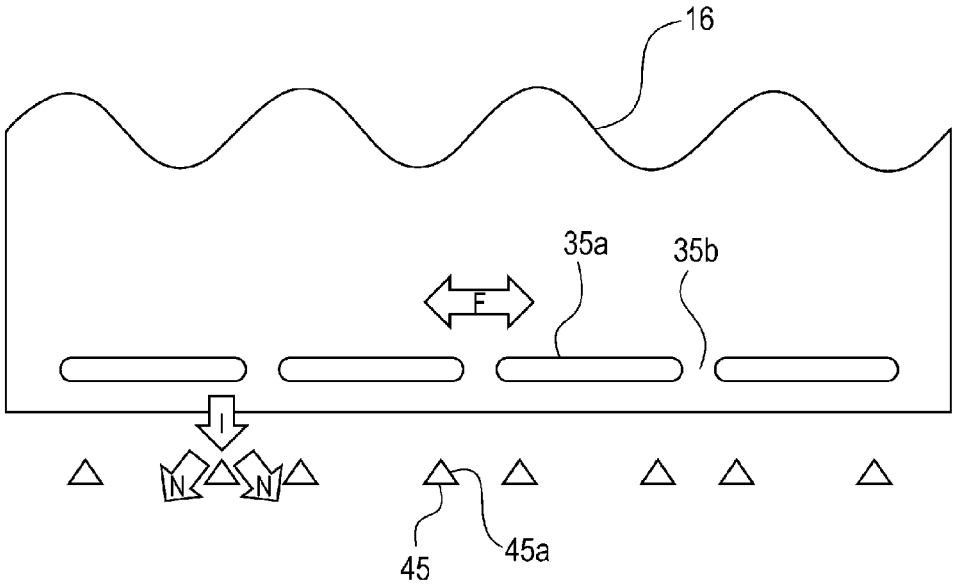

FIG. 46 is a sectional view of the diffusing members in Sixth Embodiment of the present invention.

Figure 47:
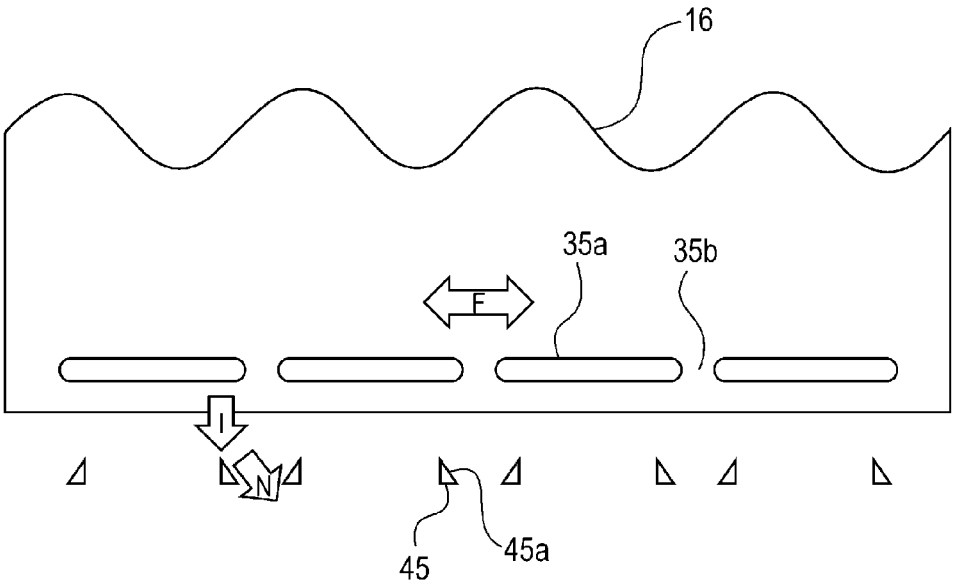
Figure 48:
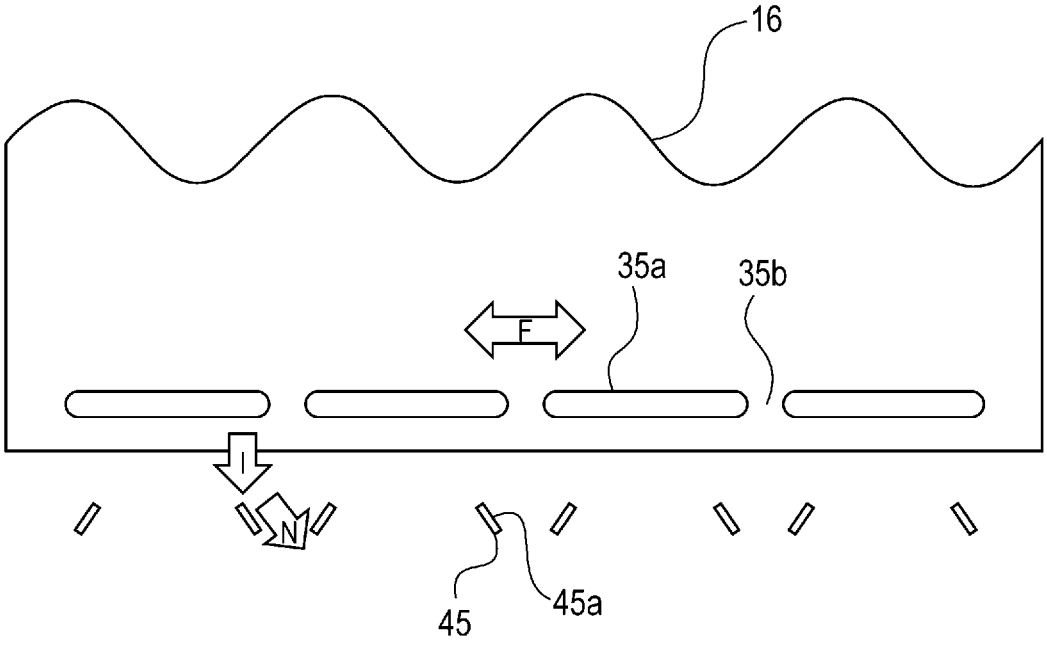

FIGS. 47, 48, and (a) and (b) of each of FIGS. 49 to 52 are illustrations of the diffusing members in Sixth Embodiment of the present invention.

Figure 53:
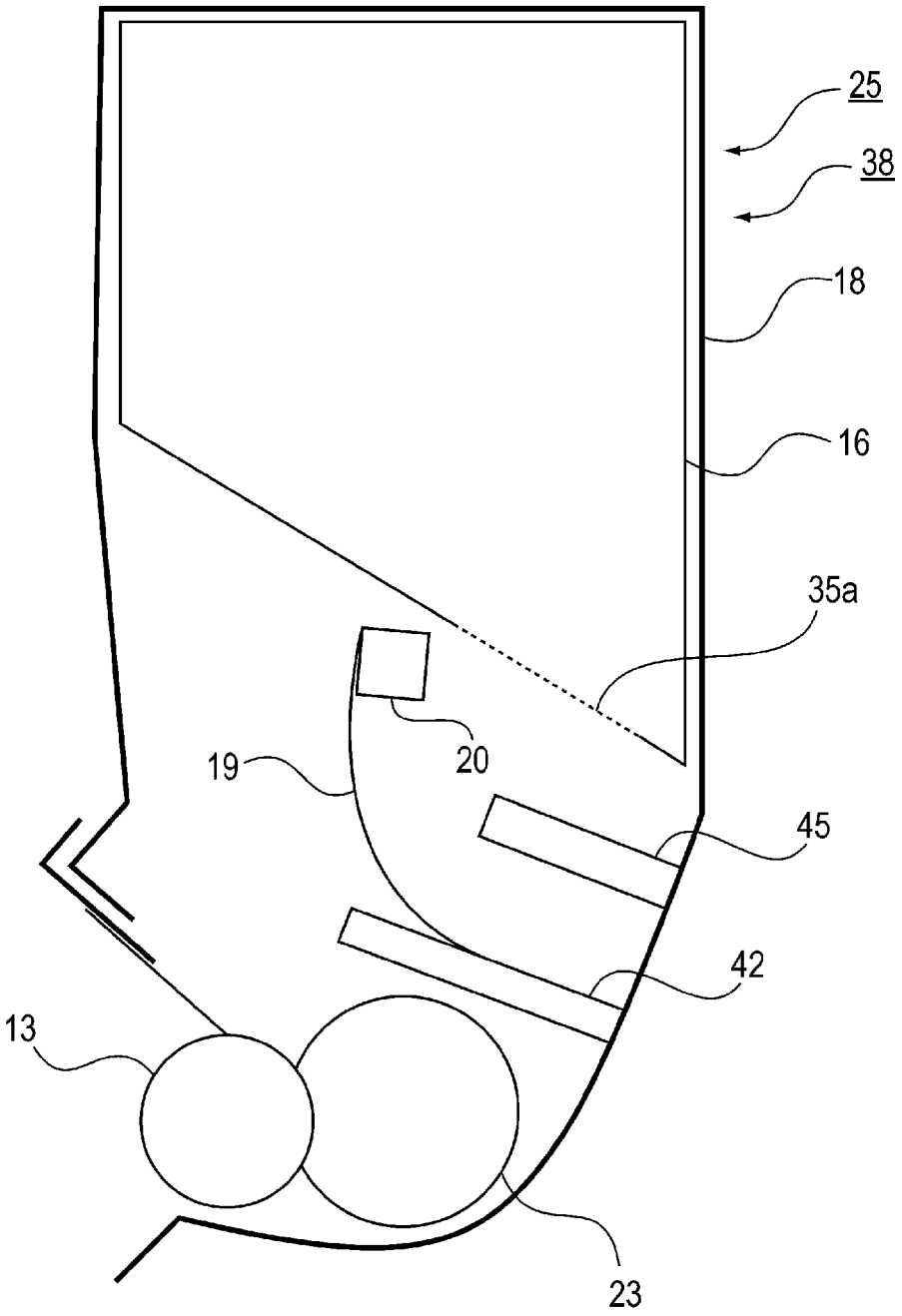
Figure 54:
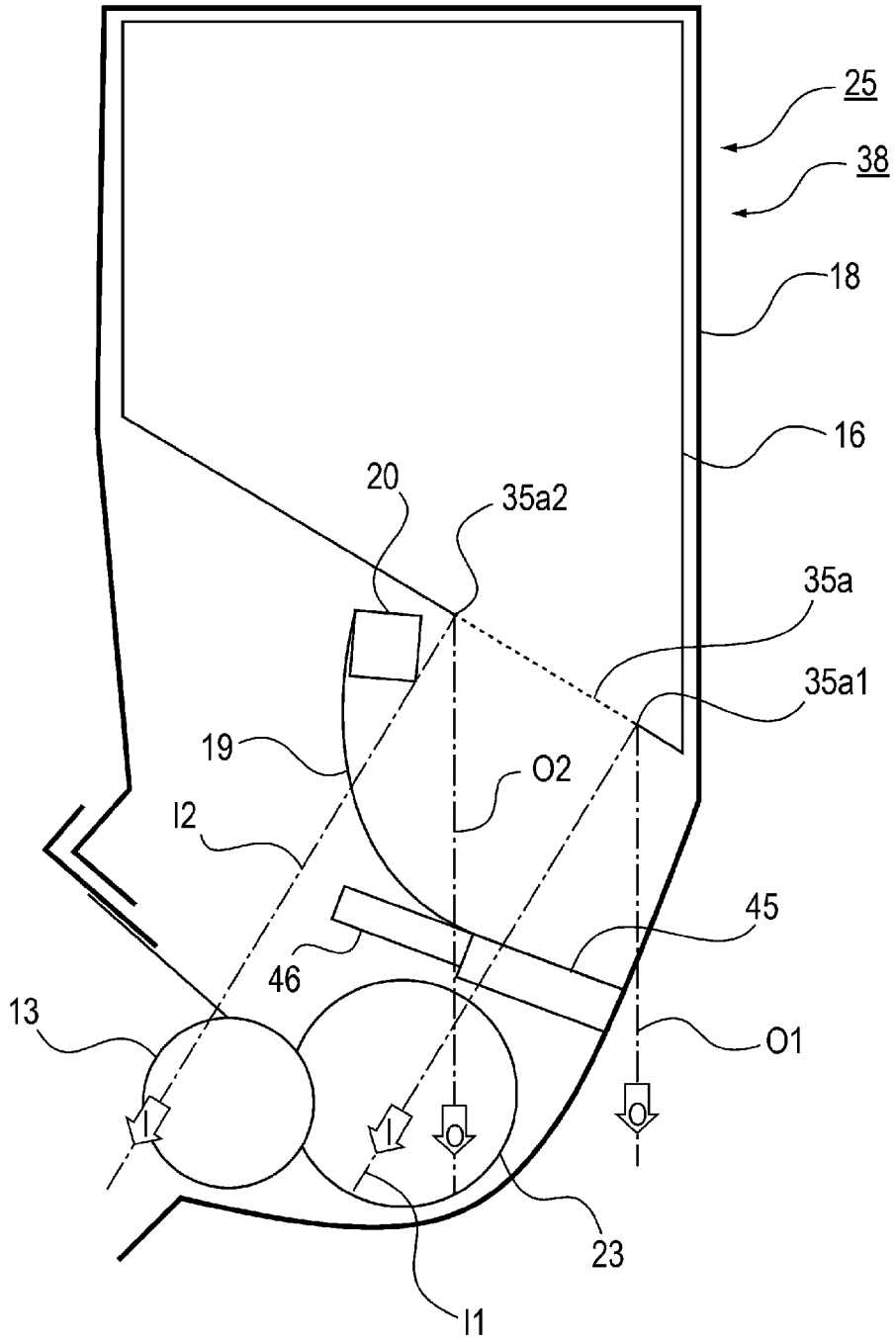

FIGS. 53 and 54 are illustrations of developer accommodating units in Seventh Embodiment of the present invention.

FIGS. 55 to 58 are illustrations of developer accommodating units in Eighth Embodiment of the present invention.

DESCRIPTION OF THE PREFERRED EMBODIMENTS

Hereinbelow, preferred embodiments of the present invention will be exemplarity and specifically described with reference to the drawings. However, dimensions, materials, shapes, relative arrangements and the like of constituent elements described in the following embodiments are appropriately changed depending on constitutions or various conditions of devices (apparatuses) to which the present invention is applied. Therefore, the scope of the present invention is not limited thereto unless otherwise specified.

In the following description, a developer accommodating container refers to at least a flexibility container and a sealing member for sealing an opening, provided to the sealing member, for permitting discharge of a developer. The developer accommodating container before the developer is accommodated therein is referred to as a developer accommodating container 37 for accommodating the developer. The developer accommodating container which accommodates the developer and which is provided with an unsealing member for removing (unsealing) the sealing member is referred to as a developer accommodating container 30 including the unsealing member. The developer accommodating container which accommodates the developer and which is not provided with the sealing member is referred to as a developer accommodating container 26 accommodating the developer.

Incidentally, for simplification, these developer accommodating containers will be described as the developer accommodating container 37, the developer accommodating container 30 and the developer accommodating container 26 by using different reference numerals.

A developer accommodating unit includes at least the developer accommodating container and a frame for accommodating the developer accommodating container.

(First Embodiment)

Figure 1:
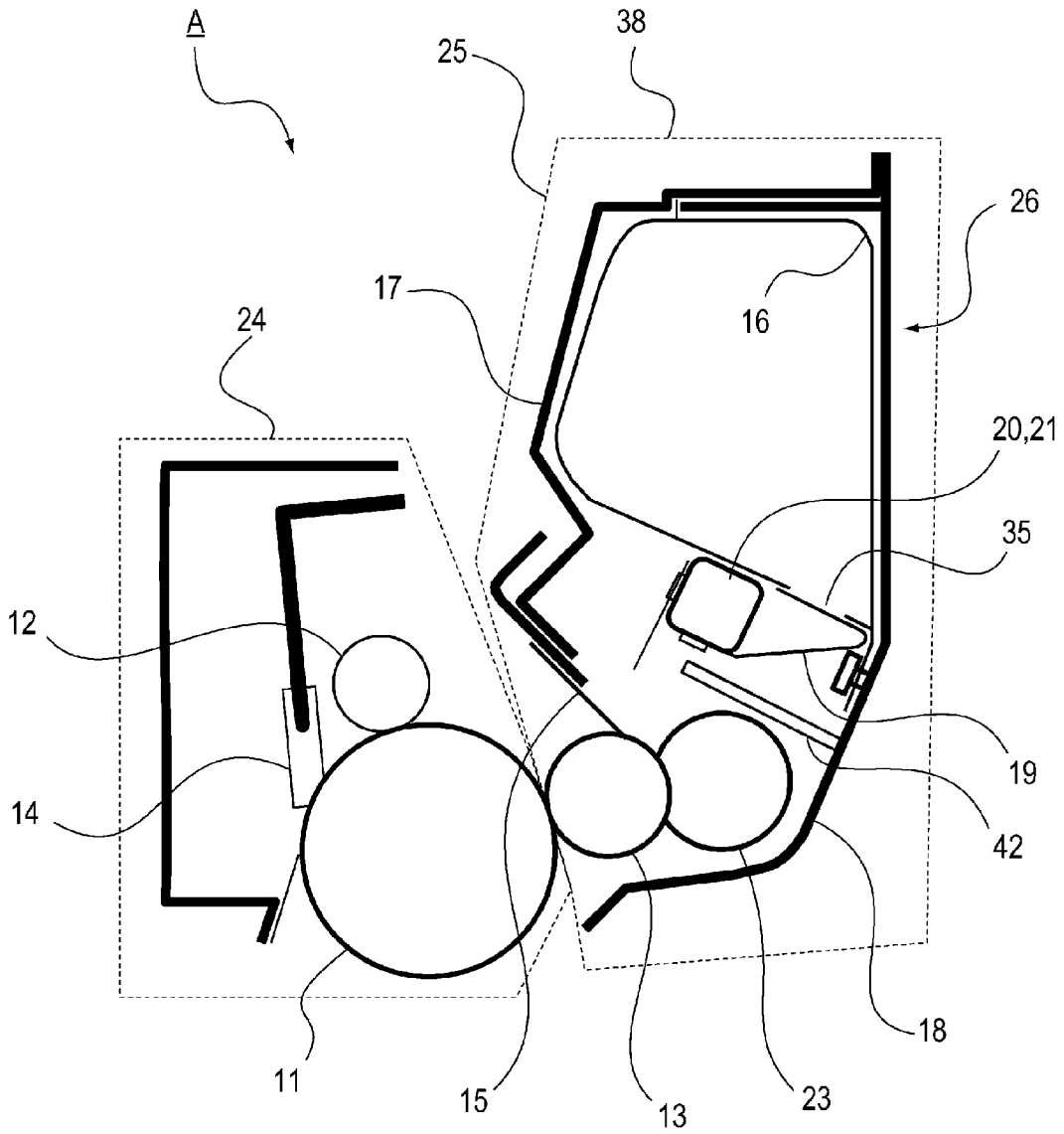
FIG. 1 is a principal sectional view of a process cartridge in an embodiment of the present invention.
Figure 2:
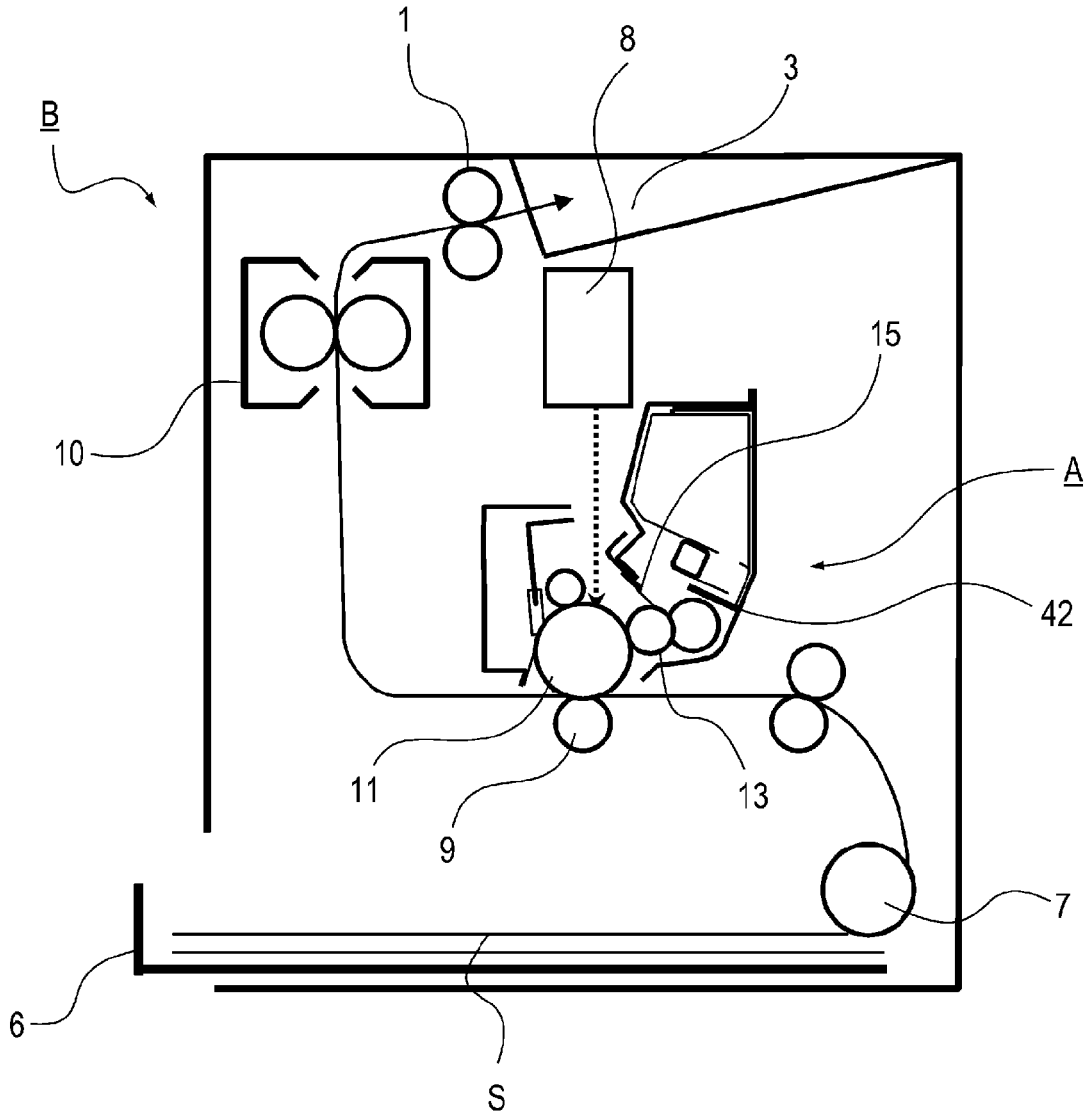
FIG. 2 is a principal sectional view of an image forming apparatus in the embodiment of the present invention.

FIG. 1 is a principal sectional view of a process cartridge including the developer accommodating unit to which the present invention is applicable, and FIG. 2 is a principal sectional view of an electrophotographic image forming apparatus to which the present invention is applicable.

<General Structure of Process Cartridge>

The process cartridge includes an image bearing member (electrophotographic photosensitive member) and process means acting on the image bearing member. Examples of the process means include a charging means for electrically charging a surface of the image bearing member, a developing device for forming an image on the image bearing member, and a cleaning means for removing a developer (toner, carrier, etc.) remaining on the image bearing member surface.

The process cartridge A in this embodiment includes, as shown in FIG. 1, includes a photosensitive drum 11 as the image bearing member and includes, at a periphery of the photosensitive drum 11, a charging roller 12 as the charging means and a cleaner unit 24 including an elastic cleaning blade 14 as the cleaning means. Further, the process cartridge A includes a developing device 38 including a first frame 17 and a second frame 18. The process cartridge A is prepared by integrally assembling the cleaner unit 24 and the developing device 38, and is constituted so as to be detachably mountable to an image forming apparatus main assembly B as shown in FIG. 2. A developing device 38 includes a developing roller 13 as the developing means, a developing blade 15, a developer supplying roller 23, and a developer accommodating container 26 in which the developer is accommodated. The developing roller 13 and the developing blade are supported by the first frame 17.

<General Structure of Electrophotographic Image Forming Apparatus>

The process cartridge A is as shown in FIG. 2, mounted in the image forming apparatus main assembly B and is used for image formation. In the image formation, a sheet S is fed by a feeding roller 7 from a sheet cassette 6 mounted at a lower portion of the apparatus and in synchronism with this sheet feeding, the photosensitive drum 11 is selectively exposed to light by an exposure device 8 to form a latent image. The developer is supplied to the developing roller 13 (developer carrying member) by the developer supplying roller 23 having a sponge shape and is carried in a thin layer on the surface of the developing roller 13. By applying a developing bias to the developing roller 13, the developer is supplied depending on the latent image and thus the latent image is developed into a developer image. This developer image is transferred onto the fed sheet S under bias voltage application to a transfer roller 9. The sheet S is conveyed to a fixing device 10, in which the image is fixed on the sheet S and then the sheet S is discharged to a discharge portion 3 at an upper portion of the apparatus.

<Structure of Developer Accommodating Unit>

Figure 3:
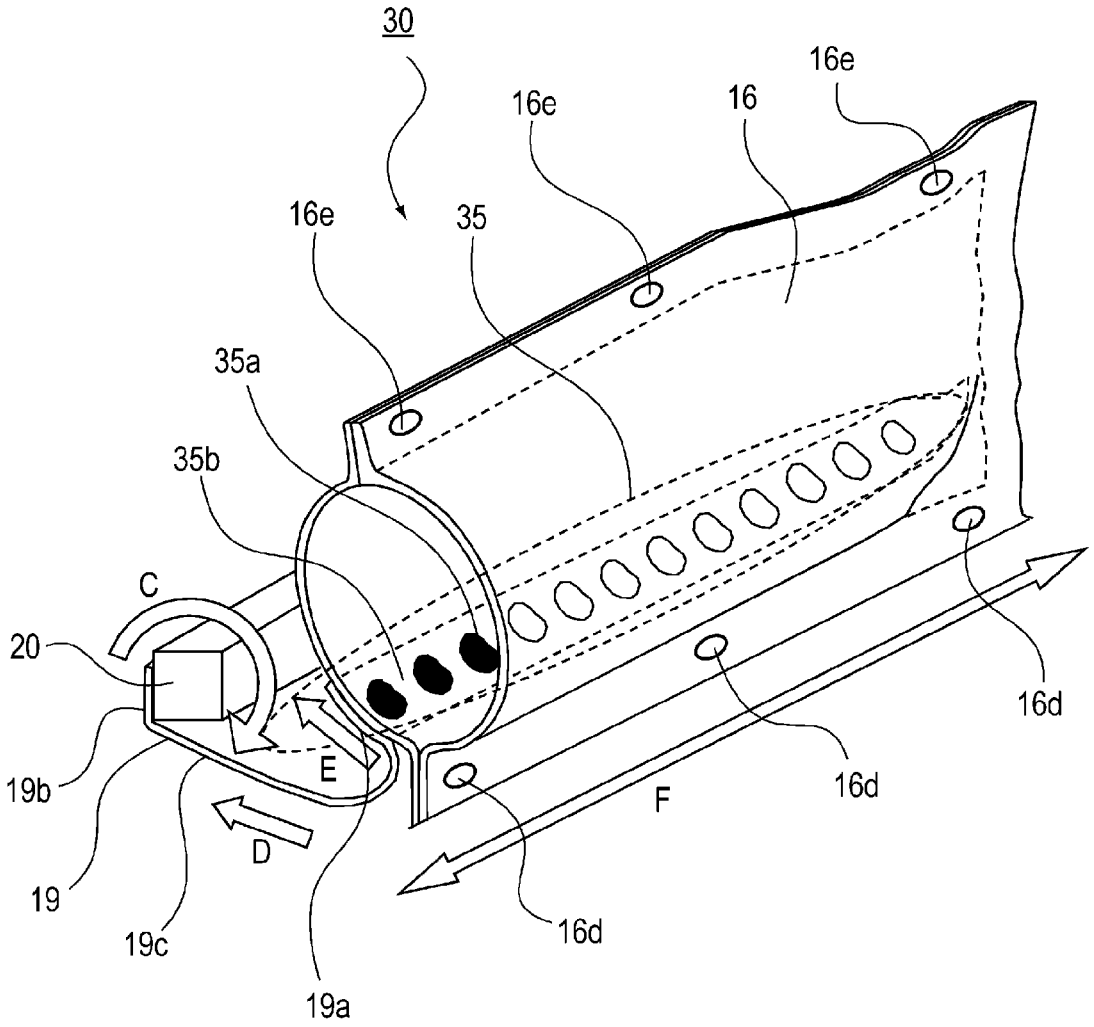
FIG. 3 is a perspective view from a cross section of a developer accommodating container including a sealing member in the embodiment of the present invention.

Next, a structure of a developer accommodating unit 25 will be described with reference to FIGS. 3, 4, (a) of FIG. 7 and FIG. 20. FIG. 3 is a perspective view of the developer accommodating container 30, as seen from a cross-sectional side, FIG. 7 is a detailed sectional view in the neighborhood of the discharging portion 35 for permitting discharge of the developer from a developer bag 16 as a flexible container, and FIG. 20 is a sectional view of the developer accommodating container 26 as seen from a cross-sectional side. Incidentally, the sectional views are illustrated along a plane passing through an unsealing member 20, an opening 35*a* and fixing portions 16*d* and 16*e*. Further, the sectional views are illustrated along a plane perpendicular to a rotation shaft of the unsealing member 20.

(Developer Accommodating Unit)

Figure 4:
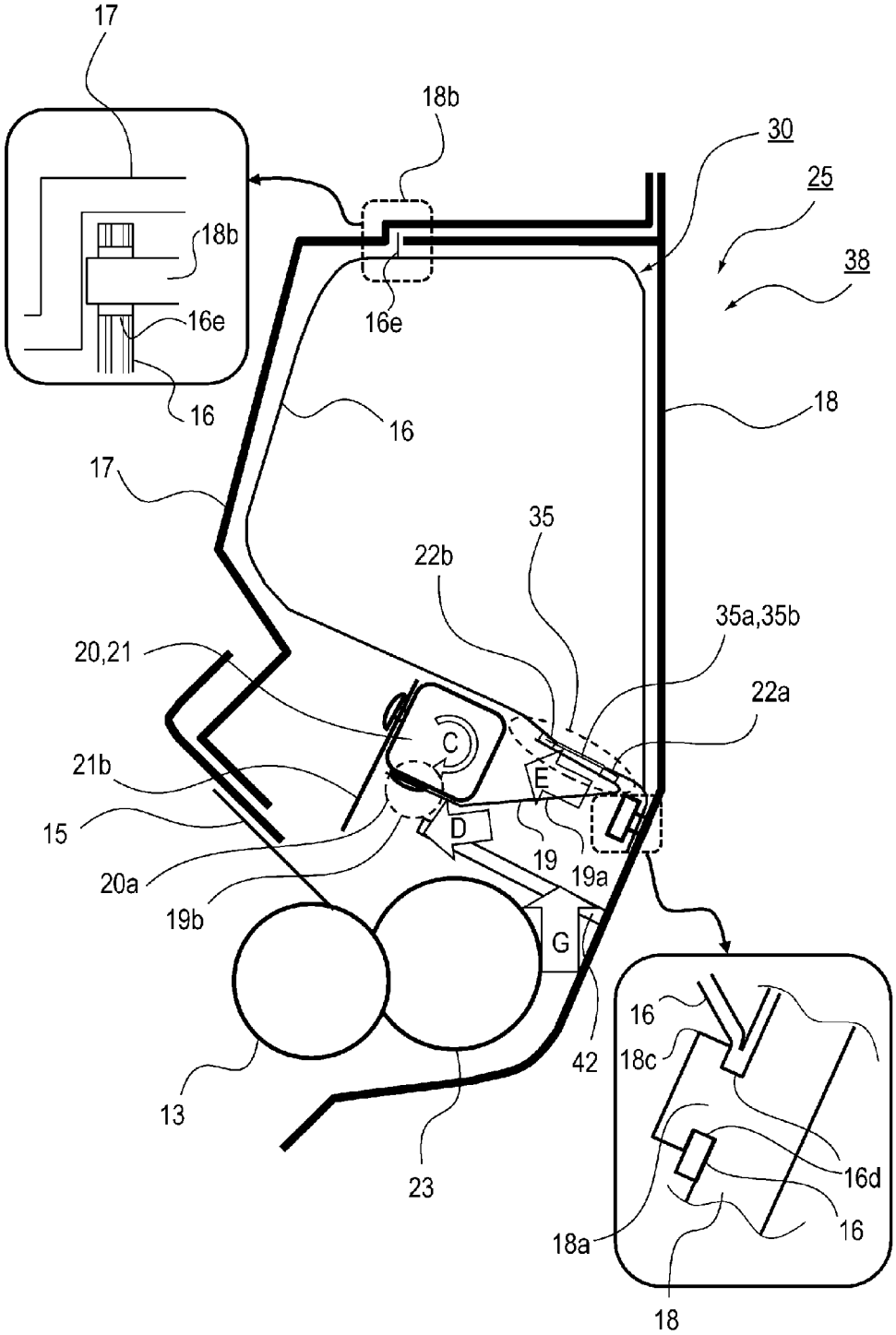
FIG. 4 is a sectional view of a developer accommodating unit before unsealing in the embodiment of the present invention.

The developer accommodating unit 25 is, as shown in FIG. 4, constituted by the developer accommodating container 30, the developing roller 13, the developing blade 15, the developer supplying roller 23, and the first and second frames 17 and 18 for supporting these members. A combination of the first and second frames is a frame in which the developer accommodating container 30 is accommodated.

In this embodiment, the developer accommodating unit 25 is the same as the developing device 38. This is because the developer accommodating unit 25 includes the developing roller 13, the developing blade 15 and the developer supplying roller 23. However, the developing roller 13, the developing blade 15 and the developer supplying roller 23 may also be supported by a frame separately from the developer accommodating unit 25 and thus may be separated from the developer accommodating unit 25. In this case, the developing device 38 is constituted by the developer accommodating unit 25, the developing roller 13, the developing blade 15 and the developer supplying roller 23 (not shown).

In this embodiment, the developing roller 13 and the developer supplying roller 23 are used as a developer carrying member, and a constitution including the developing roller 13 and the developer supplying roller 23 is exemplified as the developer carrying member. The developing roller 13 is a developer carrying member (portion) for carrying the developer on its surface and for feeding the developer to a developing portion where it opposes the photosensitive drum 11. The developer supplying roller 23 is a developer carrying member (portion) for removing, from the developing roller 13, the developer remaining on the developing roller 13 after the development at the developing portion and for supplying (feeding) a fresh developer to the developing roller 13. The constitution of the developer carrying member is not limited to the above constitution but may also be a constitution including only, e.g., the developing roller 13 as the developer carrying member.

(Developer Accommodating Container Including Unsealing Member)

The developer accommodating container 30 including the unsealing member is constituted by an unsealing member 20 and the developer accommodating container 26 as shown in FIGS. 3 and 4.

The unsealing member 20 includes an engaging portion 20*b* to be engaged with a sealing member 19, and by engaging a portion-to-be-engaged 19*b* of the developer accommodating container 26 with the engaging portion 20*b*, the developer accommodating container 30 including the unsealing member 20 is constituted.

(Developer Accommodating Container in which Developer is Accommodated)

As shown in (c) of FIG. 30, the developer accommodating container 26 is constituted by a developer, a developer bag 16 and the sealing member 19. The developer is powder.

The developer bag 16 of the developer accommodating container 26 is sealed with the sealing member 19 at the plurality of openings 35*a* for permitting the discharge of the developer and includes a connecting (bonding) portion which seals a filling opening for permitting the filling of the developer. Thus, the respective openings 35*a* and the filling opening 39 of the developer accommodating container 26 in which the developer is accommodated are sealed and therefore the accommodated developer is not leaked out to the outside, so that the developer accommodating container 26 can be treated at a single unit. Further, the sealing member 19 includes a hole as the portion-to-be-engaged 19*b* to be engaged with the unsealing member 20, thus being engageable with the unsealing member 20.

(Developer Accommodating Container for Accommodating Developer)

As shown in (a) of FIG. 30, the developer accommodating container 37 for accommodating the developer is constituted by the developer bag 16 and the sealing member 19 for sealing the plurality of openings 35*a* for permitting the discharge of the developer and for exposing the openings 35*a* by being moved. The developer bag 16 of the developer accommodating container 37 for accommodating the developer includes the filling opening 39 for permitting the filling of the developer and the openings 35*a* for permitting the discharge of the developer. The openings 35*a* are provided to the developer bag 16 at a plurality of positions.

Here, in the developer accommodating container 37 for accommodating the developer, the developer is not filled as yet, and the developer accommodating container 37 is in a state in which the filling opening 39 for permitting the filling of the developer is open.

(Filling and Developer Accommodating Container)

A relation between the developer accommodating container 37 for accommodating the developer and the developer accommodating container 26 in which the developer is accommodated will be described.

First, as shown in (a) of FIG. 30, the developer accommodating container 37 for accommodating the developer is not filled with the developer and is provided with the filling opening 39 for permitting the filling of the developer.

Next, as shown in (b) of FIG. 30, the developer is filled from the filling opening 39, for permitting the filling of the developer, of the developer accommodating container 37 for accommodating the developer. Further, by flexibility of the developer bag 16, the filling opening 39 for permitting the filling of the developer is deformable correspondingly to a filling device and thus the filling of the developer is facilitated without causing scattering of the developer. For filling the developer, a known auger type filling device is used but another method (means) having a similar function may also be used.

Then, as shown in (c) of FIG. 30, the filling opening 39 for permitting the filling of the developer is bonded and sealed. The bonding of the bonding portion 39*a* of the opening for permitting the filling of the developer is made by ultrasonic bonding in this embodiment but may also be made by other bonding methods using heat, a laser and the like.

Then, when the bonding of the bonding portion 39*a* of the opening for permitting the filling of the developer is completed, the developer is filled in the developer bag 16, so that the developer accommodating container 26 in which the developer is accommodated is provided.

A position and a size of the filling opening 39 for permitting the filling of the developer may appropriately selected correspondingly to shapes and the like of the developer filling device and the process cartridge A.

(Effect of Incorporating Developer Bag in Developing Device)

By forming the developer accommodating container 26, in which the developer is accommodated, in a bag shape, the developer can be treated as a unit. For that reason, a developer filling step can be separated from a main assembling step (manufacturing line) of the process cartridge A. As a result, the developer is prevented from being scattered in the main assembling step (manufacturing line) of the process cartridge A, so that maintenance such as cleaning of the manufacturing line can be reduced. By the prevention of the scattering of the developer during the assembling step, it is possible to omit a cleaning step of the process cartridge A to be performed after the developer filling.

Also in the filling step of the developer in the developer bag 16, the developer bag 16 has flexibility, and thus the filling opening 39 for permitting the developer filling is also soft and therefore can be easily sealed with less scattering of the developer.

Further, the developer accommodating container 26 in which the developer is accommodated has flexibility and therefore can be assembled while following a shape of the frame.

Further, in the filling step, the developer accommodating container 27 has flexibility and therefore deforms its cross section to increase its volume in which the developer can be filled, so that a filling amount can be increased during the filling.

Further, the developer accommodating container 37 before the filling with the developer has flexibility and thus can be made small (thin), so that a storing space during storage before the filling can be decreased compared with the frame which is a resinous structure.

(Structure of Developer Bag)

As shown in FIGS. 3 and 4, the developer bag 16 accommodating the developer therein and has a bag-like shape which is deformable, and is provided with the plurality of openings 35*a* at the discharging portion 35 for permitting the discharge of the accommodated developer.

Further, the developer bag 16 includes developer bag fixing portions (portions-to-be-fixed) 16*d* and 16*e* fixed to the first frame 17 and the second frame 18.

(Material and Air Permeability of Developer Bag)

Parts (a) to (c) of FIG. 29 are sectional views for illustrating the developer accommodating container 26. As shown in (a) of FIG. 29, the developer bag 16 is constituted by bonding a sheet 16*u* which includes the discharging portion 35 and does not have air permeability and a sheet 16*s* which has the air permeability and which is an air permeable portion to each other.

Here, a degree of the air permeability of the air permeable portion (sheet) 16*s* may appropriately selected so that the developer is prevented from leaking out of the developer bag 16 based on a balance with a size of the developer (particle size of powder) to be accommodated.

As a material for the air permeable portion 16*s*, a nonwoven fabric or the like formed of polyethylene telephthalate (PET), polyethylene (PE), polypropylene (PP) or the like in a thickness of 0.03-0.15 mm may preferably be used. Further, even when the material for the air permeable portion 16*s* is not the nonwoven fabric, a material having minute holes which is smaller in diameter than the powder such as the developer accommodated in the developer bag 16 may also be used.

Further, in this embodiment, as shown in FIGS. 3 and 29, the air permeability portion 16*s* is disposed over the entire region of the developer bag 16 with respect to a longitudinal direction in the second frame 18 side. As shown in (b) of FIG. 29, the air permeable portion 16*s* may also constitute the entire developer bag 16.

As a material for the developer bag 16 other than the air permeable portion 16*s*, a material having flexibility so as to improve an efficiency during the discharge of the developer described later may preferably be used. Further, the material for the air permeable portion 16*s* may also have flexibility.

(Effect of Developer Bag Having Air Permeability)

The reason why the air permeability is imparted to the developer bag 16 as described above is that the developer bag 16 can meet states during manufacturing, during transportation until a user uses the cartridge A, and during storage. First, the reason for the state during the manufacturing is that the developer bag 16 is made deformable and reducible in order to facilitate assembling the developer bag 16 with the frames 17 and 18. In the case where the developer bag 16 is not provided with the air permeability portion 16*s*, the size thereof cannot be changed from that in a state in which the developer bag 16 is filled with the developer (the developer bag 16 is closed) and therefore the developer bag 16 is not readily deformed. For that reason, it takes time to assembly the developer bag 16 and the step is complicated. Therefore, when the air permeability is imparted to at least a part of the developer bag 16, the size of the developer bag 16 can be changed from that in the state in which the developer bag 16 is filled with the developer and then is closed, thus facilitating the assembling of the developer bag 16.

Next, the reason for the states during the transportation and during the storage is that the developer bag 16 can meet a change (difference) in air pressure between the inside and outside of the developer bag 16 during the transportation and during the storage of the process cartridge A. The difference in air pressure between the inside and outside of the developer bag 16 is generated in the case where the developer bag 16 is in a lower air-pressure environment during the transportation or the like than during the manufacturing or in the case where the developer bag 16 is stored at a higher temperature than during the manufacturing. For that reason, by expansion of the developer bag 16, there is a possibility that parts contacting the developer bag 16 are deformed or broken. Therefore, there is a need to control the air pressure and the temperature during the transportation and during the storage, so that facilitates for that purpose are required and a cost is increased. However, problems caused due to the difference in air pressure between the inside and outside of the developer bag 16 can be solved by partly imparting the air permeability to the developer bag 16.

Further, in the case where the nonwoven fabric is provided with the discharging portion 35 and a bonding portion 22 at a periphery of the discharging portion 35, there is a possibility that fibers of the nonwoven fabric fall out with peeling of the sealing member 19 during unsealing and then enter the developer to adversely affect the image. For that reason, the discharging portion 35 is provided to the sheet 16*u* different from the sheet 16*s* having the air permeability, so that the above-described falling-out of the fibers from the nonwoven fabric is prevented.

Further, a filling density can be increased by filling the developer while deaerating the developer bag 16.

(Structure of Discharging Portion of Developer Bag)

As shown in FIGS. 3 and 10, the developer bag 16 includes the developer discharging portion 35 consisting of the plurality of openings 35*a* for permitting the discharge of the developer therein and the connecting portion 35*b* defining the plurality of openings 35*a*. Further, the discharging portion 35 is continuously surrounded by a bonding portion 22 to be unsealably bonded, so that the developer accommodated in the developer bag 16 is sealed with the sealing member 19.

(Structure of Bonding Portion of Developer Bag)

The bonding portion 22 has a rectangular shape consisting of two lines extending in a long direction (arrow F direction) and two lines extending in a short direction (arrow E direction) so as to surround the discharging portion 35 and therefore the bonding portion 22 enables the sealing of the discharging portion 35.

Here, of the two lines of the welded bonding portion 22 extending in the long direction (arrow F direction), a bonding portion which is first unsealed is referred to as a first bonding portion 22*a* and a bonding portion which is unsealed later is referred to as a second bonding portion 22*b*. In this embodiment, in the case where the bonding portion 22 is viewed along the surface of the sealing member 19, a bonding portion closer to a fold-back portion 19*d* (or portion-to-be-engaged 19*b*) described later is a first bonding portion 22*a*. Further, a bonding portion opposing the first bonding portion 22*a* via the opening 35*a* is a second bonding portion 22*b*. Further, a bonding portion with respect to a widthwise direction (arrow E direction) is a widthwise bonding portion 22*c*.

In this embodiment, an unsealing direction is the arrow E direction. The unsealing direction is defined as follows. In the case where the unsealing is effected by moving the sealing member 19, of the first bonding portion 22*a* and the second bonding portion 22*b* opposing to each other via the opening 35*a*, the first bonding portion 22*a* is first unsealed (peeled). Thus, a direction directed from the first bonding portion 22*a* to be first unsealed toward the second bonding portion 22*b* is the unsealing direction (arrow E direction).

When the sealing member 19 is unsealed (peeled) from the developer bag 16 in the arrow E direction, in some cases, the peeling microscopically progresses also in the arrow F direction due to the deformation of the developer bag 16 by an unsealing force also in the first bonding portion 22*a* and the second bonding portion 22*b*. However, the unsealing direction in this embodiment does not refer to such a microscopic unsealing direction.

(Disposition of Openings of Developer Bag)

Next, disposition of the openings 35*a* will be described with reference to FIGS. 10, 11 and 30. The movement direction of the sealing member 19 for sealing the openings 35*a* and for exposing the openings 35*a* by being moved (i.e., a direction in which the sealing member 19 is pulled by the rotatable member 20)) is an arrow D direction. By the movement of the sealing member 19, the exposure of the openings 35*a* progresses in the unsealing direction (arrow E direction). In the following, the movement direction of the sealing member 19 is the arrow D direction.

The plurality of openings 35*a* and the plurality of connecting portions 35*b* are alternately disposed along the direction (arrow F direction) perpendicular to the unsealing direction (arrow E direction). Further, the sealing member 19 is configured to be wound up by rotating the unsealing member 20 but the arrow F direction is the same direction as an axis (axial line) of the rotation is shaft of the unsealing member 20.

The reason why the rotational axis direction of the developing roller 13 and the arrangement direction (arrow F direction) of the plurality of openings 35*a* are made equal is that the developer is easily supplied, during the discharge thereof, to the developing roller 13 over the entire longitudinal direction without being localized.

The plurality of openings 35*a* are shifted and disposed along the arrow F direction and therefore the discharging portion 35 is long in the arrow F direction and is short in the arrow E direction. That is, with respect to the arrow F direction, a distance from an end to another end of the plurality of openings 35*a* is longer than that with respect to the arrow E direction.

Thus, the discharging portion 35 where the plurality of openings 35*a* are shifted and disposed in the direction (arrow F direction) perpendicular to the unsealing direction (arrow E direction) is long in the arrow F direction and is short in the arrow E direction. For that reason, the distance required for the unsealing can be made shorter than that required for the unsealing in the long direction (arrow F direction) and therefore a time required for the unsealing can also be made short.

Further, a constitution in which the sealing is member 19 for covering the discharging portion 35 is wound up by the unsealing member 20 is employed. The rotational axis direction of the unsealing member 20 and the direction (arrow F direction) substantially perpendicular to the unsealing direction (arrow E direction) are made equal, so that winding distance and time of the sealing member 19 can be shortened.

(Shape and Direction of Openings of Developer Bag)

Each of the plurality of openings 35*a* in First Embodiment has a circular shape. When a discharging property is taken into consideration, an area of the openings 35*a* may preferably be large. Further, the connecting portions 35*b* defining the openings 35*a* may preferably be large (thick) in order to enhance the strength of the developer bag 16. Therefore, the area of the openings 35*a* and the area of the connecting portions 35*b* are required to achieve a balance in view of a material and a thickness of the discharging portion 35 and a force relationship with peeling strength during the unsealing described later and may be appropriately selected. The shape of each opening 35*a* may also be, in addition to the circular shape, a polygonal shape such as a rectangular shape, an elongated circular shape as shown in FIG. 18 in Fourth Embodiment described later, and the like shape.

The arrangement of the openings 35*a* may only be required to be such that the openings 35*a* are shifted (spaced) with respect to the direction (arrow F direction) perpendicular to the unsealing direction (arrow E direction). Even when the adjacent openings 35*a* overlap with each other, as shown in (c) of FIG. 28, as seen in the direction (arrow F direction) perpendicular to the unsealing direction (arrow E direction) or do not overlap with each other, as shown in (d) of FIG. 28, as seen in the direction (arrow F direction), an effect of the connecting portions 35*b* described later is achieved.

Further, the direction of the openings 35*a* may preferably be such that the developer accommodated in the developer bag 16 is easily discharged in an attitude during image formation. For that reason, in the attitude during image formation, the openings 35*a* are disposed so as to be open downward with respect to the gravitational direction. The state in which the openings 35*a* open downward with respect to the gravitational direction refers to that the direction of the openings 35*a* has a downward component with respect to the gravitational direction.

(Fixing Between Developer Bag and Frame)

As shown in FIGS. 3 and 4, the developer bag 16 is fixed inside the first frame 17 and the second frame 18 by the fixing portions 16*d* and 16*e*.

(First Fixing Portion)

First, as a first fixing portion, the first fixing portion 16*d* of the developer bag 16 where a force is received when the sealing member 19 is unsealed (removed) from the developer bag 16 as described later is provided. The first fixing portion 16*d* is provided at a plurality of positions in parallel to the direction (arrow F direction) along which the plurality of openings 35*a* are arranged. Different from the arrangement at the plurality of positions, the first fixing portion 16*d* may also be a single fixing portion elongated in parallel to the arrow F direction (not shown).

The first fixing portion 16*d* is positioned in the neighborhood of the openings 35*a* of the developer bag 16.

The first fixing portion 16*d* of the developer bag 16 is fixed to a first fixing portion 18*a* of the frame.

The first fixing portion 16*d* is a fixing portion necessary for the time of unsealing the developer bag 16, and its action and arrangement will be described later in the description of the unsealing.

(Second Fixing Portion)

Further, as a second fixing portion, the second fixing portion 16*e* for preventing movement of the developer bag 16 downward or toward the developing roller 13 and the developer supplying roller 23 is provided.

The second fixing portion 16*e* is provided for the following two reasons. A first reason is that the second fixing portion 16*e* of the developer bag 16 is prevented from moving the developer bag 16 downward in the attitude during the image formation. For that reason, the second fixing portion 16*e* may preferably be disposed at an upper position in the attitude during the image formation.

Further, a second reason is that the developer bag 16 is prevented from disturbing the image in contact with the developing roller 13 and the developer supplying roller 23 during the image formation. For that reason, the second fixing portion 16*e* of the developer bag 16 may preferably be provided at a position remote from the developing roller 13 and the developer supplying roller 23. In this embodiment, the second fixing portion 16*e* of the developer bag 16 is disposed at an upper position remote from the developing roller 13 as shown in FIG. 4.

The second fixing portion 16*e* of the developer bag 16 is fixed to a second fixing portion 18*b* of the frame.

(Fixing Method Between Developer Bag and Frame)

A fixing method between the developer bag 16 and the frame will be described with reference to FIGS. 27 and 4. Parts (a) to (d) of FIG. 27 are illustrates of the fixing portion of the developer accommodating container.

(Fixing Method of First Fixing Portion)

As a fixing method of the first fixing portion 16*d* of the developer bag 16, fixing by ultrasonic clamping such that a boss of the second frame 18 is passed through the hole of the developer bag 16 to be deformed is used. As shown in (a) of FIG. 27, before fixing, the first fixing portion 18*a* of the second frame 18 has a cylindrical boss shape, and the first fixing portion 16*d* of the developer bag 16 has a hole which is open. An assembling step is described below.

First, a projected portion of the first fixing portion 18*a* of the second frame 18 is passed through the hole of the first fixing portion 16*d* of the developer bag 16 ((b) of FIG. 27).

Then, an end of the first fixing portion 18*a* of the second frame 18 is fused by a ultrasonic clamping tool 36 ((c) of FIG. 27).

Then, the end of the first fixing portion 18*a* of the second frame 18 is deformed so that it is larger than the hole of the first fixing portion 16*d* of the developer bag 16, and thus the developer bag 16 is fixed to the second frame 18 ((d) of FIG. 27).

(Fixing Method of Second Fixing Portion)

As shown in FIG. 4, as a fixing method of the second fixing portion 16*e* of the developer bag 16, clamping by the two frames 17 and 18 is used. Holes are made in the developer bag 16 to constitute the first fixing portion 16*e* of the developer bag 16, and projections are provided to the second frame 18 to constitute the second fixing portion 18*b* of the frame.

An assembling step is as follows. The second fixing portion (projections) 18*b* of the second frame 18 is passed through the second fixing portion (holes) 16*e* of the developer bag 16, and then the developer bag 16 is clamped by the first frame 17 so that the second fixing portion (holes) 16*e* of the developer bag 16 is not disengaged (dropped) from the second fixing portion (projections) 18*b* to be fixed.

(Other Fixing Means)

As other fixing means, different from the above-described ultrasonic clamping, it is also possible to use fixing means using ultrasonic wave. For example, heat clamping using heat, (heat) welding or ultrasonic welding for directly welding the developer bag 16 to the first frame 17 or the second frame 18, bonding using a solvent or an adhesive, insertion of the developer bag 16 between the frames, hooking using the heat clamping, the ultrasonic clamping, a screw, or a combination of holes and projections (such as bosses), and the like means may also be used. Further, the developer bag 16 may also be fixed via a separate member provided between the first and second frames 17 and 18 depending on appropriate design based on relationships in space, arrangement or the like between the developer bag 16 and the first and second frames 17 and 18 (not shown).

<Structure of Sealing Member>

As shown in FIGS. 3 and 4, the sealing member 19 covers the discharging opening 35 of the developer bag 16 before use of the cartridge A to confine the developer in the developer bag 16. The sealing member 19 is moved, so that the openings 35*a* are exposed. The sealing member 19 is constituted by a sheet-like sealing member including a sealing portion 19*a* for covering (sealing) the discharging portion 35 of the developer bag 16, a portion-to-be-engaged 19*b* to be fixed (engaged) with the unsealing member 20 described later, and a sealing member connecting portion 19*c* which connects the sealing portion 19*a* and the portion-to-be-engaged 19*b*. The sheet-like sealing member is formed of a laminate material having a sealant layer which exhibits an easy-unsealing property described later, and a base material therefor is polyethylene telephthalate (PET), polyethylene, polypropylene or the like. A thickness of the sheet-like sealing member may appropriately be set in a range of 0.03-0.15 mm.

(Sealing Portion of Sealing Member)

A sealing portion 19*a* refers to a region where the sealing member 19 seals the plurality of openings 35*a* and connecting portions 35*b* of the developer bag 16. By the sealing portion 19*a*, the developer is prevented from being leaked from the inside of the developer bag 16 until before use of the process cartridge A.

(Engaging Portion of Sealing Member)

The sealing member 19 has a free end portion in one end side thereof with respect to the unsealing direction (arrow E direction) and at the free end portion, the portion-to-be-engaged 19*b* to be engaged with the unsealing member 20 for moving the sealing member 19 is provided. With the portion-to-be-engaged 19*b*, the unsealing member 20 for moving the sealing member 19 so as to expose the openings 35*a* is engaged. The unsealing member 20 may also be configured to automatically perform the unsealing by receiving a driving force from the image forming apparatus main assembly B. Or, the unsealing member 20 may also be configured to perform the unsealing by being held and moved by the user. In this embodiment, the unsealing member 20 is a rotation shaft provided in the frame, and the sealing member 19 engaged with the unsealing member 20 is pulled, so that the developer accommodating container 26 accommodating the developer is unsealed.

(Sealing Member Connecting Portion of Sealing Member)

A portion for connecting the bonding portion 22 and the sealing member engaging portion (portion-to-be-engaged) 19*b* is the sealing member connecting portion 19*c*. The sealing member connecting portion 19*c* is a portion for transmitting a force so as to pull off the bonding portion 22 by receiving the force from the unsealing member 20.

(Folding-Back of Sealing Member Connecting Portion)

Referring to FIG. 12, a surface formed between the first bonding portion 22*a* and the second bonding portion 22*b* at the movement of the unsealing is taken as N1. A surface which is perpendicular to the surface N1 and which passes through the first bonding portion 22*a* is taken as N2.

The unsealing member 20 is disposed in the second bonding portion 22*b* side more than the surface N2 passing through the first bonding portion 22*a*. In other words, the sealing member 19, when it is seen along the surface of the sheet-like sealing member 19, includes a fold-back portion 19*d* where the sealing member 19 is folded back at the portion (connecting portion 19*c*) between the connecting portion 22 and the portion-to-be-engaged 19*b* engaged with the unsealing member 20. The fold-back portion 19*d* may be provided with or not provided with a fold (crease). A folding angle Q of the sealing member 19 may preferably be 90 degrees or less. The folding angle Q is a narrow angle Q between a surface of the bonding portion 22 of the developer bag 16 and a surface along the direction (arrow D direction) in which the sealing member 19 is pulled.

(Fixing of Sealing Member)

Further, fixing between the sealing member 19 and the unsealing member 20 is, in this embodiment, made by the ultrasonic clamping similarly as in the case of the first fixing portion 16*d*. Other than the ultrasonic clamping, the fixing may also be made by the (heat) welding, the ultrasonic welding, the bonding, the insertion between the frames, the hooking by a hole and a projection, or the like similarly as the means for fixing the first fixing portion 16*d* and the second fixing portion 16*e*.

(Portion Having Easy-Unsealing Property of Sealing Member)

A method of providing a peeling force of the bonding portion 22 with a desired value will be described. In this embodiment, in order to provide the peeling force with the desired value (a minimum force within a range in which the toner sealing property can be maintained), two methods are principally employed.

In a first method, a laminate material having a sealant layer for enabling easy unsealing of the sealing member is applied. Further, the first method is a method in which the easy unsealing is enabled at the bonding portion by using, as the material for the developer bag 16, a sheet material (of, e.g., polyethylene or polypropylene) which is weldable with the sealant layer and which has flexibility. By changing a combination of formulation of the sealant layer with the material to be bonded, the peeling force can be adjusted correspondingly to a desired condition. In this embodiment, a material having a peeling strength of about 3N/15 mm measured by testing methods for heat sealed flexible packages (JIS-Z0238) is used.

A second method is a method in which as shown in FIGS. 4 and 7, the discharging portion 35 of the developer bag 16 is placed in a state in which the sealing member 19 is folded back with respect to an unsealing direction (arrow E direction in the figures). For example, in the state of FIG. 4, the unsealing member 20 is rotated (in an arrow C direction), so that the sealing member 19 is pulled in a pulling direction (arrow D direction) by the unsealing member 20. As a result, the developer bag 16 and the sealing member 19 provide an inclined peeling positional relationship, as shown in FIG. 12, in which the narrow angle Q between the surface of the bonding portion 22 of the developer bag 16 and the surface along the pulling direction (arrow D direction) of the sealing member 19 is 90 degrees or less. It has been conventionally known that the peeling force necessary to separate the both surfaces can be reduced by establishing the inclined peeling positional relationship. Therefore, as described above, the discharging portion 35 is placed in the state in which the sealing member 19 is folded back with respect to the unsealing direction (arrow E direction), so that the sealing member 19 of the bonding portion 22 and the developer bag 16 are placed in the inclined peeling positional relationship and thus the peeling force can be adjusted so as to be reduced.

<Structure of Unsealing Member>

The unsealing member 20 is used for the purpose of peeling the sealing member 19 from the developer bag 16 by applying a force to the sealing member 19 to move the sealing member 19. The unsealing member 20 includes a supporting portion (not shown) which has a shaft shape and which is rotatably supported by the second frame 18 at its ends, and includes an engaging portion 20*b* to which the portion-to-be-engaged 19*b* of the sealing member 19 is to be fixed. In this embodiment, the unsealing member 20 has a rectangular shaft shape, and the portion-to-be-engaged 19*b* of the sealing member 19 is engaged with the engaging portion 20*b* at one of four surfaces of the rectangular shaft.

(Combined Use as Unsealing Member, Urging Member and Stirring Member)

The urging member 21 for externally acting on the developer bag 16 to discharge the developer accommodated in the developer bag 16, and the unsealing member 20 may be separate members but in this embodiment, the same part performs functions of the unsealing member 20 and the urging member 21.

Further, a function of stirring the developer discharged from the developer bag 16 and a function of the unsealing member 20 may be performed by separate members but in this embodiment, the unsealing member 20 also perform the stirring function of the stirring member.

(Effect of Combined Use as Unsealing Member, Urging Member and Stirring Member)

Thus, by using the same part (member) as the unsealing member 20, the urging member 21 and the stirring member, the number of parts is reduced, so that it becomes possible to realize cost reduction and space saving.

<Summary of Unsealing of Developer Bag>

The unsealing of the developer bag 16 will be described with reference to FIGS. 7 and 8.

For unsealing the developer bag 16, the developing device 38 includes a power application point portion 20*a* where the unsealing member 20 applies the force for pulling the sealing member 19, and includes the fixing portion 18*a* of the frame for fixing the developer bag 16 to be pulled.

The power application point portion 20*a* is a portion, closest to the bonding portion 22, of a portion where the sealing member 19 and the unsealing member 20 contact at the moment of the unsealing. In (b) of FIG. 7, a corner portion 20*c* of the unsealing member 20 constitutes the power application point portion 20*a*. The fixing portion 18*a* of the second frame 18 includes a fixing portion 18*c* for suppressing movement of the developer bag 16 caused by the force during the unsealing. In this embodiment, from the bonding portion 22, the first fixing portion 18*a* of the frame and the first bonding portion 16*d* of the developer bag 16 are bonded to each other by the ultrasonic clamping, and as shown in (b) and (c) of FIG. 7 and (a) of FIG. 8, a portion, closer to the bonding portion 22, of the first fixing portion 18*a* bonded by the ultrasonic clamping constitutes the fixing portion 18*c*.

As shown in FIG. 4, the unsealing member 20 is rotated in the arrow C direction by transmission of the during force thereto from the main assembly by an unshown driving means.

Figure 5:
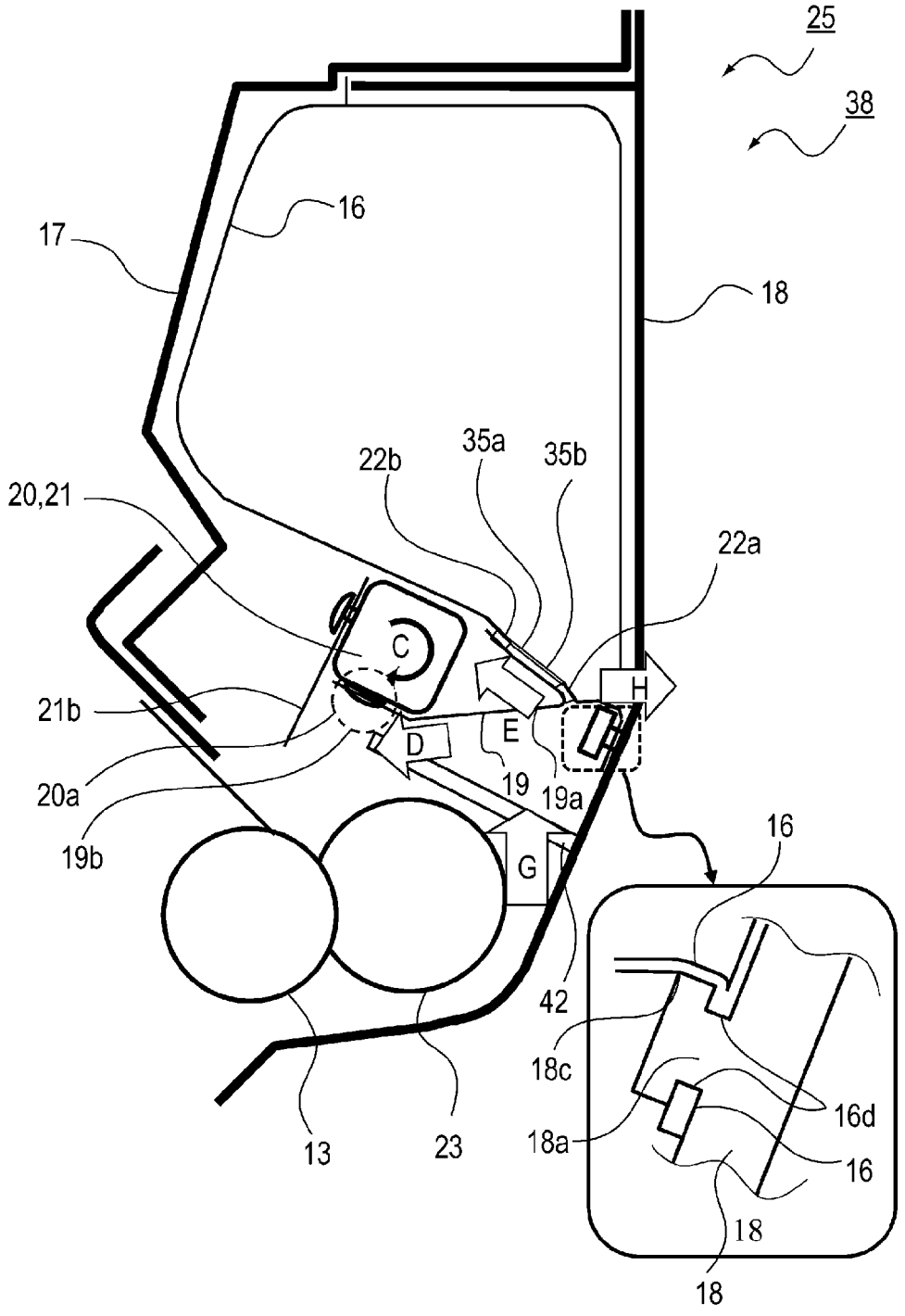
FIG. 5 is a sectional view of the developer accommodating unit immediately before the unsealing in the embodiment of the present invention.

A state immediately before the sealing member 19 is pulled by further rotation of the unsealing member 20 to start the unsealing is shown in FIG. 5 and (c) of FIG. 7. With the rotation, the sealing member 19 fixed to the unsealing member 20 by the portion-to-be-engaged 19*b* is pulled in the arrow D direction by the corner portion 20*c* (power application point portion 20*a*) of the rectangular unsealing member 20.

When the sealing member 19 is pulled, the developer bag 16 is pulled via the bonding portion 22. Then, a force is applied to the first fixing portion 16*d* of the developer bag 16, so that the developer bag 16 is pulled from the fixing portion 18*c* toward the power application point portion 20*b* by the fixing portion 18*c*. Then, in a cross section perpendicular to the rotation shaft of the unsealing member 20, the first bonding portion 22*a* is moved to approach a line connecting the power application point portion 20*a* and the fixing portion 18*c*. At this time, with respect to the arrow D direction, from a side close to the rotation shaft of the unsealing member 20, the portions are disposed in the order of the openings 35*a*, the first bonding portion 22*a*, the fold-back portion 19*d* and the fixing portion 18*c* ((b) of FIG. 7). Further, the unsealing member 19 is folded back between the first bonding portion 22*a* and the portion-to-be-engaged 19*b* and therefore the force is applied to the portion of the first bonding portion 22*a* so as to be inclination-peeled in the arrow D direction. Then, the peeling of the first bonding portion 22*a* is effected to start the unsealing of the discharging portion 35.

Together with the corner portion 20*c*, also the power application point portion 20*a* is moved in the arrow C direction, and when the sealing member contacts a corner portion 20*d*, the power application point portion 20*a* is moved from the corner portion 20*c* to the corner portion 20*d*. Part (b) of FIG. 7 shows a state in which the power application point portion 20*a* is the corner portion 20*c*, and (c) of FIG. 7 shows a state in which the unsealing member 20 in further rotated and thus the power application point portion 20*a* is moved to the corner portion 20*d*.

Figure 6:
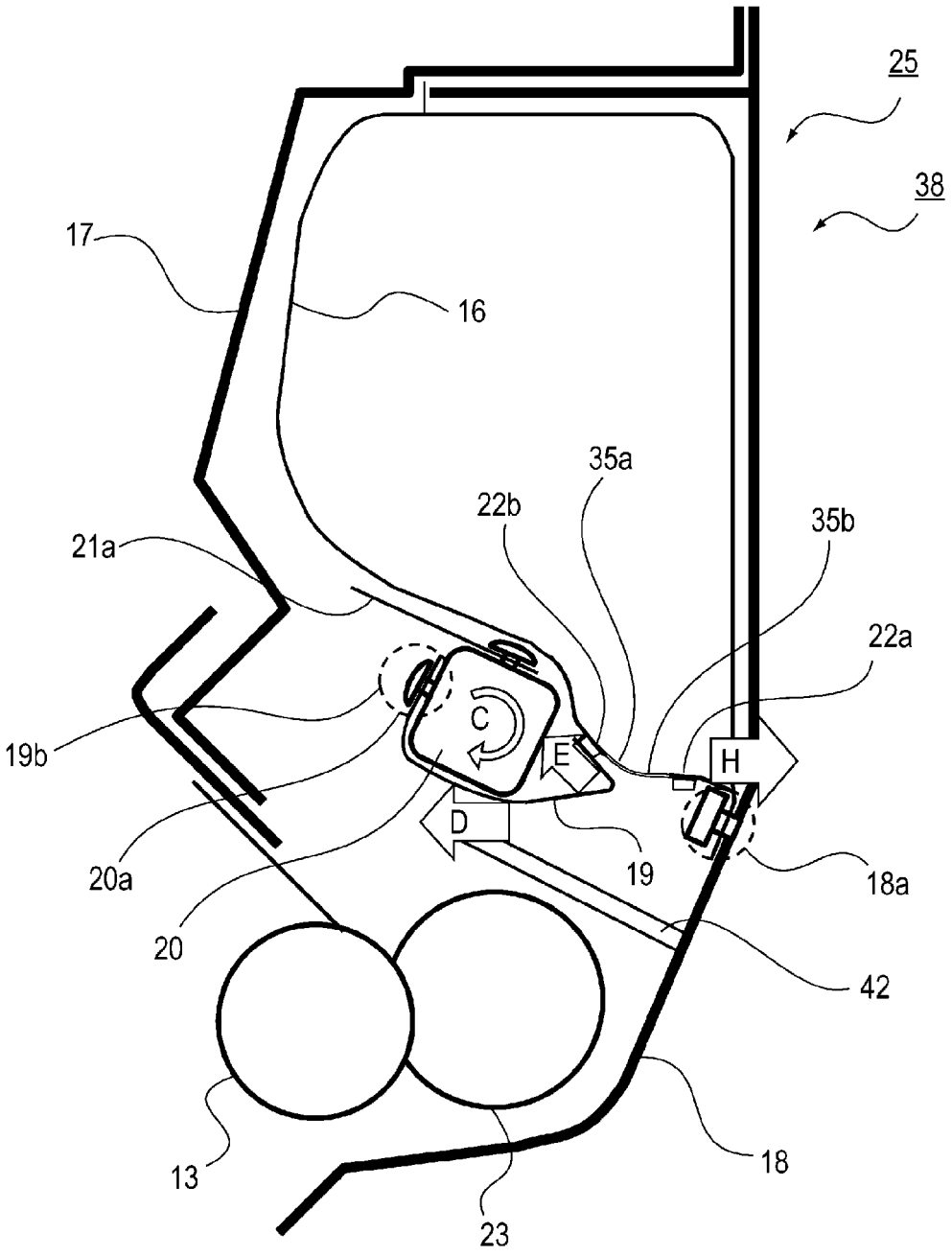
FIG. 6 is a sectional view of the developer accommodating unit in which a discharging portion is unsealed in midstream in the embodiment of the present invention.

As shown in FIG. 6 and (c) of FIG. 7, when the unsealing is advanced with further rotation of the unsealing member 20, also the fold-back portion 19*d* is moved in the arrow E direction. Then, the unsealing is further advanced, so that the openings 35*a* are exposed. A state in which the peeling of the second bonding portion 22*b* is to be started after the openings 35*a* are exposed is shown in (a) of FIG. 8. Also at this time, similarly as in the case of the peeling of the first bonding portion 22*a*, the sealing member 19 is pulled toward the power application point portion 20*a*, and the developer bag 16 stands firm toward a direction of the fixing portion 18*c* (an arrow H direction). Then, in a cross section perpendicular to the rotation shaft of the unsealing member 20, the second bonding portion 20*b* is moved to approach a line connecting the power application point portion 20*a* and the fixing portion 18*c*. Then, the force is applied to the portion of the bonding portion 22*b* in the arrow D direction, so that the second bonding portion 22*b* is separated. Thus, the second bonding portion 22*b* is peeled to complete the unsealing ((b) of FIG. 8 and FIG. 9). Then, the developer inside the developer bag 16 is discharged in an arrow I direction through the openings 35*a* of the discharging portion 35.

Thus, the sealing member 19 is wound up around the unsealing member 20 by the rotation of the unsealing member 20, so that the bonding portion 22 is unsealed. The sealing member 19 is wound up by the rotation and therefore a space required to move the unsealing member 20 may only be required to be a rotation space of the unsealing member 20, and compared with the case where the sealing member 19 is moved by movement other than the rotation, it is possible to realize space saving.

By providing the sealing member 19 with the fold-back portion 19*d*, so that the bonding portion 22 can be inclination-peeled without using shearing peeling and thus can be unsealed with reliability.

Further, the portion-to-be-engaged 19*b*, to be engaged with the unsealing member 20, for unsealing the sealing member 19 in an end side of the sealing member 19 with respect to a direction substantially perpendicular to the direction (arrow F direction in FIG. 3) in which the plurality of openings 35*a* are arranged is provided, so that the sealing member 19 can be engaged and unsealed with reliability.

Further, by providing the frame with the developer bag 16, the developer bag 16 is supported by the frame during the unsealing, so that even a soft and deformable developer bag 16 becomes unsealable with reliability.

With respect to the discharge of the developer during the unsealing, as described above, the bonding portion 22 is moved along the line connecting the power application point portion 20*a* and the fixing portion 18*c* (in the order of (a) of FIG. 7, (b) of FIG. 7, (c) of FIG. 7 and (a) of FIG. 8). By this motion, the developer at the periphery of the openings 35*a* is moved, so that agglomeration of the developer can be broken.

(Positional Relation of Fixing Portion Associated with Unsealing)

As shown in FIG. 4, in order to peel off the first bonding portion 22*b* with reliability, the following positional relation is required between the first bonding portion 22*b* and the fixing portion 18*c*. During the unsealing, with respect to the fixing portion 18*c*, the unsealing member 20 pulls the sealing member 19 in the arrow D direction. At this time, with respect to the movement direction (arrow D direction) of the sealing member 19 by the unsealing member 20, the fixing portion 18*c* is provided upstream of the openings 35*a*. For that reason, as shown in FIG. 5, a force is applied to the fixing portion 18*c* in the arrow H direction. Therefore, when the unsealing force is applied, the sealing member 19 is pulled in the arrow H direction and the arrow D direction between the fixing portion 18*c* and the unsealing member 20 to apply a force to the first bonding portion 20*a*, thus advancing the unsealing. Thus, when the fixing portion 18*c* is not provided upstream with respect to the movement direction (arrow D direction) of the sealing member 19, the entire developer bag 16 is pulled in the direction in which the sealing member 19 is pulled, so that the force cannot be applied to the first bonding portion 22*a* and thus the first bonding portion 22*a* cannot be unsealed.

In this way, the fixing portion 18*c* is provided upstream with respect to the movement direction (arrow D direction) of the sealing member 19, so that reliable unsealing becomes possible.

(Distance Relation of Fixing Portion Associated with Unseal)

As shown in FIGS. 22 and 23, in order to peel off the first bonding portion 22*b* with reliability, the following length relationship is required between the first bonding portion 22*a* and the fixing portion 18*c*. First, a point of the first bonding portion 22*a* finally peeled off when a flat surface which passes the unsealing member 20, the openings 35*a* and the fixing portion 18*c* and which is perpendicular to the rotation shaft of the unsealing member 20 is viewed, is taken as a first point 22*d*. The first point 22*d* is an end point of the first bonding portion 22*a* close to the openings 35*a*. A distance from the fixing portion 18*c* to the first point 22*d* along the developer bag 16 is taken as M1. A distance from the first fixing portion 18*c* to the first point 22*d* along the developer bag 16 with respect to the direction including the openings 35*a* is taken as M2. The openings 35*a* provide a space in which the material for the developer bag 16 is not present but a width of the openings 35*a* is also included in the distance M2.

In this case, a relationship of M1<M2 is satisfied to permit the peeling-off of the first bonding portion 22*a*. The relationship of M1<M2 will be described specifically.

($M1<M2$)

First, in the case where M1<M2 is satisfied, as shown in FIG. 22, a force for pulling the sealing member 19 toward the first bonding portion 22*a* (in the arrow D direction) by the unsealing member 20 and a retaining force of the fixing portion (in the arrow H direction) are applied to the first bonding portion 22*a*, so that inclination peeling of the first bonding portion 22*a* can be effected. By effecting the inclination peeling, the peeling force can be set at a low level. Part (a) of FIG. 22 shows a state before the unsealing, and (b) of FIG. 22 shows a state immediately before the first bonding portion 22*a* is unsealed.

($M1>M2$)

On the other hand, in the case of M1>M2, as shown in FIG. 23, the pulling force by the unsealing member 20 is not applied to the first bonding portion 22*a* but is applied to the second bonding portion 22*b*. In this case, the force is not applied to the first bonding portion 22*a* and therefore the first bonding portion 22*a* is not peeled. In this case, the force from the unsealing member 20 (in the arrow D direction) and the retaining force of the fixing portion 18*c* (in the arrow H direction) are applied to the second bonding portion 22*b*. In this state, to the second bonding portion 22*b*, the force for pulling the sealing member 19 by the unsealing member 20 (in the arrow D direction) and the retaining force of the fixing portion 18*c* (in the arrow H direction) are applied. At the portion of the second bonding portion 22*b*, the peeling relationship is a shearing peeling relationship and therefore it is difficult to unseal the second bonding portion 22*b*. This is because the shearing peeling requires a large force thereon that of the inclination peeling.

Part (a) of FIG. 23 shows a state before the unsealing, and (b) of FIG. 23 shows a state when the force for pulling the sealing member 19 by the unsealing member 20 (in the arrow D direction) is applied to the bonding portion (the second bonding portion in this case) by the rotation of the unsealing member 20. To the second bonding portion 22*b*, the force is applied but is applied based on the shearing peeling and therefore compared with the case of the inclination peeling, a very large force is required, so that it becomes difficult to reduce the peeling force.

(Distance in Case where Projection is Present)

Definition of a manner of measuring the above-described distances M1 and M2 will be described. The distances M1 and M2 are important when the sealing member 19 is pulled during the unsealing. In the case where there is no projection (projected connecting portion) 16*t* (FIG. 24) at an intermediate position of paths of M1 and M2, the distances developed as shown in FIGS. 22 and 23 may only be required to be measured. Further, in the case where there is the projection 16*t* formed, by bonding in manufacturing, at the intermediate position of the paths of M1 and M2, even when the sealing member 19 is pulled during the unsealing, the projection 16*t* is not elongated (peeled off) and therefore the portion of the projection 16*t* is not included in the distances M1 and M2. That is, the portion, such as the projection 16*t*, which does not affect transmission of the force is not included in the distances M1 and M2.

As described above, based on the relationship of M1<M2, the first bonding portion 22*a* is unsealed earlier than the second bonding portion 22*b*. As a result, the fold-back portion 19*d* of the sealing member 19 is provided closer to the first bonding portion 22*a*. By this fold-back portion 19*d*, the peeling is not the shearing peeling but is the inclination peeling. As a result, with reliability, the sealing member 19 can be peeled off from the developer bag 16, so that it is possible to provide an unsealable developing device 38.

(Plurality of Fixing Portions)

A relation between a plurality of fixing portions and the unsealing will be described with reference to (a) and (b) of FIG. 31, wherein (a) of FIG. 31 shows a state before the unsealing, and (b) of FIG. 31 shows a state immediately before the unsealing member 20 is rotated from the state of (a) of FIG. 31 to unseal the first bonding portion 22*a*. In this embodiment, the first fixing portion 18*a* and the second fixing portion 18*b* are provided. The force during the unsealing is applied to the first fixing portion 18*a* disposed at a place close to the first bonding portion 22*a*, which is first unsealed, spaced from the second bonding portion 22*b* via the openings 35*a*. For that reason, the second fixing portion 18*b* is not required to be taken into consideration in the measuring manners of the distances M1 and M2 (FIGS. 23 and 24) described above. Thus, in the case where are the portion fixing portions, the unsealing is effected on the basis of the fixing portion disposed at the place close to the first bonding portion 22*a*, which is first unsealed, spaced from the second bonding portion 22*b* via the openings 35*a* to which the force during the unsealing is to be applied.

(Positional Relation of Second Bonding Portion)

With reference to FIG. 12 showing a state immediately before the first bonding portion 22*a* is unsealed, an arrangement in which the second bonding portion 22*b* can be more satisfactorily unsealed without being wound up around the unsealing member 20 will be described. First, an end portion of the first bonding portion 22*a* remote from the openings 35*a* is taken as a second point 22*e*. An end portion of the second bonding portion 22*b* remote from the openings 35*a* is taken as a third point 22*f*. A distance from the second point 22*e* to the third point 22*f* is taken as L1. A distance from the second point 22*e* to the power application point portion 20*a* is taken as L2. In this case, the distances L1 and L2 are required to satisfy the relationship of L1<L2.

This is because in the case where L1 is larger than L2, the second bonding portion 22*b* reaches the power application point portion 22*a* before the peeling of the second bonding portion 22*b* is ended, and thus the second bonding portion 22*b* is wound about the unsealing member 20. Therefore, the force cannot be applied so as to peel off the sealing member 19 from the second bonding portion 22*b*. For that reason, it becomes difficult to unseal the sealing member 19 from the developer bag 16.

As described above, the relationship between the distance L1 and L2 is made to satisfy: L1<L2, the sealing member 19 is satisfactorily unsealable without being wound about the unsealing member 20.

(Function of Connecting Portions Defining Openings)

A summary of the connecting portions 35*b*, defining the openings 35*a*, which perform a large function in the unsealing operation of the developer bag 16 will be described.

FIG. 11 is a schematic view of the discharging portion 35 when the peeling at the first bonding portion 22*a* to be first unsealed is ended to expose the openings 35*a*, and shows a state in which the peeling at the second bonding portion 22*b* is not ended. As described above, the discharging portion 35 includes the plurality of openings 35*a* shifted and disposed along the direction (arrow F direction) perpendicular to the unsealing direction (arrow E direction) in which the exposure of the openings 35*a* is advanced. For that reason, also the plurality of connecting portions 35*b* defining the plurality of openings 35*a* are disposed along the arrow F direction. As a result, the plurality of connecting portions 35*b* connect the first bonding portion 22*a* and the second bonding portion 22*b* with respect to the unsealing direction (arrow E direction) of the openings 35*a*. For that reason, at the time of the state of (a) of FIG. 8 in which the unsealing of the first bonding portion 22*a* is ended, the force for unsealing the second bonding portion 22*b* can be received by the first fixing portion 16*d* via the connecting portions 35*b*, so that the force for peeling off the sealing member 19 from the developer bag 16 can be transferred. That is, the forces are applied to the second bonding portion 22*b* in the arrow D direction and the arrow E direction, so that also at the second bonding portion 22*b*, the sealing member 19 is peelable.

A similar effect can be obtained also in cases other than the case where the openings 35*a* are arranged in the direction (arrow F direction) perpendicular to the unsealing direction (arrow E direction) as shown in (b) of FIG. 28 as described above. Even when the openings 35*a* are not completely arranged in the direction perpendicular to the unsealing direction as shown in (c) of FIG. 28, the connecting portions 35*b* can transmit the force, for peeling off the sealing member 19 from the developer bag 16, in an arrow P direction. Further, even when the openings 35 overlap each other with respect to the unsealing direction as shown in (d) of FIG. 28, the connecting portions 35*b* can transmit the force, for obliquely peeling the sealing member 19 from the developer bag 16, in an arrow P direction. That is, the plurality of openings 35*a* may only be required to be shifted and disposed with respect to the direction (arrow F direction) perpendicular to the unsealing direction (arrow E direction).

Further, as shown in (b) of FIG. 28, a portion including the connecting portions 35*b* provided at a periphery of the openings 35*a* may also be used as the bonding portion 22. Also in this case, by the presence of the connecting portions 35*b*, the force can be transmitted until the sealing member 19 is completely peeled off at the bonding portion 22, so that the unsealing is effected with reliability.

As for a relationship between the rotation shaft of the unsealing member 20 and the openings 35*a*, it can be said that the openings 35*a* are shifted and disposed in the direction (arrow F direction) of the rotation shaft of the unsealing member 20. As a result, the connecting portions 35*b* for connecting the first and second bonding portions 22*a* and 22*b* with respect to the direction (arrow E direction) perpendicular to the rotation shaft of the urging member 20. The openings 35*a* may only be required to be shifted and disposed in the rotational axis direction (arrow F direction) of the unsealing member. Even when the openings 35*a* overlap with each other with respect to the rotational axis direction (arrow F direction) as shown in (b) of FIG. 28 and do not overlap with each other completely with respect to the rotational axis direction (arrow F direction) as shown in (d) of FIG. 28, the force can be transmitted in the arrow P direction and thus the effect of the connecting portions 35*b* can be achieved.

Thus, by the presence of the connecting portions 35*b* for connecting the first and second bonding portions 22*a* and 22*b* at the discharging portion 35 of the developer accommodating container 26 accommodating the developer and the developer accommodating container 30 including the unsealing member 20, the unsealing force of the unsealing member 20 can be transmitted until the second bonding portion 22*b* is unsealed, so that the discharging portion 35 can be unsealed with reliability.

A relationship between the openings 35*a* and the portion-to-be-engaged 19*b* of the sealing member 19 will be described (FIG. 3). The portion-to-be-engaged 19*b* is provided in an end side of the sealing member 19 with respect to the direction substantially perpendicular to the direction in which the plurality of openings 35*a* are arranged.

A relationship between the openings 35*a* and the unsealing member 20 will be described (FIG. 3). The unsealing member 20 is provided in an end side of the sealing member 19 with respect to the direction substantially perpendicular to the direction in which the plurality of openings are arranged.

Also in such a constitution, it is possible to obtain the effect of transmitting the unsealing force of the unsealing member 20 by the connecting portions 35*b* until the second bonding portion 22*b* is unsealed.

(Example of Connecting Portions as Separate Member)

The connecting portions 35*b* defining the openings 35*a* may also be provided as a separate member (connecting members 16*f*) as shown in FIG. 21. In this case, a constitution in which a single long opening 16*a* elongated in the direction (arrow F direction) perpendicular to the unsealing direction (arrow E direction) and then the connecting members 16*f* as the separate member connecting both sides of the opening 16*a* along the unsealing direction (arrow E direction) are provided on the opening 16*a* is employed. At this time, the connecting members 16*f* are bonded in each of the first bonding portion 22*a* side and the second bonding portion 22*b* side of the opening 16*a* by adhesive bonding, welding or the like.

Also in the case where the developer bag 16 is provided with the connecting members 16*f*, the sealing member 19 is folded back between the bonding portion 22 and the portion-to-be-engaged 18*b* as described above and is wound around the unsealing member 20, so that the developer bag 16 is unsealable. By employing such a constitution, the connecting portions 35*b* defining the openings 35*a* in the case where the plurality of openings 35*a* are provided, and the connecting members 16*f* perform the same function. That is, the single long opening 16*a* is the same as the plurality of openings 35*a* by providing the connecting members 16*f*.

Therefore, when the sealing member 19 is peeled at the second bonding portion 22*b* after the unsealing of the first bonding portion 22*a* is ended, the force (arrow D direction) during the unsealing of the second bonding portion 22*b* by the unsealing member 20 can be received by the first fixing portion 16*d* via the connecting members 16*f* with respect to the arrow H direction. Thus, the force for peeling the sealing member 19 from the developer bag 16 can be transmitted. That is, the forces are applied to the second bonding portion 22*b* in the arrow D direction and the arrow H direction, so that also the second bonding portion 22*b* is unsealable.

In this way, the single long opening 16*a* is combined with the connecting members 16*f* to form the plurality of openings 35*a*, so that it also becomes possible to strengthen only the connecting members 16*f*.

(Problem of Unsealing Property in Case of No Connecting Portion)

An example in which the present invention is not applied and thus it is difficult to unseal the developer bag 16 will be described. This is the case where there are no connecting portions 36*b* and thus it becomes difficult to unseal the developer bag 16 as shown in FIGS. 13, 14 and 15. Parts (a) and (b) of FIG. 13 show an example in which there are no connecting portions 35*b* and a single long opening 16*a* is provided. Part (a) of FIG. 13 shows a state before the peeling at the second bonding portion 22*b*, and (b) of FIG. 13 and FIG. 15 show a state when the sealing member 19 is peeled at the second bonding portion 22*b*. Parts (a) and (b) of FIG. 8 are enlarged sectional views of the openings 35*a* and their periphery in states before and after the sealing member 19 is peeled at the second bonding portion 22*b* in this embodiment, and (a) to (c) of FIG. 14 are sectional views of the opening 16*a* and its periphery in the case where there are no connecting portions 35*b* and thus it becomes difficult to unseal the developer bag 16.

In this case, a state in which the unsealing is advanced to the second bonding portion 22*b* is shown in (a) of FIG. 14, and from this state, the sealing member 19 is pulled and moved in the arrow D direction by further rotation of the unsealing member 20. Then, since there are no connecting portions 35*b*, the force from the first fixing portion 16*d* cannot be transmitted to the second bonding portion 22*b* side at the central portion of the opening 16*a*. For that reason, as shown in (b) of FIG. 14 and (b) of FIG. 13, a binding force of the fixing portion 18*a* of the frame to the second bonding portion 22*b* is eliminated, so that the opening 16*a* gradually opens largely in the arrow D direction. Further, the second bonding portion 22*b* is pulled by the sealing member 19, so that the opening 16*a* is deformed as shown in (c) of FIG. 14. In this case, a force acting on the second bonding portion 22*b* fails to provide the inclination peeling positional relationship as shown in FIG. 8 and causes the shearing peeling (approximately 0-degree peeling) by the deformation of the opening 16*a* as shown in (c) of FIG. 14, so that there is a need to apply a large force for the peeling. In addition, the supporting force of the first fixing portion 16*d* cannot be transmitted to the second bonding portion 22*b* and therefore the second bonding portion 22*b* is pulled by the unsealing member 20 without causing the peeling of the sealing member 19 therefrom. For that reason, the opening 16*a* in the neighborhood of a longitudinal central portion of the second bonding portion 22*b* further opens largely, so that the second bonding portion 22*b* is wound about the unsealing member 20.

Incidentally, when a developer accommodating member is a rigid structure, there is no such a deformation, so that the sealing member is unsealable as in the conventional example. However, in the case of a constitution in which the developer is accommodated in a soft deformation bag-like member and an opening which is deformed during unsealing is unsealed, as described above, when there are no connecting portions 35*b*, it is difficult to effect the unsealing.

As described above, the sealing member 19 (toner seal) is made unsealable transmitting the driving force to the unsealing member 20 of the image forming apparatus main assembly B and thus there is no need for the user to peel off the toner seal, so that the developing device 38 and the process cartridge A can be simply and easily replaced and used. Further, the sealing member 19 after the unsealing is fixed to the unsealing member 20, so that the unsealing can be effected without demounting a waste material from the process cartridge A.

<Summary of Urging Member and Developer Discharge>

The discharge of the developer by the urging member will be described with reference to the drawings.

(Urging Member)

As shown in (a) to (d) of FIG. 16, the urging member 21 includes a shaft portion 21*a* and an urging sheet 21*b* fixed to the shaft portion 21*a* and is provided rotatably inside the first frame 17 and the second frame 18.

The shaft portion 21*a* performs a function by the same part as the unsealing member 20 (21*a*=20). Therefore, as described above, the driving force is transmitted to the urging member 21 by the unshown driving means of the image forming apparatus main assembly B, so that the urging member 21 (=20) is rotated in the arrow C direction.

The urging sheet 21*b* is fixed on a surface of a rectangular shaft portion 21*a* in cross section and is rotated together with the shaft portion 21*a*. The urging sheet 21*b* is a flexible sheet formed of a material such as PET, PPS (polyphenylene sulfide) or polycarbonate, in a thickness of about 0.05-0.1 mm, and an end thereof projects to the outside of a circumscribed circle of the shaft portion 21*a*. In this embodiment, on different surfaces of the shaft portion 21*a*, the sealing member (first urging member) 19 and the urging sheet (second urging member) 21*b* are fixed but may also be fixed on the same surface of the shaft portion 21*a*.

As shown in FIGS. 16 and 17, the urging sheet 21*b* also performs the function of stirring the developer and feeding the developer toward the developing roller 13 and the developer supplying roller 23.

<Summary of Developer Discharge from Developer Bag>

Next, the discharge of the developer from the developer bag will be described with reference to the drawings.

(Summary of Discharge from Before Unsealing to During Unseal)

First, the discharge of the developer from before the unsealing to the time of start of the unsealing will be described. As described above with reference to FIGS. 7 and 8, the sealing member 19 is pulled toward the power application point portion 20*a* (in the arrow D direction), and the developer bag 16 is supported by the fixing portion 18*c*. For that reason, during unsealing, three places consisting of the power application point portion 20*a*, the fixing portion 18*c* of the frame and the place of the bonding portion where the sealing member 19 is peeled and moved in a direction in which these three places are aligned in a rectilinear line in a cross section perpendicular to the rotation shaft of the unsealing member 20. Thus, the position of the openings 35*a* is changed between the time before the unsealing member 20 applies the force to the sealing member 19 to perform the unsealing operation and the time when the unsealing operation is started to unseal the first bonding portion 22*a*, so that stagnation of the developer in the neighborhood of the openings 35*a* can be prevented and thus a discharging property is good.

(Summary of Discharge after Unsealing/During Urging)

When the sealing member 19 is unsealed from the above-described developer bag 16 as shown in (b) of FIG. 8, the openings 35*a* are disposed to open at a lower portion of the developer bag 16 and therefore the developer in the neighborhood of the openings 35*a* is discharged by the action of gravitation and vibration or the like of the developer bag 16 during the unsealing.

After the unsealing, when the unsealing member 20 is further rotated, also the urging sheet 21*b* for urging the developer bag 16 fixed to the unsealing member 20 is rotated, so that the distance 21*b* is wound about the unsealing member 20 by the developer bag 16 as shown in FIG. 9. As shown in FIG. 16, the urging sheet 21*b* has elasticity and therefore is likely to be restored to an original shape, thus urging the developer bag 16 in an arrow J direction. At this time, the developer bag 16 is urged by the urging sheet 21*b* and is pressed against the second frame 18 via the toner, so that the entire developer bag 16 is deformed. The developer bag 16 is urged by the urging sheet 21*b* to be decreased in its inside volume. Thus, by the decrease in inside volume of and the change in entire shape of the developer bag 16, the developer inside the developer bag 16 is stirred and as a result, the developer is readily discharged from the openings 35*a*. At this time, the developer bag 16 is closed except for the openings 35*a* and thus there is no escape route except for the openings 35*a*, and therefore the discharging property from the openings 35*a* is high. By the discharging action as described above, the developer is readily discharged in the arrow I direction.

In the case, when the developer bag 16 is contacted to and pressed against the second frame 18 at least at a part thereof, the developer bag 16 is deformable.

By aligning the rotational axis direction of the developing roller 13 and the arrangement direction (arrow F direction) of the plurality of openings 35*a*, the developer can be easily supplied over the entire longitudinal direction of the developing roller 13 during the discharge without being localized.

When the developing device 38 is mounted in the image forming apparatus main assembly B, by providing the openings 35*a* so as to open toward the direction of gravitation, the developer discharging property can be improved.

Further, the urging sheet 21 provided in the frames 17 and 18 urges the flexible container 16 so as to be pressed against the frame 18, so that the developer discharging property can be improved.

(Summary of Discharge/Developer Bag Shape Restoration)

As shown in FIG. 17, the unsealing member 20 is further rotated, so that the urging sheet 21*b* is separated from the developer bag 16. At this time, the developer bag 16 has flexibility and therefore is likely to be restored to the state before the urging by the weight of the developer (arrow K direction). Then, also the urging sheet 21*b* is rotated and urges the developer bag 16 toward the second frame 18 as shown in FIG. 16, so that the developer bag 16 is deformed to move the developer at a position other than the neighborhood of the openings 35*a* and thus the developer is discharged from the openings 35*a*.

(Summary of Discharge/Repetition of Urging and Restoration)

In the case where the developer immediately after the unsealing is accommodated in the developer bag 16 in a large amount, a penetration depth (entering amount) of the urging sheet 21*b* and the unsealing member 20 with respect to the flexible container 16 is repetitively changed, so that the developer bag 16 is deformed so as to be pressed against the second frame 18. Contraction of the developer bag 16 by the urging with the urging member 21 and restoration of the shape of the developer bag 16 by the weight of the developer inside the developer bag 16 and by the flexibility of the developer bag 16 are repeated. Further, by the above-described action, the developer bag 16 itself is moved and therefore the developer bag 16 is vibrated, so that the developer inside the developer bag 16 is discharged from the openings 35*a* also by the vibration of the developer bag 16. The urging member 21 is rotated and therefore is capable of repetitively urging the developer bag 16.

(Example in which Developer Bag is Applied to Frame)

A portion 27 where the developer bag 16 is urged against the second frame 18 is as shown in FIG. 25, even in the case where a bonding portion 28 such as an adhesive or a double-side tape is provided and bonds the developer bag 16 to the second frame 18, the urging sheet 21*b* can urge the developer bag 16 to discharge the developer.

(Case where Amount of Developer is Small)

The case where the amount of the developer inside the developer bag 16 is decreased by image formation will be described with reference to (a) and (b) of FIG. 32. Immediately after the unsealing, as shown in (a) of FIG. 32, the shape of the developer bag 16 follows a shape, defined by the urging member 21, in such a manner that the developer bag 16 always contacts the urging member 21 by the weight of the accommodated developer, so that a size (inside volume) is periodically changed. However, when the amount of the accommodated developer becomes small, as shown in (b) of FIG. 32, the weight of the developer becomes light, so that the developer bag 16 does not follow the urging member 21 and thus repeats periodical separation from and contact with the urging member 21. For that reason, the size (inside volume) of the developer bag 16 is not so changed. For that reason, a developer discharging effect by the change in inside volume of the developer bag 16 is decreased but by the periodical contact between the developer bag 16 and the urging member 21, the developer bag 16 is vibrated and thus the developer can be discharged.

(Combined Use as Urging Sheet and Sealing Member)

A single part may be used as the urging sheet 21*b* and the sealing member 19 to have functions of these members. After the unsealing, the bonding portion 22 is separated from the developer bag 16 and therefore an end of the sealing member 19 in the bonding portion 22 side is a free end. For this reason, the sealing member 19 can have the function of the urging sheet 21*b*. Thus, the unsealing member 20 can have the function of the shaft portion 21*a* of the urging member 21, and the sealing member 19 can have the function of the urging sheet 21*b*. As a result, it is possible to reduce the number of parts and thus cost reduction can be realized.

As described above, the developer inside the developer bag 16 can be satisfactorily discharged without providing another discharging part such as a developer discharging roller at the openings 35*a* as a developer discharging port, so that agglomeration and bridge of the developer in the neighborhood of the openings 35*a* can be prevented. As a result, even in the case where the developer in the developer bag 16 is agglomerated by tapping during transportation, storage or the like, the agglomerated developer is broken by the movement of the entire developer bag 16 and the periphery of the openings 35*a* as described above, so that it is possible to prevent a state in which it is difficult to discharge the developer.

(Example of Single Part for Urging Member)

The urging member 21 is not constituted by separate parts consisting of the shaft portion 21*a* and the urging sheet 21*b* but may also be constituted by a single part, as shown in (a) of FIG. 26, prepared by providing the urging member 21 integrally with a projection 21*e* functioning as the urging sheet 21*b*. Also in this case, similarly, the developer can be discharged. In the case where the urging member 21 is constituted by only the shaft portion 21*a*, the developer bag 16 can be pressed against a frame 29 to be deformed even in the case where the cross section of the shaft portion 21*a* (urging member 21) has a polygonal shape ((b) of FIG. 26) or has a cam shape ((c) of FIG. 26) when the urging member 21 is viewed in its cross section perpendicular to its rotation center. This is because when the urging member 21 is disposed so as to contact at least the developer bag 16, a distance from the rotation center of the urging member 21 to the outer end of the urging member is changed and therefore the penetration depth of the urging member 21 with respect to the developer bag 16 is also changed. That is, so long as the shaft portion (urging member) is not a shaft portion having a circular cross section including the rotation shaft as its center, the developer bag 16 can be deformed by the rotation of the urging member 21. As shown in (a) of FIG. 26, a distance 21*c* from the center of the urging member 21 to a remote outer end of the urging member 21 and a distance 21*d* from the center of the urging member 21 to a close outer end of the urging member 21 are different from each other and therefore the penetration depth of the urging member 21 with respect to the developer bag 16 is also changed.

Part (b) of FIG. 33 is a sectional view of an urging member 21 having a cross-shape in cross section, and (a) of FIG. 33 is a cross-sectional illustration of the developer accommodating unit 25 including the cross-shaped urging member 21. As shown in FIG. 33, in the case where four projections 21*e* each having the same distance from the center of the urging member 21 to an associated outer end are provided, outer configurations (distance 21*c*) of the four projections 21*e* are the same. However, the urging member 21 includes a portion, other than the projections 21*e*, having an outer end (distance 21*d*) close to the center and therefore the penetration depth with respect to the developer bag 16 can be changed. That is, the urging member 21 can be constituted as a rotatable member including portions different in distance from its rotation center to its outer end in the cross section perpendicular to the rotation center of the urging member 21.

Thus, the developer bag 16 is unsealed by the urging member 21 (in the arrow J direction) to be pressed against the frame 29, thus being deformed to decrease its inside volume, so that the inside developer is pushed out to be discharged from the openings 35*a* (arrow I direction).

In an attitude during the image formation, the shaft portion 21*a* (=20) of the urging member 21 is positioned under the developer bag 16 in contact with the developer bag 16 with respect to the direction of gravitation. The cross-sectional shape of the shaft portion 21*a* (=20) of the urging member 21 is rectangular not is not circular and therefore by the rotation of the shaft portion 21*a* (=20), the penetration depth of the shaft portion 21*a* (=20) with respect to the developer bag 16 is periodically changed as described above. Also by the change in penetration depth of the shaft portion 21*a* (=20) with respect to the developer bag 16, the developer bag 16 can be changed in volume and can be vibrated, so that the developer discharging property can be improved.

<Summary of Positional Relationship Between Unsealing Member and Developer Carrying Member>

A positional relationship among the rotation shaft of the unsealing member 20, the sealing member 19 and the developer supplying roller 23 will be described. As shown in (c) of FIG. 36, a distance from the shaft center as the rotation center of the unsealing member 20 to the closest point on the surface of the developer supplying roller 23 is defined as X, and a maximum length from the shaft center of the unsealing member 20 to the free end of the sealing member 19 when the sealing member 19 is unsealed is defined as T. The positional relationship will be described specifically below.

The sealing member 19 is the flexible sheet (first urging member) having elasticity and therefore is likely to be restored to the original sheet state even after being unsealed. Therefore, as shown in (b) of FIG. 36, in the case where a relationship between the distance X and the length T satisfy: $X<T$, when the unsealing member 20 is rotated, the developer supplying roller 23 and the sealing member 19 contact each other every time when the free end of the sealing member 19 approaches the developer supplying roller 23. In this case, a coating state of the developer on the developer supplying roller 23 is disturbed by the contact of the sealing member 19 with the developer supplying roller 23, so that the disturbed portion is recognized as image non-uniformity when the image is outputted by the image forming apparatus.

Therefore, in this embodiment, as shown in (a) of FIG. 36, a shielding member 42 is provided between the developer supplying roller 23 as the developer carrying member (developer feeding member) and the rotation shaft (shaft portion) of the unsealing member 20. As a result, every time when the sealing member 19 approaches the developer supplying roller 23, the free end of the sealing member 19 is bent and curved by the shielding member 42, so that the contact between the developer supplying roller 23 and the sealing member 19 can be prevented.

In this embodiment, as the urging member 21, a 0.05 mm-thick flexible PPS sheet is used and is provided under a setting condition such that the urging member 21 does not contact the shielding member 42. As shown in FIG. 40, in the case where the unsealing member 19 is used also as the urging member 21, the urging member 21 is not present, so that its constitution is the same as that in this embodiment.

<Summary of Structure of Shielding Member>

The shielding member 42 provided in this embodiment is of a rib-shaped type as shown in (a) of FIG. 37. The developer accommodating unit 25 used in this embodiment has a longitudinal width of 240 mm. The shielding member 42 is a cylinder (cylindrical shielding member) of 2 mm in diameter and 15 mm in widthwise height, and a plurality of shielding members 42 (5 shielding members in this embodiment) are disposed at an interval of 40 mm with respect to a longitudinal direction. That is, the shielding member in this embodiment is configured so that the plurality of shielding members 42 for preventing contact of the sealing member 19 with the developer supplying roller 23 are provided at predetermined intervals to permit passing of the developer. Further, as shown in (a) of FIG. 37, the shielding members 42 are disposed to be present on a tangential line M, of the developer supplying roller 23, extending to the rotational axis center of the sealing member 19. When the sealing member 19 contacts the shielding member 42, the sealing member 19 is bent, so that the contact between the developer supplying roller 23 and the sealing member 19 can be prevented.

However, there is no shielding member 42 between the rotation shaft of the unsealing member 20 and the developer supplying roller 23, i.e., also by the presence of the shielding member in the neighborhood thereof, it is possible to prevent contact of the sealing member 19 with the developer supplying roller 23. First, as shown in (a) of FIG. 38, the sealing member 19 is bent by a shielding member 42*a* present upstream of the rotational direction. Then, as shown in (b) of FIG. 38, during the contact between the shielding member 42*a* and the free end of the sealing member 19, a shielding member 42*b* present downstream of the rotational direction and a part of the sealing member 19 contact and thus a locus of the ends of the sealing member 19 is changed, so that it is possible to prevent the contact between the developer supplying roller 23 and the sealing member 19. The shielding member 42*a* and the shielding member 42*b* are of the rib-shaped type similarly as in the constitution of the shielding member 42 described with reference to (a) of FIG. 37.

Further, (c) and (d) of FIG. 38 show a constitution in which only the shielding member 42*a* present upstream of the rotational direction is provided. In this constitution, first, as shown in (c) of FIG. 38, a part of the sealing member 19 contacts the shielding member 42*a* to start bending and thereafter as shown in (d) of FIG. 38, the free end of the sealing member 19 is to be separated from the shielding member 42*a*. At this time, the locus of the end of the sealing member 19 is changed, so that the contact between the developer supplying roller 23 and the sealing member 19 can be prevented.

Incidentally, when a spacing between the shielding member 42 and the developer supplying roller 23 is narrow and the shielding members (ribs) are small in the number thereof and are excessively wide in interval therebetween with respect to the longitudinal direction, at the time of the contact of the sealing member with the shielding member, the shielding member is bent at an intermediate position between the ribs in some cases. In this case, the developer supplying roller 23 and the sealing member 19 contact, so that there is possibility that a shielding effect (contact preventing effect) is not achieved. Therefore, when the developer accommodating unit 25 is intended to be downsized, there is need to pay attention also to setting conditions such as a widthwise disposition interval between the developer supplying roller 23 and the shielding member 42, the number of ribs disposed with respect to the longitudinal direction of the shielding member 42, a longitudinal interval of the ribs, and the like. Further, in this embodiment, there is a need to feed the developer to the neighborhood of the developer supplying roller 23 and therefore the shielding member 42 prevents the passing of the sealing member 19 but positively permits the passing of the developer.

The shape of the shielding member 42 may also be a rod shape in parallel to the rotation shaft of the unsealing member 20 as shown in (b) of FIG. 37. Specifically, a plurality (three in this embodiment) of rod-like shielding members 42 of 240 mm in longitudinal width and 2 mm in diameter are provided, so that the contact between the developer supplying roller 23 and the sealing member 19 can be prevented. Similarly as in the case of the rib shape of the shielding member shown in (a) of FIG. 37, as shown in (b) of FIG. 37, the shielding member 42 is disposed to be present on a tangential line member, of the developer supplying roller 23, extending to the rotational axis center of the sealing member 19.

However, when the effect of preventing the contact between the sealing member 19 and the developer supplying roller 23 is obtained, the position of the shielding member 42 is not limited to the position between the rotation center of the sealing member 19 and the surface of the developer supplying roller 23, and there is no problem when the shielding member may also be disposed in the neighborhood of the position similarly as in the cases of (a) and (b) of FIG. 38.

As a comparative example, in the case where the distance X and the length T satisfy X>T as shown in (c) of FIG. 36, even in the case where the end of the sealing member approaches the neighborhood of the developer supplying roller 23, both members do not contact each other. In this case, the disposing position of the rotation shaft of the unsealing member 20 is spaced apart from the developer supplying roller 23, so that a large space is provided between the unsealing member 20 and the developer supplying roller 23. That is, a position where the developer bag can be disposed is influenced by the position of the unsealing member 20 and therefore a dead space where the developer bag 16 cannot be disposed is formed in the developing device, so that there is a tendency that a developer filling rate in the developer accommodating unit is lowered.

On the other hand, in this embodiment, in the constitution in which the sealing member 19 can contact the developer supplying roller 23 due to downsizing or the like of the developing device, the shielding member 42 is provided between the developer supplying roller 23 and the unsealing member 20. As a result, it is possible to prevent the contact between the developer supplying roller 23 and the sealing member 19. Further, in the case where the sealing member contacts both of the developing roller 13 and the developer supplying roller 23, by providing the shielding member 42 both between the rotation shaft of the unsealing member 20 and the developing roller 13 and between the rotation shaft of the unsealing member 20 and the developer supplying roller 23, it is possible to prevent contact of the sealing member 19 with both of the developing roller 13 and the developer supplying roller 23.

As described above, only by pulling the sealing member 19 in the rotational axis direction (arrow C direction in FIG. 4) of the sealing member, the unsealing can be effected, so that the developer bag 16 can be stably unsealed with reliability. Further, the unsealing can be effected by pulling the sealing member 19 in the widthwise direction of the process cartridge A and therefore a peeling distance which was about two times the longitudinal length of the conventional process cartridge can be remarkably shortened. The sealing member 19 after the unsealing is fixed to the unsealing member 20 and therefore the unsealing can be effected without taking out the waste material from the process cartridge. Further, the discharged of the developer from the inside of the developer bag 16 can be effected with reliability by the urging member 21. Further, the sealing member 19 can move together with the unsealing member 20 and therefore the toner stirring effect in the process cartridge can be expected. Further, the process cartridge free from causing the image defect resulting from the contact between the sealing member 19 as the urging member and the developer supplying roller 23 (developing roller 13) as the developer carrying member can be provided to the user without upsizing the developer accommodating unit.

[Second Embodiment]

Next, the case where the urging sheet 21*b* as a second urging member is in a positional relationship of contact with the shielding member 42 will be described. In this embodiment, in order to downsize the process cartridge while ensuring the developer supply, the positional relationship such that the urging sheet 21*b* contacts the shielding member 42 is established. Incidentally, in the positional relationship, the urging sheet 21*b* does not contact the developing roller 13 and the developer supplying roller 23. That is, when a length from the rotation center of the urging sheet 21*b* to the free end of the urging sheet 21*b* is defined as Y, the length Y of the urging sheet 21*b* is constituted to be shorter than the length T of the sealing member and satisfy a relationship of X>Y with the distance X.

The urging sheet 21*b* provided on the unsealing member 20 separately from the sealing member 19 as shown in FIG. 16 also has the function of stirring the developer by its rotation to feed the developer toward the developing roller 13 and the developer supplying roller 23 and the function of uniformizing localization of the developer by impact or the like. For that reason, the urging sheet 21*b* requires a length in which the developer in the first frame 17 and the second frame 18 can be sufficiently stirred and therefore has a positional relationship of contact with the shielding member 42. Further, as the urging sheet 21*b* in this embodiment, in order to sufficiently exhibit the stirring property, a 0.05 mm-thick flexible PPS sheet having rigidity is used. For that reason, when the urging sheet 21*b* starts contact with the shielding member 42 with the rotation thereof, the shielding member 42 starts bending. When the urging sheet 21*b* is further rotated, the bent shielding member 42 is released at a stretch. At this time, flick sound is generated and is recognized as noise during operation.

In order to avoid the noise, the shielding member 42 is, as shown in (b) of FIG. 16, provided with a cut-away portion 43 in its free end side at a position where it contacts the shielding member 42. The cut-away portion 43 is provided so that the urging sheet 21*b* does not contact the shielding member 42. As a result, even in the case where the urging sheet 21*b* and the shielding member 42 are in the positional relationship of contact therebetween, it becomes possible to suppress the generation of the noise while maintaining the developer stirring effect. By using the constitution in this embodiment, there is no need to establish a non-contact positional relationship between the urging sheet 21*b* and the shielding member 42 in order to avoid the generation of the noise and therefore a downsized process cartridge and a downsized developer accommodating unit can be provided to the user. Incidentally, when the generation of the noise can be allowed to some extent, a cut-away portion 43 shown in (c) of FIG. 16 or a cut-in portion 44 shown in (d) of FIG. 16 are provided to the urging sheet 21*b*, so that the developer stirring property can be further improved while suppressing the generation of the noise.

In this embodiment, the constitution including, as the developer carrying member, the developing roller (developer carrying member) and the developer supplying roller 23 (developer feeding member) is exemplified but the present invention is not limited thereto. For example, a constitution in which the developer supplying roller is not provided but only the developing roller is provided as the developer carrying member may also be employed. Further, the developing device including the flexible container for accommodating the developer and the urging member for urging the flexible container is exemplified but the present invention is not limited thereto. For example, a developing device which does not include the flexible container but includes a developer feeding member for feeding the accommodated developer may also be used. Also by such constitution, a similar effect can be obtained.

[Third Embodiment]

In the developing devices in First and Second Embodiments, the case where the non-magnetic toner is used and the developer supplying roller 23 is needed as the developer carrying member was principally described. In this embodiment, the case where the developer supplying roller 23 is not needed by providing a magnet roller (not shown), as the developer carrying member, inside the developing roller to effect developer feeding using a magnetic force will be described. Further, also the case where the developer is the non-magnetic toner but the developer supplying roller 23 is not needed is similarly included in this embodiment.

As shown in (b) of FIG. 39, a distance from the shaft center of the unsealing member 20 to the closest point on the surface of the developing roller 13 is defined as X and this embodiment will be described specifically below. Further, similarly as in the case of (c) of FIG. 36, the maximum length from the shaft center of the unsealing member 20 to the free end of the sealing member 19 after the unsealing is taken as T.

In this embodiment, as shown in (a) of FIG. 39, the shielding member 42 is provided between the developing roller 13 and unsealing member 20. However, when the effect of preventing the contact between the sealing member 19 and the developing roller 13 is obtained, the position of the shielding member 42 is not limited thereto, and there is no problem when the position is located between the rotation shaft of the unsealing member 20 and the surface of the developing roller 13 or the neighborhood of these members.

As the urging member 21 in this embodiment, a 0.05 mm-thick flexible PPS sheet is used and is disposed under a setting condition of non-contact with the shielding member 42. Further, in the case where the sealing member 19 is used also as the urging member 21, there is no urging member and therefore its constitution is similar to that in this embodiment.

As shown in (b) of FIG. 39, in the case where a relationship between the distance X and the length T satisfy: X<T, when the unsealing member 20 is rotated, the developing roller 13 and the sealing member 19 contact each other every time when the free end of the sealing member 19 approaches the developing roller 13. In this case, a coating state of the developer on the developing roller 13 is disturbed by the contact of the sealing member 19 with the developer supplying roller 23, so that the disturbed portion is recognized as image nonuniformity, when the image is outputted by the image forming apparatus. Therefore, as shown in (b) of FIG. 39, by providing the shielding member 42, it becomes possible to downsize the process cartridge while preventing contact between the developing roller 13 and the sealing member 19. In this case, every time when the sealing member 19 approaches the developing roller 13, the free end of the sealing member 19 is bent and curved by the shielding member 42 and is configured to is be in non-contact with the developing roller 13.

Further, the shielding member 42 is constituted to prevent the passing of the sealing member 19 but is constituted to positively permit the passing of the developer similarly as First and Second Embodiments.

[Fourth Embodiment]

As shown in FIGS. 18 and 19 and (c) of FIG. 29, in this embodiment, a developer accommodating member 34 is used in place of the developer bag 16 in First to Third Embodiments. The constitution and effect of the shielding member 42 are the same as those in First to Third Embodiments and will be omitted from detailed description.

(Vacuum Molding)

Details of the developer accommodating member 34 will be described. The developer accommodating member 34 is formed by shaping a sheet-like material by vacuum molding, air-pressure molding and press molding, and is used. The developer accommodating container 30 including the unsealing member includes, similarly as in First Embodiment, the developer accommodating member 34, the sealing member 19, the unsealing member 20, the first frame 17 and the second frame 18. Incidentally, the unsealing member 20 is a member having the function of the urging member 21 and the developer stirring function similarly as in First Embodiment.

(Structure of Developer Bag)

As shown in FIG. 18 and (c) of FIG. 29, the developer accommodating member 34 is constituted by a molded portion 34*a* which is a flexible container formed by the vacuum molding, the air-pressure molding and the press molding and constituted by a sheet-like air permeable portion 34*b*. The molded portion 34*a* and the air permeable portion 34*b* are bonded by (heat) welding, laser welding, adhesive bonding, adhesive tape bonding or the like. The reason why an air permeability is imparted to the developer accommodating member 34 is that the developer accommodating member 34 meets states during manufacturing, during transportation and during storage similarly as in First Embodiment.

As the material for the molded portion 34*a*, materials such as ABS, PMMA, PC, PP, PE, HIPS, PET, PVC and composite multi-layer materials of these materials may preferably be used. The thickness of the molded portion 34*a* in the sheet shape before the molding may preferably be about 0.1-1 mm. The material and thickness of the molded portion 34*a* may appropriately selected depending on cost, product specification, manufacturing condition, and the like.

The molded portion 34*a* is bonded to the air permeable portion 34*b* at an outer peripheral portion 34*c* of the molded portion 34*a*. The developer accommodating member 34 accommodates the developer therein. Further, at a part of the outer peripheral portion 34*c*, a fixing portion 16*d* (portion-to-be-fixed) of the developer accommodating member 34 is provided. The shape of the molded portion 34*a* follows the inside shape of the frames 17 and 18 (FIG. 19).

The developer accommodating container 26 in which the developer is accommodated is constituted by the developer accommodating member 34 and the sealing member 19 for unsealably covering the discharging portion 35 of the developer accommodating member 34 to seal the toner inside the developer accommodating member 34.

The developer accommodating container 30 including the unsealing member is constituted by the unsealing member 20 for unsealing the sealing member 19 from the developer accommodating member 34 and the developer accommodating container 26 in which the developer is accommodated.

The developing device 38 is constituted by the developer accommodating container 30 including the unsealing member, the developing roller 13 as the developing means, the developing blade 15, and the first frame 17 and the second frame 18 which support these members.

The discharging portion 35 is provided at the molded portion 34*a*. Also a constitution of this discharging portion 35 is the same as that in First Embodiment, and a plurality of openings 35*a* and a plurality of connecting portions 35*b* for defining the plurality of openings 35*a* are provided with respect to the direction (arrow F direction) substantially perpendicular to the unsealing direction (arrow E direction) in which the unsealing of the developer accommodating member 34 is advanced. That is, the plurality of openings 35*a* are shifted and disposed with respect to the direction (arrow F direction) perpendicular to the unsealing direction (arrow E direction). Further, the plurality of openings 35*a* are shifted and disposed with respect to the direction of the rotation shaft of the unsealing member 20. Further, the portion-to-be-engaged 19*b* is provided in an end side of the sealing member 19 with respect to the direction substantially perpendicular to the direction in which the plurality of openings 35*a* are arranged. Further, the unsealing member 20 is provided in the end side of the sealing member 19 with respect to the direction substantially perpendicular to the direction in which the plurality of openings 35*a* are arranged. The fixing portion includes a fixing portion 16*d*, necessary for the unsealing, corresponding to the first fixing portion 16*d* in First Embodiment. When the shape of the developer accommodating member 34 itself is intended to be maintained by the molded portion 34*a*, the developer accommodating member 34 has the shape following the frame and therefore the developer accommodating member 34 is supported by the frame as a whole, so that the developer accommodating member 34 is not readily moved toward the developer supplying roller 23 and the developing roller 13.

As a means for fixing the fixing portion, it is possible to use the (heat) welding, the ultrasonic welding, the adhesive bonding, the insertion between the frames, the heat clamping, the ultrasonic clamping, the hooking using the hole and the projection, and the like.

The constitutions of the sealing member 19 and the unsealing member 20 are the same as those in First Embodiment.

<Summary of Unsealing of Developer Bag>

The unsealing of the developer bag will be described. The fixing portion and the position thereof are the substantially same as those in First Embodiment, and also the force relationship is the same as that in First Embodiment. Therefore, also the unsealing step is the same as that in First Embodiment (FIGS. 7 and 8).

In Second Embodiment, the openings 35*a* are disposed at the molded portion 34*a* but also the molded portion 34*a* is flexible similarly as in First Embodiment, so that also the force relationship is the same as that in First Embodiment. Therefore, also in Second Embodiment, the plurality of connecting portions 35*b* connects the first bonding portion 22*a* and the second bonding portion 22*b* with respect to the direction (arrow E direction) in which the unsealing is advanced. For that reason, when the unsealing of the first bonding portion 22*a* is ended and the second bonding portion 22*b* is unsealed, a force for peeling the sealing member 19 from the developer accommodating member 34 can be transmitted. For that reason, the unsealing also at the bonding portion 22*b* becomes possible.

Also the developer discharging port after the unsealing is the same as that in First Embodiment. When the sealing member 19 is unsealed from the above-described developer accommodating member 34, first, the openings 35*a* are disposed at the lower portion of the developer accommodating member 34, and therefore the position of the openings 35*a* during the unsealing is moved at the same time when the gravitation acts on the openings 35*a*, so that the developer is discharged. Further, by the vibration or the like of the developer accommodating member 34, the developer in the neighborhood of the openings 35*a* is discharged. The unsealing member 20 also functions as the urging member 21. Further, the urging member 21 has a rectangular shape in the cross section perpendicular to the rotational axis direction of the urging member 21, and the discharge of the developer is accelerated by the rotation of the urging member 21 as described in First Embodiment (FIG. 20). The urging member 21 contacts a surface 34*f* which is the same surface as the surface where the openings 35*a* of the developer accommodating member 34 are provided. The developer accommodating member 34 is constituted by a plurality of surfaces including the surface where the openings 35*a* of the developer accommodating member 34 are provided and another surface connected to the surface via a bent portion 34*d*.

By employing such a constitution, in addition to the effect in First Embodiment, the following effects are achieved.

(Effect of Vacuum Molding)

By forming a part of the developer accommodating member 34 through the vacuum molding, the following effects are obtained.

As a first effect, the developer accommodating member 34 can be shaped so as to follow the inside shape of the frame. For that reason, in the bag form as described in First Embodiment, it is difficult to dispose the bag until corner portions of the frame, so that a space (spacing) is formed between the developer bag and the first frame 17 and thus fails to constitute an effective developer accommodating space.

As a second effect, the developer accommodating member 34 can be shaped so as to follow the shape of the frame and therefore can be easily assembled with the frame. This is because there is no need to push the developer accommodating member into the frame during the assembling so that its shape follows the shape of the frame.

As a third effect, the developer accommodating member 34 is not readily moved toward the developer supplying roller 23 and the developing roller 13. This is because the developer accommodating member 34 is supported by the frame as a whole since the shape of the developer accommodating member 34 itself is maintained as described above by the vacuum molding and follows the shape of the frame. For that reason, the second fixing portion for preventing the movement of the developer bag toward the developer supplying roller 23 and the developing roller 13 as described in First Embodiment can be omitted.

Further, as shown in FIG. 19, an effect of pushing the surface 34 which is the same surface as the surface where the openings 35*a* are provided is as follows. The developer accommodating member 34 is constituted by the plurality of surfaces by the vacuum molding. Therefore, the bent portion 34*d* is present between the surfaces of the portion surfaces. The surfaces of the developer accommodating member 34 are defined by bent portions. A difference in effect between the case where the surface 34*f* including the openings 35*a* is urged and the case where a surface 35*e* which does not include the openings 35*a* is urged will be described. The surface 34*e* is connected to the surface 34*f* including the opening 35*a* by the bent portion 34*d*. A force received by the surface 34*e* is transmitted via the bent portion 34*d*. The force is largely attenuated at the bent portion 34*d* before it reaches the surface 34*f* including the openings 35*a*. For that reason, also a force for moving the openings 35*a* becomes small compared with the case where the surface 34*f* including the openings 35*a* is urged directly. For that reason, the action of discharging the developer by moving the openings 35*a* becomes small. Therefore, when the urging member 21 urges the surface 34*f* including the openings 35*a*, the urging member 21 can efficiently improve the discharging property of the inside developer and can prevent stagnation of the developer.

Thus, by the rotation of the urging member 21 of which function is performed by the unsealing member 20, the developer accommodating member 34 is urged so as to be pressed against the second frame 18, so that the developer accommodating member 34 is deformed to change the position of the openings 35 and thus the inside developer is discharged. Further, there are the plurality of openings 35*a* and therefore the developer is readily discharged more than the case of a single opening. Further, the openings 35*a* are disposed downward with respect to the direction of gravitation in the attitude during the image formation and therefore the developer is easily discharged.

[Fifth Embodiment]

As shown in FIG. 35, in this embodiment, different from First to Fourth Embodiments, the case where the developer bag 16 and the developer accommodating member 34 as the flexible container are not disposed in the developer accommodating unit will be described. That is, in this embodiment, the case of a developing device in which the flexible container accommodating the developer is not provided but only the developer accommodating container as the frame for accommodating the developer is provided will be described.

In the developing device in this embodiment, an elastic developer feeding member 41 which is rotatably provided inside the developer accommodating container and which is rotated to feed the developer, and the developing roller 13 as the developer carrying member for carrying and feeding the developer on its surface are provided.

A positional relationship among the developer feeding member 41 and the developing roller (developer carrying member portion) 13 as the developer carrying member will be described. As shown in (c) of FIG. 35, a distance from the rotation center of the developer feeding member 41 to the closest point on the surface of the developing roller 13 is defined as Z, and a maximum length from the rotation center of the developer feeding member 41 to the free end of the developer feeding member 41 is defined as T. The positional relationship will be described specifically below.

In a general process cartridge, as shown in (a) of FIG. 35, the developer accommodated in the developer accommodating container as the frame is fed to the neighborhood of the developing roller 13 by the developer feeding member 41 using a flexible sheet. In order to downsize the process cartridge, as shown in (b) of FIG. 35, in the case of a positional relationship of contact between the developer feeding member 41 and the developing roller 13 (in the case where a relationship between the distance Z and the length T satisfy: $Z<T$), the developing roller 13 and the developer feeding member 41 contact each other every time when the free end of the developer feeding member 41 approaches the developing roller 13. In this case, a coating state of the developer on the developing roller 13 is disturbed by the contact of the developer feeding member 41 with the developing roller 13, so that the disturbed portion is recognized as image non-uniformity when the image is outputted by the image forming apparatus.

Therefore, in this embodiment, as shown in (d) of FIG. 35, a shielding member 42 for preventing the contact between the developer feeding member 41 and the developing roller 13 is provided between the rotation center of the developer feeding member 41 and the surface of the developing roller 13 (or the neighborhood of these members). As a result, it becomes possible to downsize the process cartridge while preventing contact between the developing roller 13 and the developer feeding member 41. In the case where the shielding member 42 is present between the developing roller 13 and a rotation shaft 40 of the developer feeding member 41, every time when the developer feeding member 41 approaches the developing roller 13, the free end of the developer feeding member 41 is bent and curved by the shielding member 42 and is configured to be in non-contact with the developing roller 13.

Further, the shielding member 42 is constituted to prevent the passing of the developer feeding member 41 but is constituted to positively permit the passing of the developer similarly as First to Fourth Embodiments. Further, the case where as the developer carrying member, the developer supplying roller (developer feeding member) 23 is present in addition to the developing roller (developer carrying member portion) 13 is shown in (e) of FIG. 35. As shown in (e) of FIG. 35, also in the case where the developer supplying roller 23 is present, by the presence of the shielding member 42 between the developer supplying roller 23 and the rotation shaft of the developer feeding member 41, it is possible to prevent contact between these members. Incidentally, also in a constitution shown in (e) of FIG. 35, similarly as in the case of the developing roller 13, a distance from the rotation center of the developer feeding member 41 to the closest point on the surface of the developer supplying roller 23 is defined as Z, and a maximum length from the rotation center of the developer feeding member 41 to the free end of the developer feeding member 41 is defined as T.

[Sixth Embodiment]

In this embodiment, a diffusing means of the developer discharged from a developer bag 16 will be described. In the following, a "longitudinal" means a longitudinal direction of the developer accommodating unit 25 unless otherwise specified. Similarly, a "width" means a length of the 35*a*, the connecting portion 35*b* and the like with respect to the longitudinal direction unless otherwise specified. Further, a downstream-side longitudinal position of each of the opening 35*a* and the connecting portion 35*b* with respect to a developer discharging direction (arrow I direction) is referred to as an "immediately downstream (below) (position)" of each of the opening 35*a* and the connecting portion 35*b*.

As shown in FIG. 41, the discharging portion 35 includes a plurality of openings 35*a* along the longitudinal direction (arrow F direction), and the connecting portion 35*b* is present between adjacent two openings 35*a*. The developer in the developer bag 16 is discharged through the openings 35*a* and therefore non-uniformity of a developer supply (free end) amount is locally generated between an immediately downstream position of the opening 35*a* and an immediately downstream position of the connecting portion 35*b*. For this reason, immediately after the developer bag 16 is unsealed, the amount of the developer supplied to a portion, corresponding to the immediately downstream position of the connecting portion 35*b*, of the developing roller 13 becomes locally insufficient, so that there is a possibility that a vertical band-like white dropout image is generated.

The nonuniformity of the developer supply is alleviated by shortening the width of each connecting portion 35*b* and decreasing the number of the connecting portions 25*b*. However, as described above, when each connecting portion 35*b* is excessively thin (narrow), the developer bag 16 cannot obtain strength such that it can withstand a force at the time of the unsealing. For that reason, as a condition required for the connecting portions, there is a need to provide a thickness and the number (of the connecting portions) to some extent. Further, the developer is successively discharged from the developer bag 16 and therefore the developer is gradually accumulated in the developer accommodating unit, so that the developer is diffused to some extent in the longitudinal direction in accordance with angle of repose thereof. However, there arises such an adverse effect that it takes a long time from the unsealing of the developer bag 16 until the image can be formed and thus convenience of a user is impaired.

Therefore, in Sixth Embodiment, as shown in FIG. 42, in order to quickly supply the developer to also the immediately downstream position of the connecting portions 35*b*, columnar-like diffusing members 45 were provided immediately downstream of the openings 35*a*. In this embodiment, each of the diffusing members 45 was provided so as to cross a vertical line passing through an associated opening 35*a*. The diffusing member 45 as the columnar member is fixed on the second frame 18, described later and shown in FIG. 44, as its one end and has another end as a free end. Further, the diffusing member 45 has an inclined surface 45*a* inclined with respect to the longitudinal direction, and the inclined surface 45*a* opposes the opening 35*a*. For that reason, the developer discharged from the opening 35*a* once strikes the diffusing member 45 and is diffused in a direction (arrow N direction) along the inclined surface 45*a*. As a result, the developer can be quickly supplied to also the immediately downstream position of the connecting portion 35*b*.

However, on the other hand, the amount of the developer supplied to the immediately downstream position of the diffusing member 45 is decreased by being obstructed by the diffusing member 45. For this reason, the width of the diffusing member 45 may preferably be narrow to the possible extent. Further, as shown in FIG. 43, by disposing two or more diffusing members 45 to be close to each other, the developer diffused by a diffusing member 45 is supplied to the immediately downstream position of an adjacent (another) diffusing member 45.

Further, by adjusting the length of the diffusing member 45 with respect to a projection direction of the diffusing member 45, it is possible to prevent a state in which the developer is not supplied to the immediately downstream position of the diffusing member 45. This will be described with reference to FIG. 44. Of the opening 35*a*, a portion located at the closest position to the second frame 18 on which one end of the diffusing member 45 is fixed is referred to as a closest portion 35*a*1, and a portion located at the remotest position from the second frame 18 is referred to as a remotest portion 35*a*2. As described above, the developer bag 16 has flexibility and therefore the position of the opening 35*a* is changed during the unsealing, so that, it is possible to prevent stagnation of the developer in the neighborhood of the opening 35*a*. Further, as described above, the developer bag 16 is urged by the urging member (not shown) and therefore the developer is readily discharged in an arrow I direction. Thus, in the case where a state in which flowability of the developer is relatively high and the developer is vigorously discharged from the opening 35*a* is assumed, the developer is discharged in a region ranging from a downstream side (chain line I1) of the closest portion 35*a*1 to a downstream side (chain line I2) of the remotest portion 35*a*2 with respect to a developer discharging direction (arrow I direction).

From the above, by providing the diffusing member 45 in the region defined by the chain lines I1 and I2, it is possible to diffuse the developer discharged from the opening 35*a*. One end of the diffusing member 45 is fixed on the second frame 18 and another end of the diffusing member 45 is the free end. Further, an arrow W1 shows a direction in which the projection direction of the diffusing member 45 is viewed from the inside of the developer accommodating unit 25, and an arrow W2 shows a direction perpendicular to the arrow W1 direction.

Therefore, the diffusing member 45 is set so that the free end of the diffusing member 45 is located in the region defined by the chain lines I1 and I2. In this embodiment, the diffusing member 45 was set so that the free end of the diffusing member 45 crossed the vertical line passing through the opening 35*a*. At this time, at a portion of the diffusing member 45 ranging from the free end of the diffusing member 45 to the chain line I1, the developer discharged from the opening 35*a* is diffused by the diffusing member 45. On the other hand, at a portion of the diffusing member 45 ranging from the free end to the chain line I2, the developer discharged from the opening 35*a* is discharged as it is in the discharging direction (arrow I direction) without striking the diffusing member 45. That is, of the developer discharged from the opening 35*a*, only a part strikes the diffusing member 45 to be diffused, and a remaining part is discharged it is without striking the diffusing member 45. Each of the developing roller 13 and the developer supplying roller 23 is a rotatable member and therefore the non-uniformity of the developer supply amount with respect to a circumferential direction of each roller is uniformized by a rotating operation of each roller. As a result, the developer can be supplied (fed) to not only the immediately downstream position of the connecting portion 35*b* but also the immediately downstream position of the diffusing member 45.

However, even when the developer is placed in a high-flowability state to the possible extent as described above, the developer is placed in a low-flowability state to some extent, so that it would be also assumed that the developer is discharged in a partly agglomerated state. Also in such a state, as described above, it is desirable that the length of the diffusing member is set so that only a part of the developer discharged from the developer bag 16 is caused to strike the diffusing member 45 to be diffused.

Then, a constitution of the diffusing member 45 in the case where the low-flowability state of the developer is taken into consideration will be described with reference to FIG. 45. In the case where the flowability of the developer is low, when the developer is discharged from the opening 35*a*, the developer is not discharged vigorously but freely drops in a region ranging from a vertical line (chain line O1) passing through the closest portion 35*a*1 to a vertical line (chain line O2) passing through the remotest portion 35*a*2. An arrow O represents the direction of gravitation. In such a case, the free end of the diffusing member 45 may preferably be disposed in the region defined by the chain lines O1 and O2. As a result, only the part of the discharged developer strikes the diffusing member 45 to be diffused, so that it is possible to supply the developer to also the immediately downstream position of the diffusing member 45. In addition, by employing setting also following a condition of the position of the free end in the high-flowability state of the developer as described above, even when the flowability state of the developer is fluctuated to various states, the developer can be supplied to also the immediately downstream position of the diffusing member 45.

Then, a positional relation of the diffusing member 45 with the opening 35*a* and the connecting portion 35*b* with respect to the longitudinal direction will be described. In FIG. 42, there is no large difference in width between the opening 35*a* and the diffusing member 45, and in the case where the diffusing member 45 is viewed from the arrow W1 direction in FIG. 44, the diffusing member 45 is configured to have two inclined surfaces having the same (symmetrical) shape with respect to the longitudinal direction. In addition, the diffusing member 45 is disposed so that a top portion thereof is located immediately downstream (below) of a center of the opening 35*a*. As a result, the developer diffused, in the longitudinal direction along the two inclined surfaces 45*a* of the diffusing member 45 is supplied to the immediately downstream position of the adjacent connecting portions 35*b*.

On the other hand, as shown in FIG. 46, in the case where the width of the opening 35*a* is wider than the width of the diffusing member 45 to some extent or more, the diffusing member 45 may preferably be disposed immediately downstream of the opening 35*a* at a position closer to the adjacent connecting portion 35*b*. Further, in this case, the diffusing member 45 may only be required to diffuse the developer in only a side closer to the immediately downstream position of the connecting portion 35*b*, so that there is no need to provide the diffusing member 45 with the two inclined surfaces 45*a* in order to diffuse the developer in the longitudinal direction. For that reason, the diffusing member 45 may have an almost triangular, shape as shown in FIG. 47 and a flat plate-like shape as shown in FIG. 48. Further, when the diffusing member 45 has the inclined surface 45*a*, at the immediately downstream position of the connecting portion 35*b*, for permitting the supply of the developer, the shape of the diffusing member 45 is not limited to those described above but may also be changed to various shapes.

Figure 49:
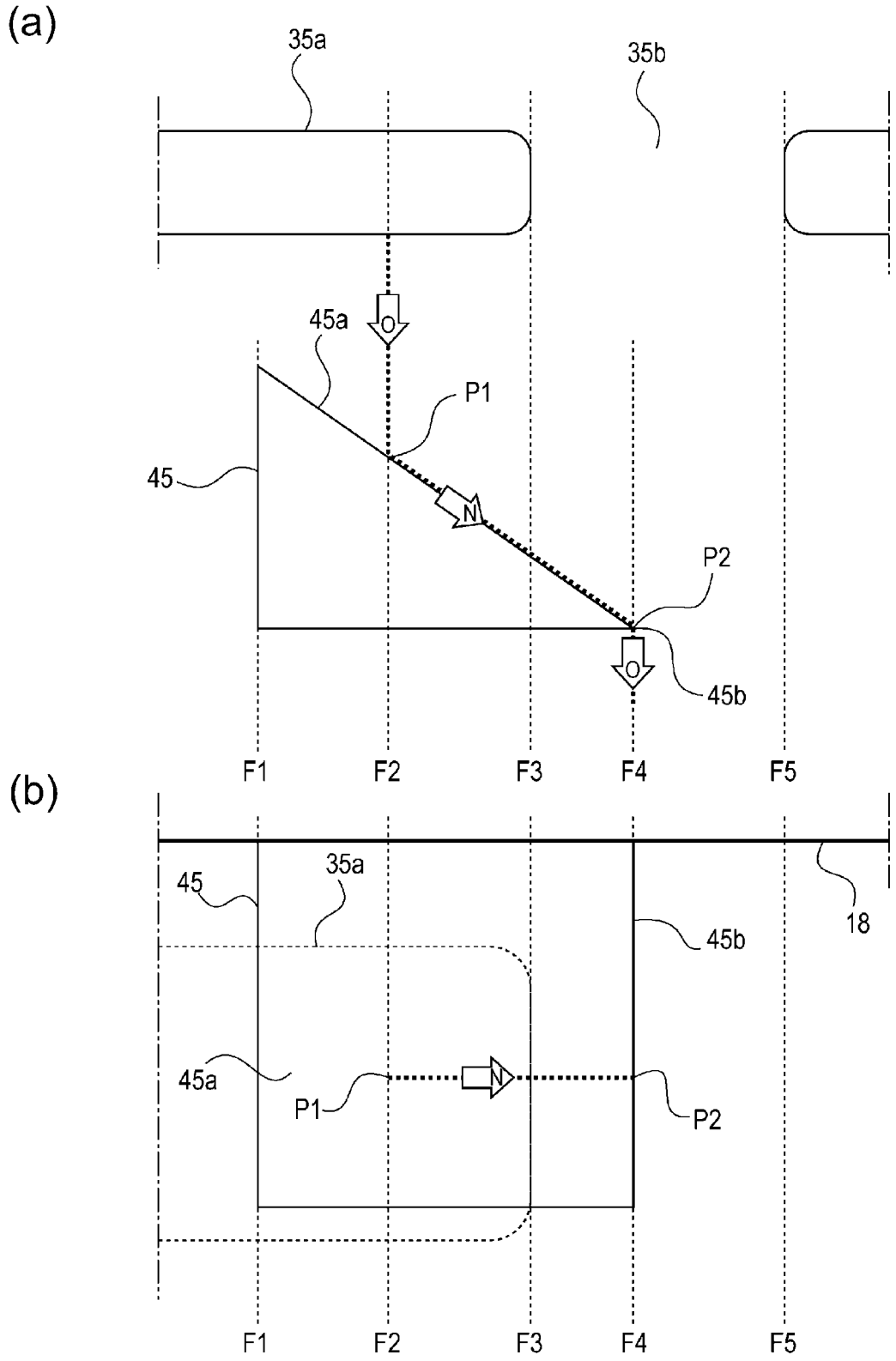
Figure 50:
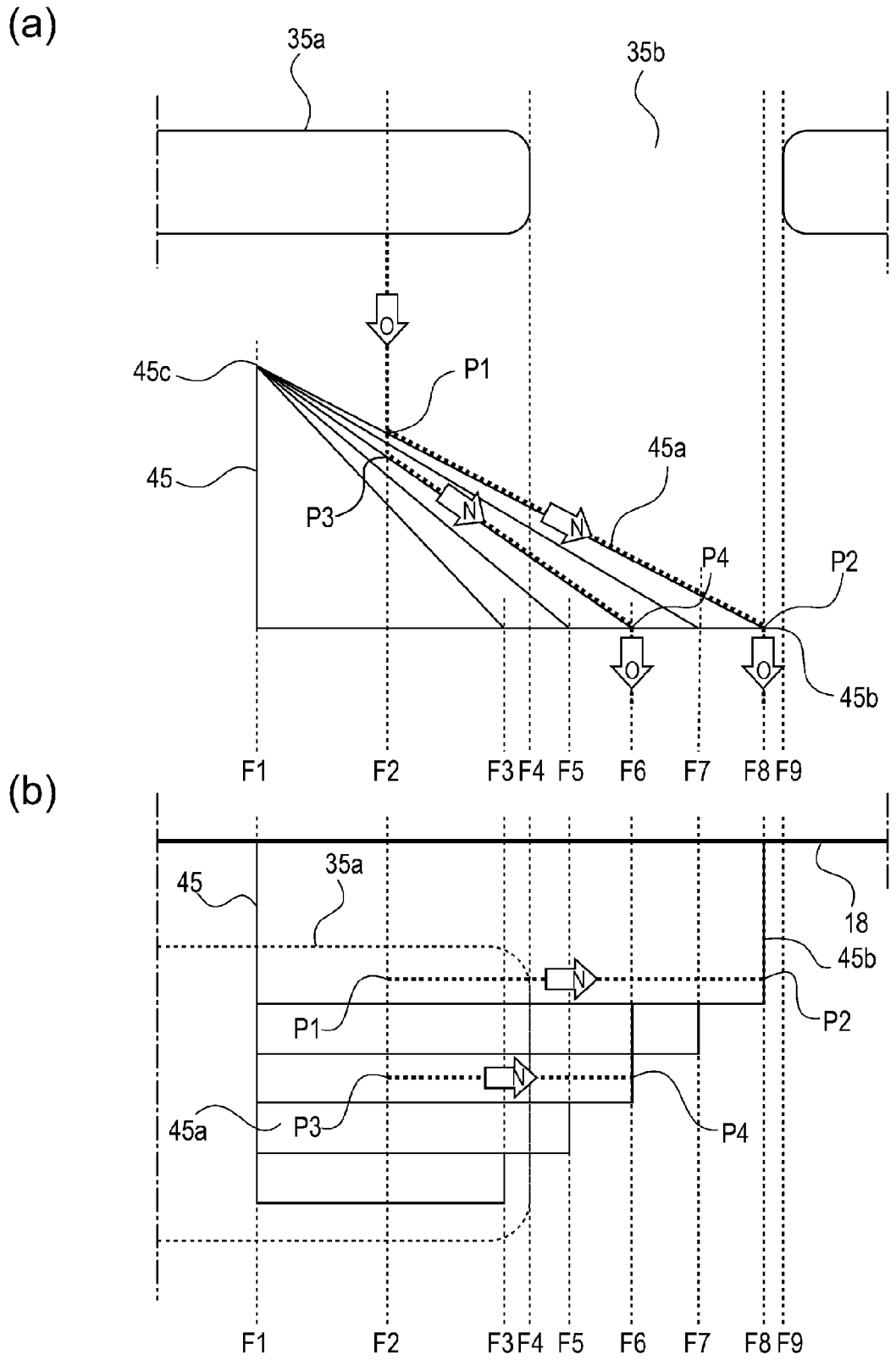

Further, in the case where the state in which the flowability of the developer is low and thus the developer is not readily diffused is taken into consideration as described above, the diffusing member 45 may preferably be disposed as shown in (a) and (b) of FIG. 49. With respect to the diffusing member 45 and the opening 35*a*, the case where these are viewed from the arrow W1 direction in FIG. 44 is shown in (a) of FIG. 49, and the case where these are viewed from the arrow W2 direction in FIG. 44 is shown in (b) of FIG. 49. With respect to broken lines F1 to F5, in (a) and (b) of FIG. 49, each of the same broken lines represents the same longitudinal position. In the form shown in FIG. 49, in order to receive the developer discharged from the opening 35*a*, a part of the inclined surface 45*a* was disposed at the immediately downstream position of the opening 35*a*. On the other hand, a lower end 45*b* of the inclined surface 45*a* was disposed at the immediately downstream position of the connecting portion 35*b*. In this embodiment, the diffusing member 45 was provided so that the lower end 45*b* of the inclined surface 45*a* crossed a vertical line passing through the connecting portion 35*b*. In this case, of the inclined surface 45*a*, at a portion (first inclined surface portion) located at the immediately downstream position of the opening 35*a*, the developer discharged from the opening 35*a* directly strikes the diffusing member 45. On the other hand, of the inclined surface 45*a*, at a portion (second inclined surface portion) located at the immediately downstream position of the connecting portion 35*b*, the developer discharged from the opening 35*a* does not strike the diffusing member 45 directly. However, the developer discharged from the opening 35*a* strikes a point P1 on the first inclined surface portion and moves in a direction (arrow N direction) along the inclined surface 45*a*. For that reason, the developer is supplied to also a point P2 at the lower end 45*b* of the inclined surface portion constituting the second inclined surface portion where the developer discharged from the opening 35*a* does not strike the diffusing member 45. Thereafter, the developer drops from the point P2 in the direction of gravitation (arrow O direction), so that the developer can be supplied to also the immediately downstream position of the connecting portion 35*b*.

However, in the case of the constitution shown in FIG. 49, the developer diffused by the diffusing member 45 is supplied to only one longitudinal position of longitudinal positions immediately below the connecting portion 35*b*. Therefore, a constitution for uniformly supply the developer to several immediately downstream positions of the connecting portion 35*b* is shown in (a) and (b) of FIG. 50. Similarly as in (a) and (b) of FIG. 49, the case where the diffusing member 45 and the opening 35*a* are viewed from the arrow W1 direction in FIG. 44 is shown in (a) of FIG. 50, and the case where these are viewed from the arrow W2 direction in FIG. 44 is shown in (b) of FIG. 50. Similarly, with respect to broken lines F1 to F9, in (a) and (b) of FIG. 50, each of the same broken lines represents the same longitudinal position. In the constitution in FIG. 50, the diffusing member 45 has a plurality of inclined surfaces 45*a*, and an inclination angle of the inclined surface 45*a* becomes steeper at a position closer to the end of the diffusing member 45. For that reason, the width of the diffusing member 45 becomes narrower at the position closer to the end of the diffusing member 45, so that the longitudinal position of the lower end 45*b* of the inclined surface 45*a* approaches the longitudinal position of an upper end 45*c* of the diffusing member 45. Thus, the diffusing member 45 has the inclined surface 45*a* as a changing portion where the width of the diffusing member 45 with respect to the longitudinal direction of the frame is changed depending on the position. Similarly as in the constitution in FIG. 49, the developer discharged from the opening 35*a* drops on the point P1 of the inclined surface 45*a* and thereafter moves in the direction (arrow N direction) along the inclined surface 45*a*, so that the developer drops from the lower end point P2 of the inclined surface 45*a* in the direction of gravitation (arrow O direction). Further, with respect to the developer dropping on a point P3 of the inclined surface 45*a* other than the inclined surface 45*a* including the point P1, the developer drops from a point P4 at the longitudinal position other than the longitudinal position of the point P2. Thus, in the constitution in FIG. 50, the plurality of inclined surfaces 45*a* are provided and are configured to have associated lower ends 45*b* different in longitudinal direction, so that the developer can be supplied to several longitudinal positions by a single diffusing member.

Figure 51:
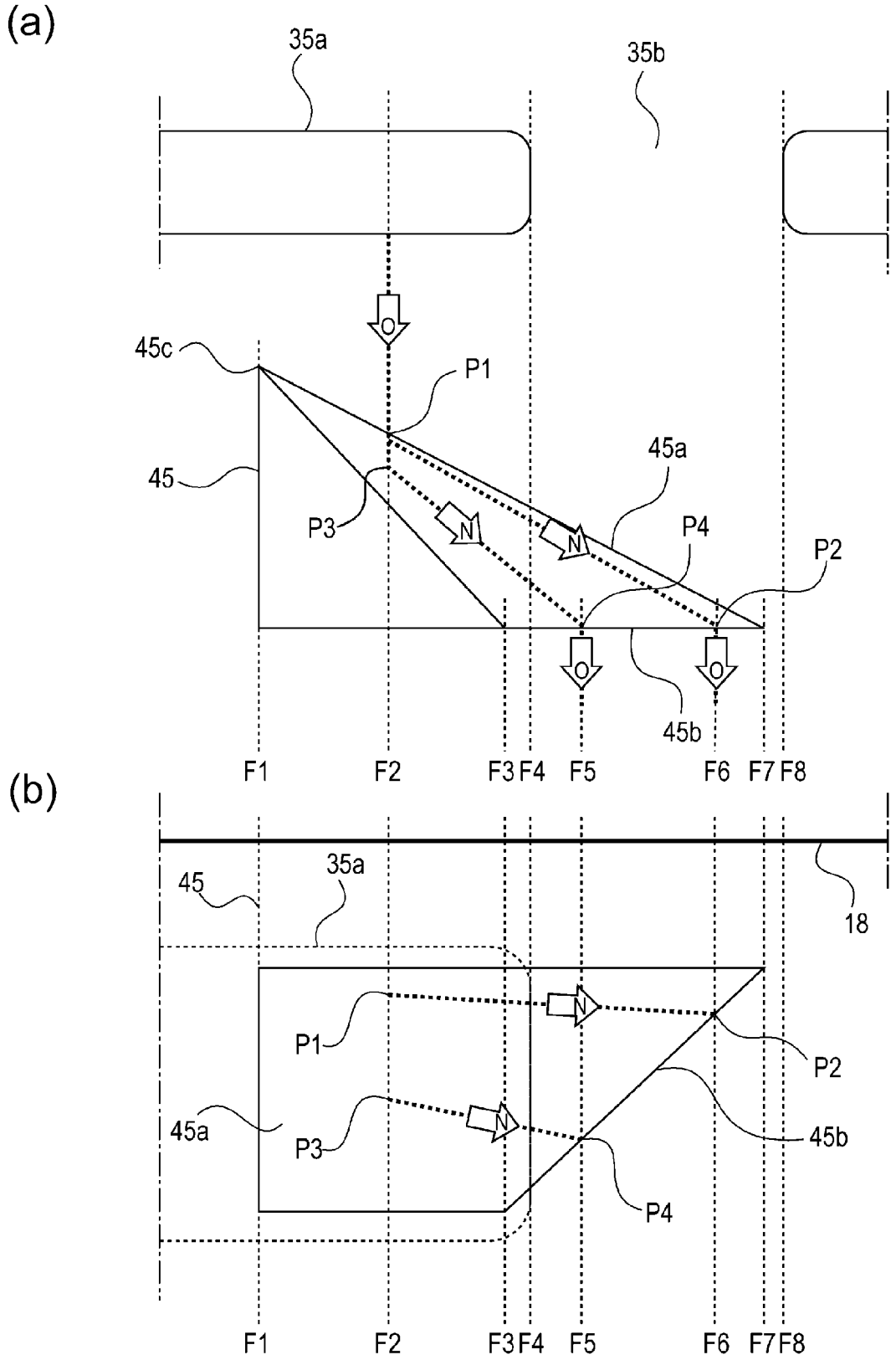

In addition, similarly, as the diffusing member 45 for supplying the developer to several longitudinal positions, another constitution is shown in FIG. 51. Similarly as in FIGS. 49 and 50, the case where the diffusing member 45 and the opening 35*a* are viewed from the arrow W1 direction in FIG. 44 is shown in (a) of FIG. 51, and the case where these are viewed from the arrow W2 direction in FIG. 44 is shown in (b) of FIG. 51. Similarly, with respect to broken lines F1 to F8, in (a) and (b) of FIG. 51, each of the same broken lines represents the same longitudinal position. In the constitutions in FIGS. 49 and 50, each of the inclined surfaces 45*a* as the changing portion was the surface parallel to the arrow W1 direction in FIG. 44 and therefore one inclined surface 45*a* has the lower end 45*b* at only one longitudinal position. On the other hand, in the constitution in FIG. 51, the inclined surface 45*a* as the changing portion was not the surface parallel to the arrow W1 direction in FIG. 44 but has a lower end 45*b* which has a width with respect to the longitudinal direction to some extent. For example, the developer dropping on the point P1 of the inclined surface 45*a* moves in the direction (arrow N direction) along the inclined surface 45*a*, so that the developer drops from the lower end point P2 of the inclined surface 45*a* in the direction of gravitation (arrow O direction). On the other hand, the developer dropping on another point P3 of the inclined surface 45*a* including also the point P1 drops from a point P4 at the longitudinal position other than the longitudinal position of the point P2. Thus, when the drop positions of the developer discharged from the developer bag 16 are different from each other, the longitudinal positions of the points on the inclined surface lower ends to which the developer is moved along the inclined surface 45*a* are also different from each other, so that the developer can be supplied further uniformly.

Figure 52:
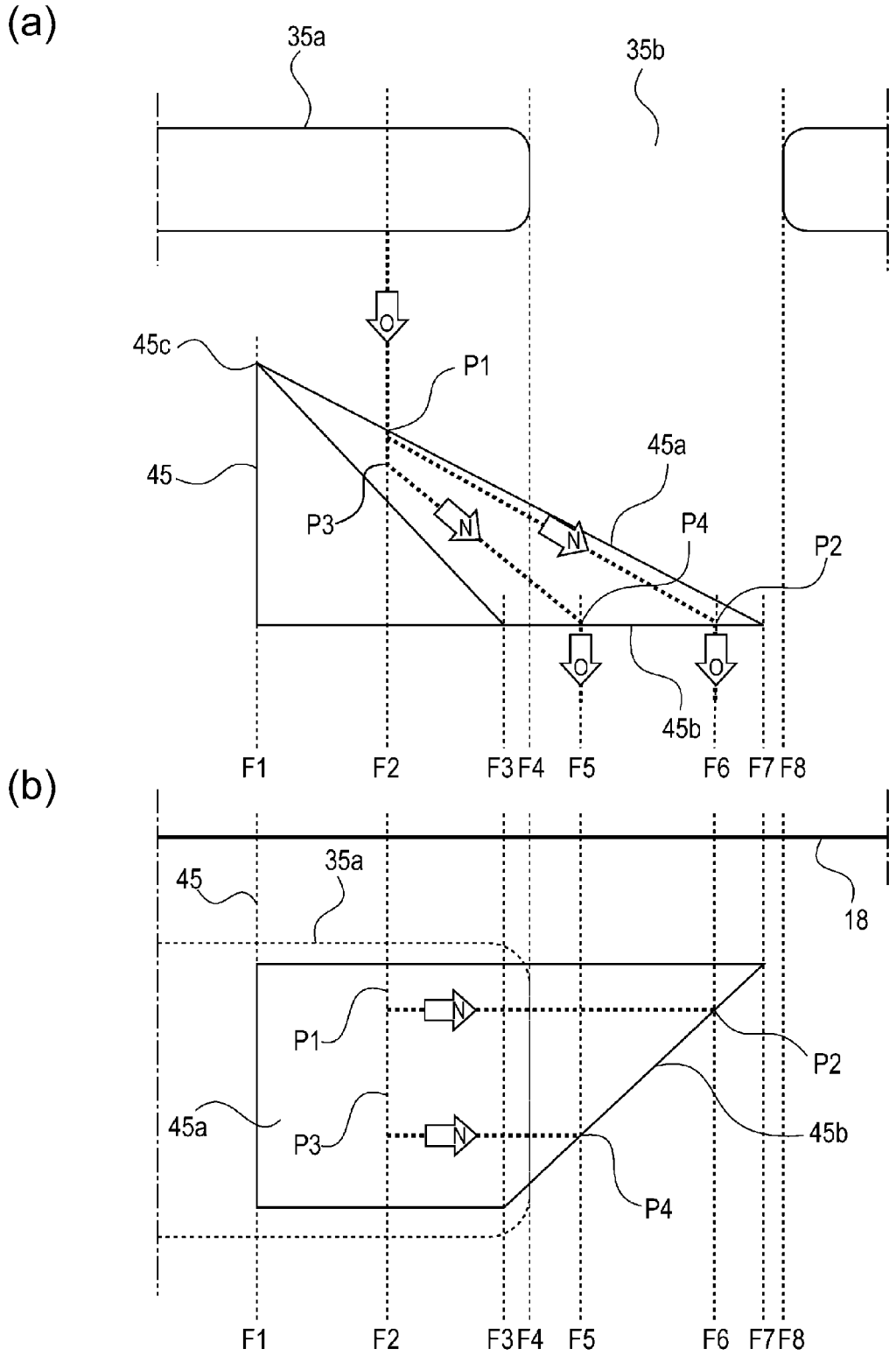

Further, as the diffusing member 45 for supplying the developer to several longitudinal positions, another constitution is shown in (a) and (b) of FIG. 52. Also with respect to the constitution in (a) and (b) of FIG. 52, the case where the diffusing member 45 and the opening 35*a* are viewed from the arrow W1 direction in FIG. 44 is shown in (a) of FIG. 52, and the case where these are viewed from the arrow W2 direction in FIG. 44 is shown in (b) of FIG. 52. Similarly, with respect to broken lines F1 to F8, in (a) and (b) of FIG. 52, each of the same broken lines represents the same longitudinal position. In the constitution in FIG. 52, the length of the diffusing member 45 with respect to the direction of gravitation (arrow O direction) is made shorter with a position closer to the end of the diffusing member 45. Even when the changing portion of the diffusing member 45 is configured in such a manner, similarly as in the constitution of FIG. 51, the lower end 45*b* of the inclined surface 45*a* has a shape such that it has a width with respect to the longitudinal direction, so that the developer can be supplied to the several longitudinal positions.

Incidentally, the shape of the diffusing member 45 for supplying the developer to the immediately downstream position of the connecting portion 35*b* is not limited to those in the constitutions shown in FIGS. 49 to 52 but may also be changed to various shapes.

[Seventh Embodiment]

The diffusing member 45 described in Sixth Embodiment may also be a separate member from the shielding member 42 for preventing the contact of the sealing member 19 with the developer supplying roller 23 as described in First to Fifth Embodiments. In this case, similarly as in First to Fifth Embodiments, the shielding member 42 is configured to positively permit the passing of the developer.

Further, on the other hand, the diffusing member 45 may also have the function as the shielding member 42 for preventing the contact of the sealing member 19 with the developer supplying roller 23. In such a case, there is a need to satisfy both of the arrangements and the shapes of the shielding member 42 and the diffusing member 45 as described in the above-described embodiments. As the function of the shielding member 42 for preventing the sealing member 19 from contacting the developer supplying roller 23, the shielding member 42 is required to have the length with respect to the projection direction to some extent or more. On the other hand, in order to supply the developer to also the immediately downstream position of the diffusing member 45, the length of the diffusing member 45 with respect to the projection direction may preferably be short to some extent. In this case, as shown in FIG. 54, of the diffusing member 54, only a part thereof ranging from the immediately downstream position of the opening 35*a* to the free end thereof may only be required to constitute a non-diffusing portion 46 having a width and a shape to the extent not impairing the developer supply. As a result, it is possible to supply the developer to the immediately downstream position of the diffusing member 45 while preventing the contact of the sealing member 19 with the developer supplying roller 23.

[Eighth Embodiment]

Figure 55:
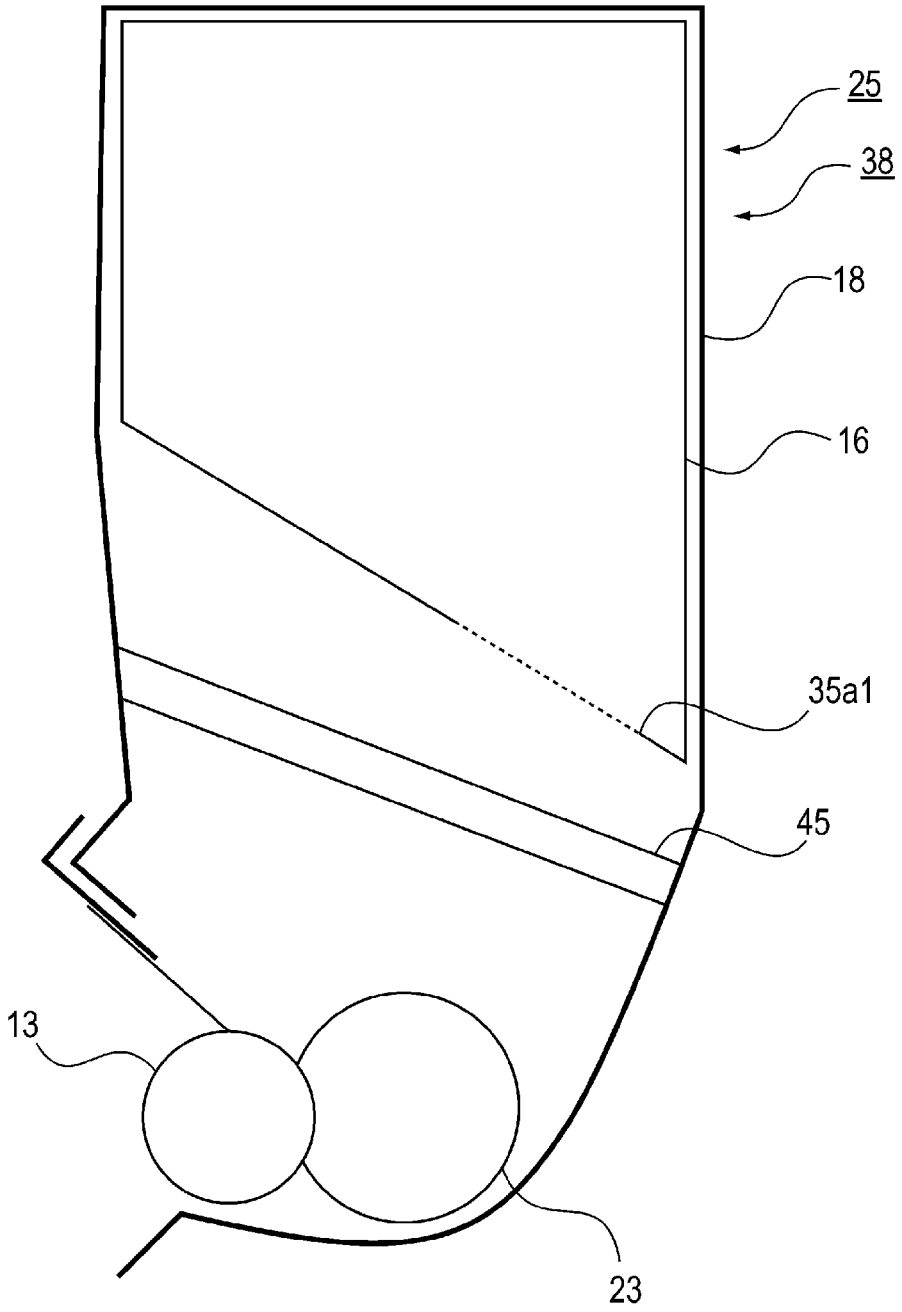

In Sixth and Seventh Embodiments, the case where one end of the diffusing member 45 is fixed on the Second frame 18 and another end is the free end was described. However, there is no need that another end is not necessarily be the free end, and as shown in FIG. 55, the diffusing member 45 may also have a beam-like shape such that another end thereof is fixed on the first frame 17. Thus, by providing the beam-like member in the frames, the strength of the developer accommodating unit 25 can be enhanced, so that the developer accommodating unit 25 can be made is less deformable. Further, by fixing the diffusing member 45 at its both ends, stress acting on the diffusing member 45 can be dispersed toward the both ends, so that also the strength of the diffusing member 45 itself can be enhanced. Also in such a case, the developer discharged from the developer bag 16 is diffused by the diffusing member 45, so that the developer can be quickly supplied to the immediately downstream position of the connecting portion 35*b*.

Figure 56:
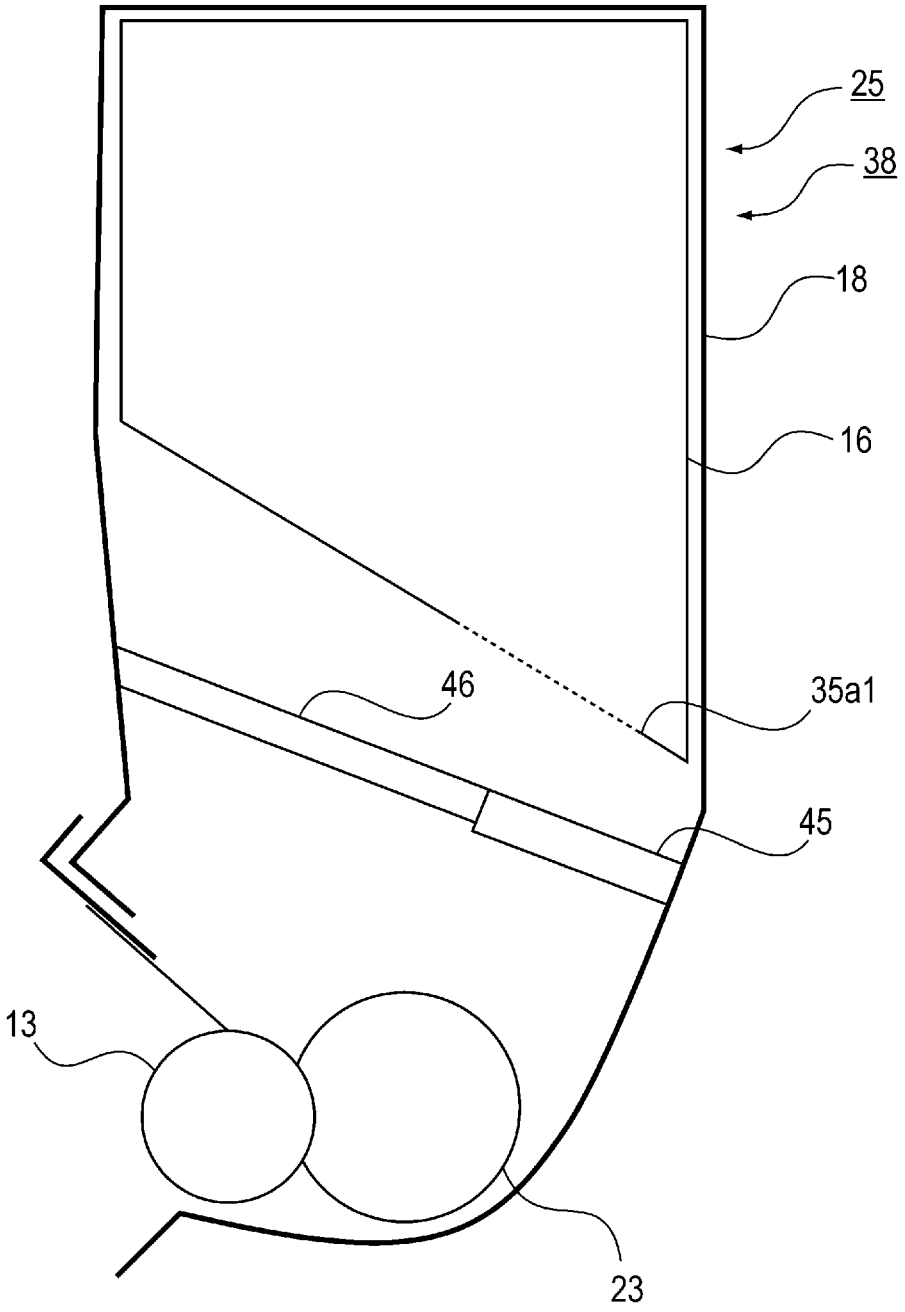

In addition, as shown in FIG. 56, the portion fixed on the first frame may also be the non-diffusing portion 46.

Figure 57:
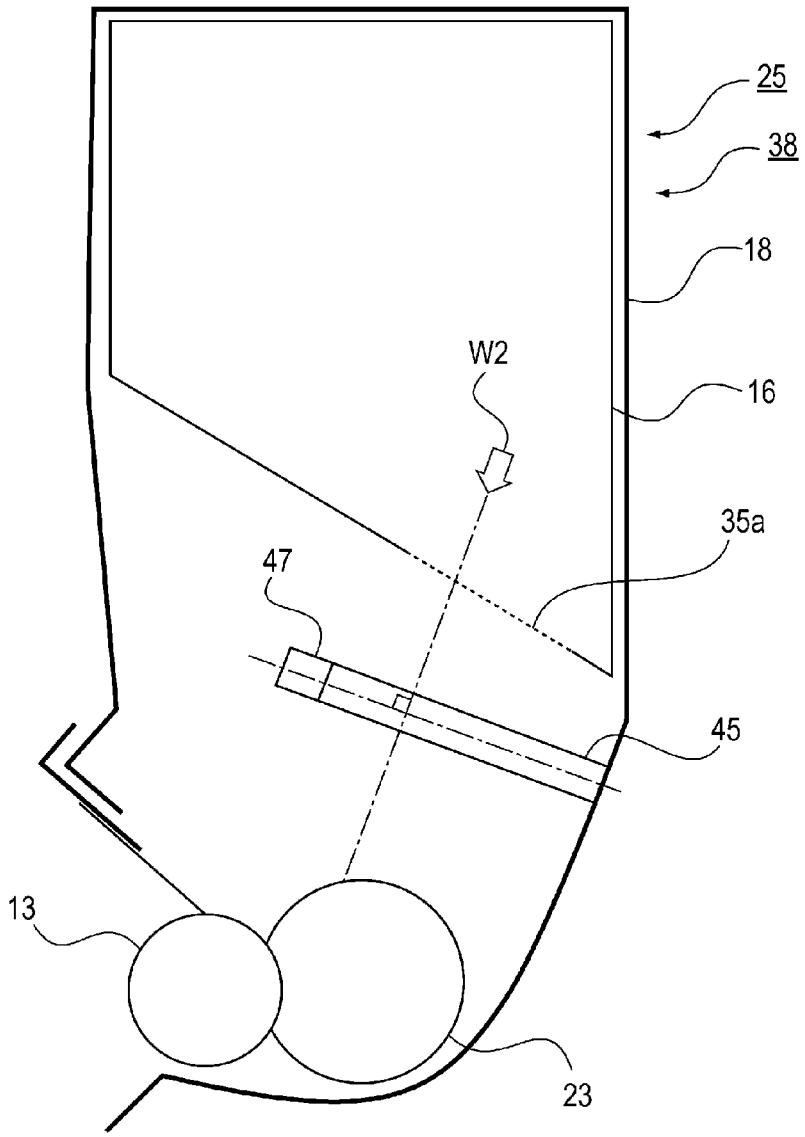
Figure 57:
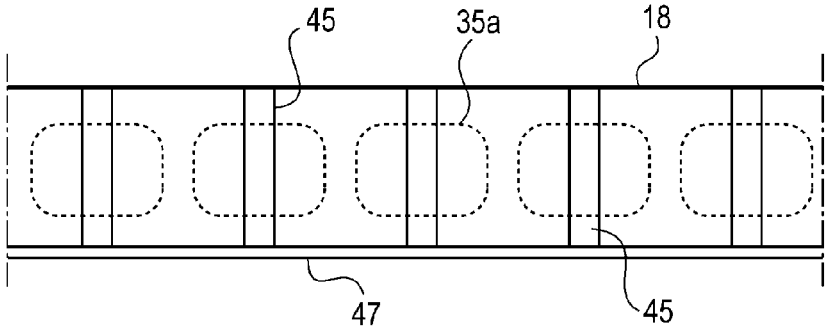
Figure 58:
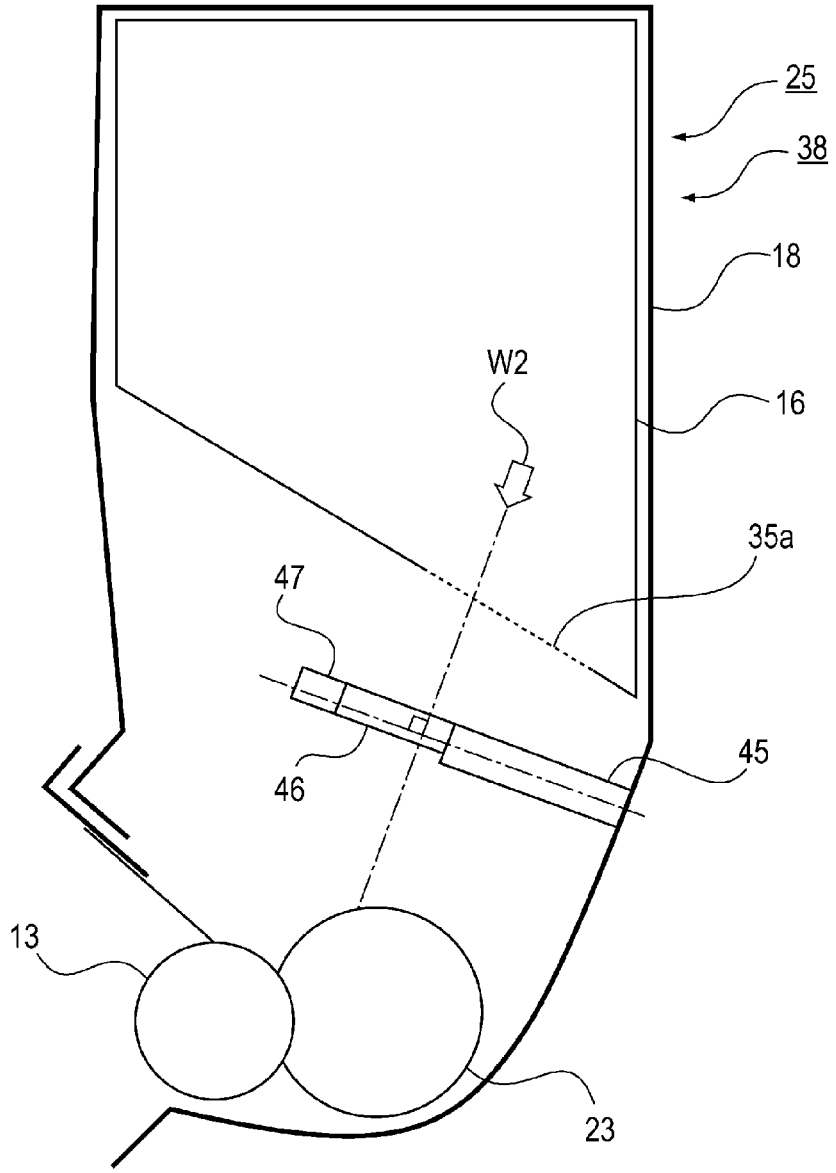
Figure 58:
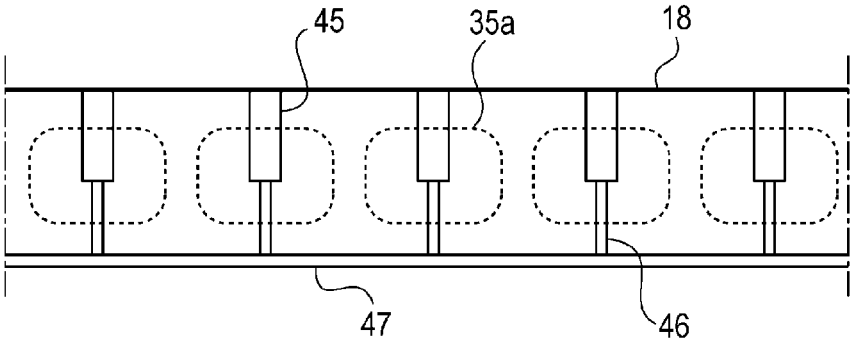

Further, as shown in (a) and (b) of FIG. 57, a crossing-linking member (connecting member) 47 for connecting a plurality of diffusing members 45 may also be provided at free ends of the diffusing members 45. Part (b) of FIG. 57 is a schematic view as seen from an arrow W2 direction in (a) of FIG. 57. Also in the case where the cross-linking member 47 is provided, the strength of the diffusing members 45 can be enhanced. Similarly, as shown in (a) and (b) of FIG. 58, each of a plurality of diffusing members 45 has a non-diffusing portion 46, and the non-diffusing portions 46 may be connected by a cross-linking member 47. Part (b) of FIG. 58 is a schematic view as seen from an arrow W2 direction in (a) of FIG. 58.

In the above-described embodiments, as the process cartridge detachably mountable to the image forming main assembly, a process cartridge integrally including the photosensitive drum and, as process means acting on the photosensitive drum, the charging means, the developing means and the cleaning means was exemplified. However, the process cartridge is not limited thereto. For example, the process cartridge including, in addition to the photosensitive drum, either one of the charging means, the developing means and the cleaning means may also be used.

Further, in the above-described embodiments, the constitution in which the process cartridge including the photosensitive drum is detachably mountable to the image forming apparatus main assembly is exemplified but the present invention is not limited thereto. For example, an image forming apparatus in which the respective constituent elements are incorporated and an image forming apparatus to which each of the constituent elements is detachably mounted may also be used.

Further, in the above-described embodiments, the printer is exemplified as the image forming apparatus but the present invention is not limited thereto. For example, other image forming apparatuses such as a copying machine, a facsimile machine, a multi-function machine having a combined function of these machines, and the like machine may also be used. A similar effect can be obtained by applying the present invention to these image forming apparatuses.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 260032/2011 filed Nov. 29, 2011 and 249882/2012 filed Nov. 14, 2012, which are hereby incorporated by reference.

What is claimed is:

1. A developing device comprising:

a flexible container for accommodating developer, said flexible container provided with an opening for permitting discharge of the developer;

a frame for accommodating said flexible container and for accommodating the developer discharged from said flexible container;

an urging member, rotatably provided inside said frame, for urging said flexible container by rotation thereof to deform said flexible container; and a developer carrying member for carrying the developer on its surface, wherein a distance X from a rotation center of said urging member to said surface of said developer carrying member is less than a distance T from the rotation center of said urging member to a free end of said urging member for urging said flexible container, and wherein a shielding member for preventing contact of said urging member with said developer carrying member is provided between the rotation center of said urging member and said surface of said developer carrying member.

2. A developing device according to claim 1, wherein said developer carrying member is one of (i) a developer carrying member for feeding the developer to a developing portion that opposes an electrophotographic photosensitive member while carrying the developer on its surface and (ii) a developer supplying member for removing from another developer carrying member the developer remaining at a developing portion after development and for supplying a fresh developer to another developer carrying member, and wherein said shielding member prevents said urging member from contacting said developer carrying member or said developer supplying member.

3. A developing device according to claim 1, wherein said shielding member includes a plurality of shielding portions for preventing contact of said urging member with said developer carrying member, and wherein said plurality of shielding portions is provided at predetermined intervals for permitting discharge of the developer.

4. A developing device according to claim 1, wherein said urging member includes:

a shaft portion rotatably provided in said frame;

a first urging member, wherein said first urging member (i) is mounted to said shaft portion, (ii) has elasticity, and (iii) satisfies the relationship of $X < T$, and wherein said free end of said urging member is a free end of said first urging member; and a second urging member that is mounted to said shaft portion, wherein a distance Y from the rotation center to a free end of said second urging member is shorter than the distance T of said first urging member and satisfies the relationship of $X > Y$, and wherein said second urging member includes a notch portion or a cut away portion at a position where said second urging member contacts said shielding member.

5. A developing device according to claim 4, wherein said first urging member is a sealing member for sealing the opening of said flexible container, and wherein said sealing member is wound up by rotation of said shaft portion to unseal the opening.

6. A developing device according to claim 1, wherein said urging member urges said flexible container against said frame.

7. A developing device according to claim 1, wherein said urging member changes a position of the opening of said flexible container by urging said flexible container.

8. A developing device according to claim 1, wherein said flexible container is provided with a plurality of openings.

9. A developing device according to claim 1, wherein said flexible container has a shape including a plurality of surfaces between which a bent portion is interposed, and wherein said urging member urges a surface where the opening of said flexible container exists.

10. A developing device according to claim 1, wherein said flexible container is provided so that the opening thereof is open into a downward direction of the gravitation direction during image formation.

11. A developing device according to claim 1, wherein said urging member is a stirring member for stirring the developer, inside said frame, discharged from said flexible container.

12. A developing device according to claim 1, wherein said shielding member includes a columnar member, and wherein said columnar member crosses a vertical line passing through the opening.

13. A developing device according to claim 12, wherein said columnar member has at least one inclined surface that opposes the opening and which is inclined with respect to a longitudinal direction of said frame.

14. A developing device according to claim 13, wherein said flexible container includes a connecting portion between adjacent openings, and wherein a lower end of said inclined surface crosses a vertical line passing through said connecting portion.

15. A developing device according to claim 12 wherein said columnar member has an end as a free end that crosses a vertical line passing through the opening.

16. A developing device according to claim 12, wherein said columnar member is provided at a position where the developer discharged through the opening strikes said columnar member and diffuses the developer discharged through the opening.

17. A developing device according to claim 16, wherein said columnar member has at least one inclined surface that opposes the opening and which diffuses the developer in a longitudinal direction of said frame.

18. A developing device according to claim 17, wherein said inclined surface includes:

a first inclined surface at which the developer discharged through the opening strikes; and a second inclined surface at which the developer discharged through the opening does not strike, wherein the developer that strikes said first inclined surface is directed toward said second inclined surface by an inclination of said inclined surface.

19. A developing device according to claim 16, wherein said columnar member has an end as a free end provided at a position where the developer discharged through the opening strikes.

20. A developing device according to claim 12, wherein the opening includes a connecting portion between itself and an adjacent opening, and wherein a width of said columnar member with respect to a longitudinal direction of said frame is narrower than a width of said connecting portion with respect to the longitudinal direction of said frame.

21. A developing device according to claim 12, wherein said columnar member includes a changing portion for changing a width thereof, with respect to the longitudinal direction of said frame, depending on a position thereof.

22. A developing device according to claim 21, wherein said changing portion is positioned immediately below the opening.

23. A developing device according to claim 12, further comprising a cross-linking member, distinct from said frame, for connecting a plurality of adjacent columnar members.

24. A developing device according to claim 12, wherein said columnar member (i) is such that a distance X from a rotation center of said urging member to said surface of said developer carrying member and a distance T from the rotation center of said urging member to a free end thereof for urging said flexible container satisfy a relationship of $X<T$ and (ii) is provided between the rotation center of said urging member and said surface of said developer carrying member to prevent contact of said urging member with said developer carrying member.

25. A developing device according to claim 24, wherein said developer carrying member is one of (i) a developer carrying member for feeding the developer to a developing portion that opposes an electrophotographic photosensitive member while carrying the developer on its surface or (ii) a developer supplying member for removing from another developer carrying member the developer remaining at a developing portion after development and for supplying a fresh developer to said another developer carrying member, and wherein said columnar member prevents said urging member from contacting said developer carrying member or said developer supplying member.

26. A developing device according to claim 24, wherein said urging member includes:

a shaft portion rotatably provided in said frame;

a first urging member;

a second urging member that is mounted to said shaft portion, wherein said first urging member (i) is mounted to said shaft portion, (ii) has elasticity, and (iii) satisfies the relationship of $X<T$, wherein said free end of said urging member is a free end of said first urging member, and wherein a distance Y from the rotation center to a free end of said second urging member is shorter than the distance T of said first urging member and satisfies a relationship of $X>Y$, and wherein said second urging member includes a notch portion or a cut away portion at a position where said second urging member contacts said columnar member.

27. A developing device according to claim 26, wherein said first urging member is a sealing member for sealing the opening of said flexible container, and wherein said sealing member is wound up by rotation of said shaft portion to unseal the opening.

28. A developing device according to claim 24, wherein said urging member urges said flexible container against said frame.

29. A developing device according to claim 24, wherein said urging member changes a position of the opening of said flexible container by urging said flexible container.

30. A developing device according to claim 24, wherein said flexible container has a shape including a plurality of surfaces between which a bent portion is interposed, and wherein said urging member urges a surface where the opening of said flexible container exists.

31. A developing device according to claim 12, wherein said flexible container is provided so that the opening thereof is open into a downward direction of the gravitation direction during image formation.

32. A developing device according to claim 24, wherein said urging member is a stirring member for stirring the developer inside said frame that is discharged from said flexible container.

33. A cartridge detachably mountable to a main assembly of an image forming apparatus, said cartridge comprising:

an electrophotographic photosensitive member; and a developing device according to claim 1 that is provided integrally with said electrophotographic photosensitive member.

34. An electrophotographic image forming apparatus comprising a cartridge according to claim 33.

* * * * *